US010152846B2

(12) United States Patent
Kiely et al.

(10) Patent No.: US 10,152,846 B2
(45) **Date of Patent: *Dec. 11, 2018**

(54) BONUSING ARCHITECTURES IN A GAMING ENVIRONMENT

(71) Applicant: IGT, Las Vegas, NV (US)

(72) Inventors: Daryn G. Kiely, Las Vegas, NV (US); William R. Brosnan, Reno, NV (US); Richard Glasser, Henderson, NV (US); Adrian R. Marcu, Las Vegas, NV (US); Erik B. Petersen, Reno, NV (US); William C. Little, Las Vegas, NV (US); Jeffery S. Shepherd, Reno, NV (US); Bryan D. Wolf, Reno, NV (US); Steven G. LeMay, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/238,403

(22) Filed: Aug. 16, 2016

(65) Prior Publication Data

US 2016/0358416 A1 Dec. 8, 2016

Related U.S. Application Data

(63) Continuation of application No. 12/271,884, filed on Nov. 15, 2008, which is a continuation-in-part of (Continued)

(51) Int. Cl.

| | |
|---|---|
| ***G07F 17/32*** | (2006.01) |
| ***G06Q 50/34*** | (2012.01) |
| ***G07F 17/42*** | (2006.01) |

(52) U.S. Cl.

CPC ..... *G07F 17/3227* (2013.01); *G06Q 50/34* (2013.01); *G07F 17/32* (2013.01); (Continued)

(58) Field of Classification Search

CPC .. G07F 17/3227; G07F 17/32; G07F 17/3202; G07F 17/3211; G07F 17/3223; (Continued)

(56) References Cited

U.S. PATENT DOCUMENTS

| | | | |
|---|---|---|---|
| 3,662,105 | A | 5/1972 | Parks |
| 3,708,219 | A | 1/1973 | Forlini et al. |

(Continued)

FOREIGN PATENT DOCUMENTS

| | | |
|---|---|---|
| AU | 1996 50576 | 4/1997 |
| AU | 704691 | 4/1997 |

(Continued)

OTHER PUBLICATIONS

Australian Examiner's First Report dated May 25, 2011 issued in AU 2007239023.

(Continued)

*Primary Examiner* — Werner Garner

(74) *Attorney, Agent, or Firm* — Neal, Gerber & Eisenberg LLP

(57) ABSTRACT

A gaming system including a plurality of gaming machines is provided. The gaming machines may be configured to provide bonus games with persistent. The gaming machines may be configured to allow a player to enroll in bonus game with persistence and generate a record locator, such as printed ticket that allows a record of a state in the bonus game with persistence to be accessed at a later time. A server coupled to the plurality of gaming machines may maintain records of various states in the bonus game with persistence. When a valid record locator is presented at a gaming machine, these records may be checked out and updated via game play at the gaming machine.

22 Claims, 18 Drawing Sheets

Related U.S. Application Data application No. 12/209,608, filed on Sep. 12, 2008, now Pat. No. 9,311,774, which is a continuation-in-part of application No. 11/595,774, filed on Nov. 10, 2006, now Pat. No. 8,777,737.

(60) Provisional application No. 61/055,316, filed on May 22, 2008, provisional application No. 60/993,985, filed on Sep. 13, 2007.

(52) U.S. Cl.
CPC ..... *G07F 17/3202* (2013.01); *G07F 17/323* (2013.01); *G07F 17/3211* (2013.01); *G07F 17/3223* (2013.01); *G07F 17/3239* (2013.01); *G07F 17/3246* (2013.01); *G07F 17/3248* (2013.01); *G07F 17/3286* (2013.01); *G07F 17/42* (2013.01)

(58) Field of Classification Search
CPC ..... G07F 17/323; G07F 17/3239; G07F 17/3246; G07F 17/3248; G07F 17/3286; G07F 17/42; G06Q 50/34
See application file for complete search history.

(56) References Cited

U.S. PATENT DOCUMENTS 3,792,437 A 2/1974 Blumenthal et al.
3,931,504 A 1/1976 Jacoby
4,071,689 A 1/1978 Talmage
4,072,930 A 2/1978 Lucero
4,124,109 A 11/1978 Bissell et al.
4,218,011 A 8/1980 Simjian
4,283,709 A 8/1981 Lucero
4,333,715 A 6/1982 Brooks
4,333,735 A 6/1982 Hardy et al.
4,339,709 A 7/1982 Brihier
4,339,798 A 7/1982 Hedges
4,430,728 A 2/1984 Beitel et al.
4,454,594 A 6/1984 Heffron et al.
4,517,558 A 5/1985 Davids
4,553,222 A 11/1985 Kurland
4,607,844 A 8/1986 Fullerton
4,621,814 A 11/1986 Stepan et al.
4,659,182 A 4/1987 Aizawa
4,689,742 A 8/1987 Troy et al.
4,718,672 A 1/1988 Okada
4,856,787 A 8/1989 Itkis
4,911,449 A 3/1990 Dickinson et al.
4,912,548 A 3/1990 Shanker et al.
5,038,022 A 8/1991 Lucero
5,039,848 A 8/1991 Stoken
5,042,809 A 8/1991 Richardson
5,048,831 A 9/1991 Sides
5,086,354 A 2/1992 Bass et al.
5,097,981 A 3/1992 Degasperi et al.
5,113,272 A 5/1992 Reamey
5,132,839 A 7/1992 Travis
5,158,293 A 10/1992 Mullins
5,179,517 A 1/1993 Sarbin
5,221,838 A 6/1993 Gutman
5,265,874 A 11/1993 Dickinson et al.
5,290,033 A 3/1994 Bittner et al.
5,319,491 A 6/1994 Selbrede
5,325,830 A 7/1994 Hammer
5,342,047 A 8/1994 Heidel et al.
5,348,299 A 9/1994 Clapper, Jr.
5,364,100 A 11/1994 Ludlow et al.
5,371,345 A 12/1994 LeStrange
5,376,587 A 12/1994 Buchmann et al.
5,393,061 A 2/1995 Manship et al.
5,397,125 A 3/1995 Adams
5,408,417 A 4/1995 Wilder
5,429,361 A 7/1995 Raven
5,457,306 A 10/1995 Lucero
5,467,893 A 11/1995 Landis, II et al.
5,470,079 A 11/1995 LeStrange
5,483,049 A 1/1996 Schulze, Jr.
5,487,544 A 1/1996 Clapper, Jr.
5,489,096 A 2/1996 Aron
5,502,636 A 3/1996 Clarke
5,539,547 A 7/1996 Ishii et al.
5,559,312 A 9/1996 Lucero
5,580,055 A 12/1996 Hagiwara
5,585,821 A 12/1996 Ishikura et al.
5,589,980 A 12/1996 Bass et al.
5,609,337 A 3/1997 Clapper, Jr.
5,613,679 A 3/1997 Casa et al.
5,618,045 A 4/1997 Kagan
5,619,649 A 4/1997 Kovnat et al.
5,621,812 A 4/1997 Deaton et al.
5,628,684 A 5/1997 Bouedec
5,642,485 A 6/1997 Deaton et al.
5,643,086 A 7/1997 Alcorn
5,645,485 A 7/1997 Clapper, Jr.
5,647,592 A 7/1997 Gerow
5,655,961 A 8/1997 Acres
5,676,231 A 10/1997 Legras
5,702,304 A 12/1997 Acres
5,709,603 A 1/1998 Kaye
5,718,632 A 2/1998 Hayashi
5,722,890 A 3/1998 Libby et al.
5,741,183 A 4/1998 Acres
5,745,197 A 4/1998 Leung et al.
5,749,784 A 5/1998 Clapper, Jr.
5,752,881 A 5/1998 Inoue
5,759,102 A 6/1998 Pease
5,761,647 A 6/1998 Bohy
5,764,317 A 6/1998 Sadnovik et al.
5,768,382 A 6/1998 Schneier
5,769,716 A 6/1998 Saffari
5,770,533 A 6/1998 Franchi
5,779,545 A 7/1998 Berg
5,785,594 A 7/1998 Seibert et al.
5,788,573 A 8/1998 Baerlocher
5,795,228 A 8/1998 Trumbull
5,796,389 A 8/1998 Bertram
5,797,085 A 8/1998 Beuk
5,809,482 A 9/1998 Strisower
5,811,772 A 9/1998 Lucero
5,816,918 A 10/1998 Kelly
5,818,019 A 10/1998 Irwin, Jr.
5,833,536 A 11/1998 Davids
5,833,540 A 11/1998 Miodunski
5,836,819 A 11/1998 Ugawa
5,851,148 A 12/1998 Brune
5,851,149 A 12/1998 Xidos et al.
5,871,398 A 2/1999 Schneier
D406,612 S 3/1999 Johnson
5,885,158 A 3/1999 Torango
5,910,046 A 6/1999 Wada et al.
5,919,091 A 7/1999 Bell
5,923,307 A 7/1999 Hogle, IV
5,928,082 A 7/1999 Clapper, Jr.
5,934,671 A 8/1999 Harrison
5,941,733 A 8/1999 Harlick
5,951,397 A 9/1999 Dickinson
5,952,640 A 9/1999 Lucero
5,954,583 A 9/1999 Green
5,956,180 A 9/1999 Bass et al.
5,957,776 A 9/1999 Hoehne
5,959,277 A 9/1999 Lucero
5,967,893 A 10/1999 Lawrence et al.
5,967,896 A 10/1999 Jorasch
5,971,271 A 10/1999 Wynn
5,984,779 A 11/1999 Bridgeman
5,999,808 A 12/1999 LaDue
6,001,016 A 12/1999 Walker
6,003,013 A 12/1999 Bohy
6,003,651 A 12/1999 Waller
6,010,404 A 1/2000 Walker
6,012,832 A 1/2000 Saunders
6,012,983 A 1/2000 Walker

(56) References Cited

U.S. PATENT DOCUMENTS 6,015,346 A 1/2000 Bennett
6,019,283 A 2/2000 Lucero
6,027,115 A 2/2000 Griswold et al.
6,027,135 A 2/2000 Hauglin
6,038,666 A 3/2000 Hsu
6,048,269 A 4/2000 Burns
6,050,895 A 4/2000 Luciano, Jr.
6,054,969 A 4/2000 Haisma
6,059,658 A 5/2000 Mangano et al.
6,062,981 A 5/2000 Luciano
6,068,552 A 5/2000 Walker
6,077,163 A 6/2000 Walker
6,089,975 A 7/2000 Dunn
6,099,408 A 8/2000 Schneier
6,104,815 A 8/2000 Alcorn
6,106,396 A 8/2000 Alcorn
6,110,041 A 8/2000 Walker
6,113,098 A 9/2000 Adams
6,113,492 A 9/2000 Walker
6,113,493 A 9/2000 Walker
6,113,495 A 9/2000 Walker
6,135,884 A 10/2000 Hedrick
6,135,887 A 10/2000 Pease
6,139,431 A 10/2000 Walker
6,141,711 A 10/2000 Shah
6,142,369 A 11/2000 Jonstromer
6,149,522 A 11/2000 Alcorn
6,159,098 A 12/2000 Slomiany et al.
6,161,059 A 12/2000 Tedesco
6,162,121 A 12/2000 Morro
6,162,122 A 12/2000 Acres
6,174,234 B1 1/2001 Seibert, Jr.
6,182,221 B1 1/2001 Hsu
6,183,362 B1 2/2001 Bohy
6,190,256 B1 2/2001 Walker et al.
6,193,608 B1 2/2001 Walker et al.
6,206,283 B1 3/2001 Bansal
6,210,279 B1 4/2001 Dickinson
6,213,875 B1 4/2001 Suzuki
6,223,166 B1 4/2001 Kay
6,227,972 B1 5/2001 Walker
6,244,596 B1 6/2001 Kondratjuk
6,244,958 B1 6/2001 Acres
6,247,643 B1 6/2001 Lucero
6,251,014 B1 6/2001 Stockdale et al.
6,251,034 B1 6/2001 Eggiman et al.
6,252,707 B1 6/2001 Kleinberger et al.
6,253,119 B1 6/2001 Dabrowski
6,253,374 B1 6/2001 Dresevic et al.
6,254,481 B1 7/2001 Jaffe
6,264,560 B1 7/2001 Goldberg
6,264,561 B1 7/2001 Saffari
6,267,671 B1 7/2001 Hogan
6,270,410 B1 8/2001 DeMar
6,280,328 B1 8/2001 Holch
6,285,868 B1 9/2001 LaDue
6,293,866 B1 9/2001 Walker
6,302,790 B1 10/2001 Brossard
6,307,956 B1 10/2001 Black
6,312,332 B1 11/2001 Walker et al.
6,315,666 B1 11/2001 Mastera et al.
6,319,125 B1 11/2001 Acres
6,337,513 B1 1/2002 Clevenger et al.
6,341,353 B1 1/2002 Herman
6,347,996 B1 2/2002 Gilmore et al.
6,368,216 B1 4/2002 Hedrick
6,371,852 B1 4/2002 Acres
6,378,073 B1 4/2002 Davis
6,379,244 B1 4/2002 Sagawa et al.
6,379,246 B1 4/2002 Dabrowski
6,383,076 B1 5/2002 Tiedeken
6,398,220 B1 6/2002 Inoue
6,409,595 B1 6/2002 Uihlein
6,409,602 B1 6/2002 Wiltshire
6,416,827 B1 7/2002 Chakrapani et al.
6,443,843 B1 9/2002 Walker
6,444,496 B1 9/2002 Edwards et al.
6,445,185 B1 9/2002 Damadian et al.
6,445,385 B1 9/2002 Shin et al.
6,446,257 B1 9/2002 Pradhan et al.
6,449,687 B1 9/2002 Moriya
6,450,885 B2 9/2002 Schneier
6,453,319 B1 9/2002 Mattis et al.
6,454,648 B1 9/2002 Kelly et al.
6,488,585 B1 12/2002 Wells
6,491,583 B1 12/2002 Gauselmann
6,496,928 B1 12/2002 Deo
6,503,147 B1 1/2003 Stockdale et al.
6,503,347 B1 1/2003 Wysiekierski et al.
6,511,375 B1 1/2003 Kaminkow
6,512,559 B1 1/2003 Hashimoto et al.
6,514,141 B1 2/2003 Kaminkow et al.
6,514,341 B1 2/2003 Alberhasky et al.
6,517,433 B2 2/2003 Loose et al.
6,517,437 B1 2/2003 Wells et al.
6,530,835 B1 3/2003 Walker
6,547,664 B2 4/2003 Saunders
6,561,903 B2 5/2003 Walker
6,575,541 B1 6/2003 Hedrick et al.
6,581,161 B1 6/2003 Byford
6,582,310 B1 6/2003 Walker
6,585,589 B2 7/2003 Okuniewicz
6,585,591 B1 7/2003 Baerlocher et al.
6,585,598 B2 7/2003 Nguyen
6,620,047 B1 9/2003 Alcorn et al.
6,628,939 B2 9/2003 Paulsen
D480,961 S 10/2003 Deadman
6,634,550 B1 10/2003 Walker
6,645,077 B2 11/2003 Rowe
6,646,695 B1 11/2003 Gauselmann
6,648,761 B1 11/2003 Izawa
6,652,378 B2 11/2003 Cannon et al.
6,659,864 B2 12/2003 McGahn et al.
6,661,425 B1 12/2003 Hiroaki
6,676,522 B2 1/2004 Rowe
6,682,421 B1 1/2004 Rowe
6,685,567 B2 2/2004 Cockerille
6,695,703 B1 2/2004 McGahn
6,702,670 B2 3/2004 Jasper
6,702,675 B2 3/2004 Poole et al.
6,710,789 B1 3/2004 Sekiguchi
6,712,694 B1 3/2004 Nordman
6,715,756 B2 4/2004 Inoue
6,717,728 B2 4/2004 Putilin
6,722,979 B2 4/2004 Gilmore et al.
6,739,975 B2 5/2004 Nguyen
6,758,393 B1 7/2004 Luciano
6,800,029 B2 10/2004 Rowe
6,802,777 B2 10/2004 Seelig et al.
6,804,763 B1 10/2004 Stockdale et al.
6,811,486 B1 11/2004 Luciano, Jr. et al.
6,817,945 B2 11/2004 Seelig et al.
6,817,946 B2 11/2004 Motegi et al.
6,846,238 B2 1/2005 Wells
6,869,362 B2 3/2005 Walker
6,880,079 B2 4/2005 Kefford
6,887,157 B2 5/2005 LeMay et al.
6,890,259 B2 5/2005 Breckner et al.
6,896,618 B2 5/2005 Benoy
6,905,411 B2 6/2005 Nguyen
6,906,762 B1 6/2005 Witehira et al.
6,913,534 B2 7/2005 DeFrees-Parrott et al.
6,937,298 B2 8/2005 Okada
6,969,319 B2 11/2005 Rowe
6,969,339 B2 11/2005 Kayano et al.
6,997,803 B2 2/2006 LeMay et al.
7,004,388 B2 2/2006 Kohta
7,004,837 B1 2/2006 Crowder, Jr.
7,022,017 B1 4/2006 Halbritter et al.
7,095,180 B2 8/2006 Emslie et al.
7,095,380 B2 8/2006 Yoneda et al.
7,097,560 B2 8/2006 Okada
7,128,647 B2 10/2006 Muir et al.
7,153,210 B2 12/2006 Yamagishi

(56) References Cited

U.S. PATENT DOCUMENTS

| | | | |
|---|---|---|---|
| 7,159,865 | B2 | 1/2007 | Okada |
| 7,160,187 | B2 | 1/2007 | Loose et al. |
| 7,167,724 | B2 | 1/2007 | Yamagishi |
| 7,198,571 | B2 | 4/2007 | LeMay et al. |
| 7,204,753 | B2 | 4/2007 | Ozaki et al. |
| 7,207,883 | B2 | 4/2007 | Nozaki et al. |
| 7,220,181 | B2 | 5/2007 | Okada |
| 7,220,381 | B2 | 5/2007 | Ting et al. |
| 7,252,288 | B2 | 8/2007 | Seelig et al. |
| 7,252,591 | B2 | 8/2007 | Van Asdale |
| 7,255,643 | B2 | 8/2007 | Ozaki et al. |
| 7,275,991 | B2 | 10/2007 | Burns |
| 7,309,284 | B2 | 12/2007 | Griswold et al. |
| 7,322,884 | B2 | 1/2008 | Emori et al. |
| 7,329,181 | B2 | 2/2008 | Hoshino et al. |
| 7,329,381 | B2 | 2/2008 | Woodfield et al. |
| 7,331,520 | B2 | 2/2008 | Silva |
| 7,335,106 | B2 | 2/2008 | Johnson |
| 7,337,330 | B2 | 2/2008 | Gatto |
| 7,341,522 | B2 | 3/2008 | Yamagishi |
| 7,416,485 | B2 | 8/2008 | Walker et al. |
| 7,419,428 | B2 | 9/2008 | Rowe |
| 7,467,999 | B2 | 12/2008 | Walker et al. |
| 7,477,889 | B2 | 1/2009 | Kim |
| 7,510,474 | B2 | 3/2009 | Carter, Sr. |
| 7,510,475 | B2 | 3/2009 | Loose et al. |
| 7,545,522 | B1 | 6/2009 | Lou |
| 7,552,341 | B2 | 6/2009 | Chen |
| 7,594,855 | B2 | 9/2009 | Meyerhofer |
| 7,611,409 | B2 | 11/2009 | Muir |
| 7,618,339 | B2 | 11/2009 | Hashimoto et al. |
| 7,619,585 | B2 | 11/2009 | Bell et al. |
| 7,644,861 | B2 | 1/2010 | Alderucci |
| 7,686,687 | B2 | 3/2010 | Cannon et al. |
| 7,730,413 | B1 | 6/2010 | Engel et al. |
| 7,753,789 | B2 | 7/2010 | Walker et al. |
| 7,771,271 | B2 | 8/2010 | Walker et al. |
| 7,785,193 | B2 | 8/2010 | Paulsen |
| 7,785,194 | B2 | 8/2010 | Schneider et al. |
| 7,819,747 | B2 | 10/2010 | Kane et al. |
| 7,846,017 | B2 | 12/2010 | Walker et al. |
| 7,850,522 | B2 | 12/2010 | Walker et al. |
| 7,883,417 | B2 | 2/2011 | Bruzzese |
| 7,918,734 | B2 | 4/2011 | Gould |
| 7,950,996 | B2 | 5/2011 | Nguyen |
| 7,951,008 | B2 | 5/2011 | Wolf et al. |
| 7,959,502 | B2 | 6/2011 | Kane et al. |
| 8,016,666 | B2 | 9/2011 | Angell |
| 8,023,133 | B2 | 9/2011 | Kaneko |
| 8,029,351 | B2 | 10/2011 | Kosaka et al. |
| 8,038,527 | B2 | 10/2011 | Walker et al. |
| 8,070,590 | B2 | 12/2011 | Cannon et al. |
| 8,096,872 | B2 | 1/2012 | Walker et al. |
| 8,131,649 | B2 | 3/2012 | Yen et al. |
| 8,192,276 | B2 | 6/2012 | Walker |
| 8,313,371 | B1 | 11/2012 | Luciano, Jr. |
| 8,357,033 | B2 | 1/2013 | Williams et al. |
| 8,419,526 | B1 | 4/2013 | Cannon et al. |
| 8,512,144 | B2 | 8/2013 | Johnson et al. |
| 8,768,916 | B1 | 3/2014 | Cannon et al. |
| 2001/0013681 | A1 | 8/2001 | Bruzzese et al. |
| 2001/0029528 | A1 | 10/2001 | Coutts et al. |
| 2001/0031658 | A1 | 10/2001 | Ozaki et al. |
| 2001/0039204 | A1 | 11/2001 | Tanskanen |
| 2001/0044337 | A1 | 11/2001 | Rowe |
| 2002/0020603 | A1 | 2/2002 | Jones |
| 2002/0045472 | A1 | 4/2002 | Adams et al. |
| 2002/0061778 | A1 | 5/2002 | Acres |
| 2002/0077182 | A1 | 6/2002 | Swanberg |
| 2002/0082070 | A1 | 6/2002 | Macke |
| 2002/0087641 | A1 | 7/2002 | Levosky |
| 2002/0090986 | A1 | 7/2002 | Cote |
| 2002/0094869 | A1 | 7/2002 | Harkham |
| 2002/0107066 | A1 | 8/2002 | Seelig |
| 2002/0111206 | A1 | 8/2002 | Van Baltz |
| 2002/0111209 | A1 | 8/2002 | Walker |
| 2002/0142825 | A1 | 10/2002 | Lark et al. |
| 2002/0142846 | A1 | 10/2002 | Paulsen |
| 2002/0145035 | A1 | 10/2002 | Jones |
| 2002/0147047 | A1 | 10/2002 | Letovsky |
| 2002/0147049 | A1 | 10/2002 | Carter, Sr. |
| 2002/0163570 | A1 | 11/2002 | Phillips |
| 2002/0169623 | A1 | 11/2002 | Call |
| 2002/0173354 | A1 | 11/2002 | Winans et al. |
| 2002/0183046 | A1 | 12/2002 | Joyce |
| 2002/0183105 | A1 | 12/2002 | Cannon et al. |
| 2002/0194505 | A1 | 12/2002 | Muschenborn |
| 2002/0196342 | A1 | 12/2002 | Walker |
| 2003/0003988 | A1 | 1/2003 | Walker |
| 2003/0008707 | A1 | 1/2003 | Walker |
| 2003/0018403 | A1 | 1/2003 | Braun et al. |
| 2003/0027624 | A1 | 2/2003 | Gilmore et al. |
| 2003/0027632 | A1 | 2/2003 | Sines |
| 2003/0028581 | A1 | 2/2003 | Kosanovic |
| 2003/0032478 | A1 | 2/2003 | Takahama et al. |
| 2003/0032479 | A1 | 2/2003 | LeMay et al. |
| 2003/0032485 | A1 | 2/2003 | Cockerille |
| 2003/0045354 | A1 | 3/2003 | Giobbi |
| 2003/0054868 | A1 | 3/2003 | Paulsen |
| 2003/0054881 | A1 | 3/2003 | Hedrick |
| 2003/0064771 | A1 | 4/2003 | Morrow et al. |
| 2003/0064801 | A1 | 4/2003 | Breckner |
| 2003/0064805 | A1 | 4/2003 | Wells |
| 2003/0069074 | A1 | 4/2003 | Jackson |
| 2003/0074259 | A1 | 4/2003 | Slyman, Jr. |
| 2003/0078103 | A1 | 4/2003 | LeMay et al. |
| 2003/0083126 | A1 | 5/2003 | Paulsen |
| 2003/0083943 | A1 | 5/2003 | Adams |
| 2003/0087690 | A1 | 5/2003 | Loose et al. |
| 2003/0092477 | A1 | 5/2003 | Luciano, Jr. |
| 2003/0104865 | A1 | 6/2003 | Itkis |
| 2003/0130028 | A1 | 7/2003 | Aida et al. |
| 2003/0141359 | A1 | 7/2003 | Dymovsky |
| 2003/0144052 | A1 | 7/2003 | Walker |
| 2003/0148812 | A1 | 8/2003 | Paulsen |
| 2003/0157980 | A1 | 8/2003 | Loose et al. |
| 2003/0162582 | A1 | 8/2003 | Gordon |
| 2003/0162591 | A1 | 8/2003 | Nguyen |
| 2003/0172037 | A1 | 9/2003 | Jung |
| 2003/0176213 | A1 | 9/2003 | LeMay |
| 2003/0176214 | A1 | 9/2003 | Burak et al. |
| 2003/0176218 | A1 | 9/2003 | LeMay et al. |
| 2003/0176234 | A1 | 9/2003 | Sheets et al. |
| 2003/0183105 | A1 | 10/2003 | Riepenhoff et al. |
| 2003/0186734 | A1 | 10/2003 | LeMay et al. |
| 2003/0186739 | A1 | 10/2003 | Paulsen |
| 2003/0199321 | A1 | 10/2003 | Williams |
| 2003/0203756 | A1 | 10/2003 | Jackson |
| 2003/0216961 | A1 | 11/2003 | Barry |
| 2003/0222876 | A1 | 12/2003 | Giemborek et al. |
| 2003/0224852 | A1 | 12/2003 | Walker |
| 2003/0228900 | A1 | 12/2003 | Yamagishi |
| 2003/0236114 | A1 | 12/2003 | Griswold et al. |
| 2004/0009813 | A1 | 1/2004 | Wind |
| 2004/0014514 | A1 | 1/2004 | Yacenda |
| 2004/0016797 | A1 | 1/2004 | Jones |
| 2004/0023714 | A1 | 2/2004 | Asdale |
| 2004/0023721 | A1 | 2/2004 | Giobbi |
| 2004/0029636 | A1 | 2/2004 | Wells |
| 2004/0039635 | A1 | 2/2004 | Linde |
| 2004/0043814 | A1 | 3/2004 | Angell |
| 2004/0048671 | A1 | 3/2004 | Rowe |
| 2004/0063490 | A1 | 4/2004 | Okada |
| 2004/0066475 | A1 | 4/2004 | Searle |
| 2004/0085293 | A1 | 5/2004 | Soper |
| 2004/0087360 | A1 | 5/2004 | Chamberlain |
| 2004/0103444 | A1 | 5/2004 | Weinberg et al. |
| 2004/0106454 | A1 | 6/2004 | Walker |
| 2004/0110557 | A1 | 6/2004 | Rowe |
| 2004/0116178 | A1 | 6/2004 | Okada |
| 2004/0117484 | A1 | 6/2004 | Singer et al. |
| 2004/0127277 | A1 | 7/2004 | Walker |
| 2004/0127284 | A1 | 7/2004 | Walker et al. |
| 2004/0129773 | A1 | 7/2004 | Lute, Jr. |

(56) References Cited

U.S. PATENT DOCUMENTS

2004/0147303 A1 7/2004 Imura et al.
2004/0147314 A1 7/2004 LeMay
2004/0150162 A1 8/2004 Okada
2004/0162146 A1 8/2004 Ooto
2004/0166925 A1 8/2004 Emori et al.
2004/0171419 A1 9/2004 Walker et al.
2004/0171423 A1 9/2004 Silva et al.
2004/0180712 A1 9/2004 Forman et al.
2004/0180721 A1 9/2004 Rowe
2004/0183972 A1 9/2004 Bell
2004/0185935 A1 9/2004 Yamagishi
2004/0190042 A1 9/2004 Ferlitsch
2004/0192430 A1 9/2004 Burak et al.
2004/0192434 A1 9/2004 Walker
2004/0198485 A1 10/2004 Loose
2004/0199284 A1 10/2004 Hara
2004/0207154 A1 10/2004 Okada
2004/0208126 A1 10/2004 Wassew et al.
2004/0209666 A1 10/2004 Okada
2004/0209667 A1 10/2004 Emori et al.
2004/0209668 A1 10/2004 Okada
2004/0209671 A1 10/2004 Okada
2004/0209678 A1 10/2004 Okada
2004/0209683 A1 10/2004 Okada
2004/0209690 A1 10/2004 Bruzzese
2004/0214622 A1 10/2004 Atkinson
2004/0214635 A1 10/2004 Okada
2004/0214637 A1 10/2004 Nonaka
2004/0224747 A1 11/2004 Okada
2004/0225565 A1 11/2004 Selman
2004/0233663 A1 11/2004 Emslie et al.
2004/0239582 A1 12/2004 Seymour
2004/0254010 A1 12/2004 Fine
2004/0259640 A1 12/2004 Gentles
2004/0266395 A1 12/2004 Pailles
2005/0014554 A1 1/2005 Walker
2005/0020348 A1 1/2005 Thomas et al.
2005/0020354 A1 1/2005 Nguyen
2005/0020358 A1 1/2005 Cram
2005/0032571 A1 2/2005 Asonuma
2005/0037843 A1 2/2005 Wells et al.
2005/0043086 A1 2/2005 Schneider
2005/0049032 A1 3/2005 Kobayashi
2005/0049046 A1 3/2005 Kobayashi
2005/0049049 A1 3/2005 Griswold
2005/0054438 A1 3/2005 Rothschild
2005/0054445 A1* 3/2005 Gatto ..... G07F 17/32 463/42
2005/0059480 A1 3/2005 Soukup et al.
2005/0059485 A1 3/2005 Paulsen
2005/0059494 A1 3/2005 Kammler
2005/0062410 A1 3/2005 Bell et al.
2005/0063055 A1 3/2005 Engel
2005/0070257 A1 3/2005 Saarinen
2005/0076242 A1 4/2005 Breuer
2005/0079913 A1 4/2005 Inamura
2005/0079933 A1 4/2005 Gagne
2005/0085292 A1 4/2005 Inamura
2005/0096125 A1 5/2005 LeMay et al.
2005/0101383 A1 5/2005 Wells
2005/0125660 A1 6/2005 Raciborski
2005/0130728 A1 6/2005 Nguyen
2005/0153772 A1 7/2005 Griswold et al.
2005/0153775 A1 7/2005 Griswold et al.
2005/0153776 A1 7/2005 LeMay et al.
2005/0164762 A1 7/2005 Smith et al.
2005/0192090 A1 9/2005 Muir et al.
2005/0193269 A1 9/2005 Haswell et al.
2005/0206582 A1 9/2005 Bell et al.
2005/0208994 A1 9/2005 Berman
2005/0215331 A1 9/2005 Campbell
2005/0227770 A1 10/2005 Papulov
2005/0233799 A1 10/2005 LeMay et al.
2005/0239539 A1 10/2005 Inamura
2005/0240484 A1 10/2005 Yan
2005/0255911 A1 11/2005 Nguyen
2005/0266912 A1 12/2005 Sekiguchi
2005/0266932 A1 12/2005 Roach et al.
2005/0282616 A1 12/2005 Tanimura et al.
2005/0282638 A1 12/2005 Rowe
2005/0285337 A1 12/2005 Durham et al.
2005/0287852 A1 12/2005 Sugawara
2006/0009273 A2 1/2006 Moshal
2006/0013683 A1 1/2006 Martindale
2006/0018450 A1 1/2006 Sandberg-Diment
2006/0019743 A1 1/2006 Roemer
2006/0019747 A1 1/2006 Loose et al.
2006/0025206 A1 2/2006 Walker
2006/0025222 A1 2/2006 Sekine
2006/0035707 A1 2/2006 Nguyen
2006/0040741 A1 2/2006 Griswold
2006/0041586 A1 2/2006 Nassef, Jr.
2006/0046817 A1 3/2006 Paulsen et al.
2006/0046823 A1 3/2006 Kaminkow
2006/0046834 A1 3/2006 Sekine
2006/0046842 A1 3/2006 Mattice
2006/0046855 A1 3/2006 Nguyen
2006/0049624 A1 3/2006 Brosnan
2006/0058100 A1 3/2006 Pacey et al.
2006/0063581 A1 3/2006 Harris et al.
2006/0068898 A1 3/2006 Maya
2006/0079333 A1 4/2006 Morrow
2006/0089174 A1 4/2006 Twerdahl
2006/0089194 A1 4/2006 Joshi et al.
2006/0094508 A1 5/2006 D'Amico et al.
2006/0100014 A1 5/2006 Griswold et al.
2006/0103951 A1 5/2006 Bell et al.
2006/0105837 A1 5/2006 Walker et al.
2006/0105841 A1 5/2006 Rom et al.
2006/0125745 A1 6/2006 Evanicky
2006/0143085 A1 6/2006 Adams et al.
2006/0154729 A1 7/2006 LeMay et al.
2006/0160621 A1 7/2006 Rowe
2006/0165060 A1 7/2006 Dua
2006/0166727 A1 7/2006 Burak
2006/0166732 A1 7/2006 Lechner
2006/0166741 A1 7/2006 Boyd
2006/0173781 A1 8/2006 Donner
2006/0184626 A1 8/2006 Agapi et al.
2006/0189382 A1 8/2006 Muir
2006/0190482 A1 8/2006 Kishan et al.
2006/0191177 A1 8/2006 Engel
2006/0217202 A1 9/2006 Burke et al.
2006/0218029 A1 9/2006 Chin
2006/0223627 A1 10/2006 Nozaki
2006/0226598 A1 10/2006 Walker
2006/0246981 A1 11/2006 Walker
2006/0247037 A1 11/2006 Park
2006/0247039 A1 11/2006 Lerner et al.
2006/0264256 A1 11/2006 Gagner et al.
2006/0264257 A1 11/2006 Jaffe et al.
2006/0266598 A1 11/2006 Baumgartner
2006/0271433 A1 11/2006 Hughes
2006/0279781 A1 12/2006 Kaneko
2006/0281554 A1 12/2006 Gatto
2006/0282855 A1 12/2006 Margulis
2006/0284574 A1 12/2006 Emslie et al.
2006/0287035 A1 12/2006 Walker et al.
2006/0287072 A1 12/2006 Walker
2006/0287098 A1 12/2006 Morrow
2006/0290594 A1 12/2006 Engel et al.
2007/0004510 A1 1/2007 Underdahl et al.
2007/0004513 A1 1/2007 Wells et al.
2007/0004519 A1 1/2007 Swart
2007/0010315 A1 1/2007 Hein
2007/0015569 A1 1/2007 Norton et al.
2007/0017979 A1 1/2007 Wu
2007/0021198 A1 1/2007 Muir
2007/0024002 A1 2/2007 McMain et al.
2007/0026916 A1 2/2007 Juds et al.
2007/0032288 A1 2/2007 Nelson et al.
2007/0043616 A1 2/2007 Kutaragi et al.
2007/0060302 A1 3/2007 Fabbri
2007/0060317 A1 3/2007 Martin

(56) References Cited

U.S. PATENT DOCUMENTS

| | | | |
|---|---|---|---|
| 2007/0060358 | A1 | 3/2007 | Amaitis et al. |
| 2007/0060363 | A1 | 3/2007 | Nguyen et al. |
| 2007/0060372 | A1 | 3/2007 | Yamagishi |
| 2007/0077995 | A1 | 4/2007 | Oak et al. |
| 2007/0117608 | A1 | 5/2007 | Roper |
| 2007/0117623 | A1 | 5/2007 | Nelson |
| 2007/0129150 | A1 | 6/2007 | Crowder |
| 2007/0159301 | A1 | 7/2007 | Hirt |
| 2007/0180400 | A1 | 8/2007 | Zotov et al. |
| 2007/0190494 | A1 | 8/2007 | Rosenberg |
| 2007/0207854 | A1 | 9/2007 | Wolf et al. |
| 2007/0218971 | A1 | 9/2007 | Berube |
| 2007/0218985 | A1 | 9/2007 | Okada |
| 2007/0218991 | A1 | 9/2007 | Okada |
| 2007/0238505 | A1 | 10/2007 | Okada |
| 2007/0238527 | A1 | 10/2007 | Zanfardino |
| 2007/0243925 | A1 | 10/2007 | LeMay et al. |
| 2007/0243928 | A1 | 10/2007 | Iddings |
| 2007/0243934 | A1 | 10/2007 | Little et al. |
| 2008/0004104 | A1 | 1/2008 | Durham et al. |
| 2008/0008188 | A1 | 1/2008 | Buga et al. |
| 2008/0009344 | A1 | 1/2008 | Graham et al. |
| 2008/0020816 | A1 | 1/2008 | Griswold et al. |
| 2008/0020839 | A1 | 1/2008 | Wells et al. |
| 2008/0020840 | A1 | 1/2008 | Wells et al. |
| 2008/0020841 | A1 | 1/2008 | Wells et al. |
| 2008/0026816 | A1 | 1/2008 | Sammon et al. |
| 2008/0026823 | A1 | 1/2008 | Wolf et al. |
| 2008/0026844 | A1 | 1/2008 | Wells |
| 2008/0076574 | A1 | 3/2008 | Okada |
| 2008/0096655 | A1 | 4/2008 | Rasmussen et al. |
| 2008/0113747 | A1 | 5/2008 | Williams et al. |
| 2008/0123026 | A1 | 5/2008 | Kwag et al. |
| 2008/0125219 | A1 | 5/2008 | Williams et al. |
| 2008/0200233 | A1 | 8/2008 | Aida |
| 2008/0213026 | A1 | 9/2008 | Grabiec et al. |
| 2008/0305862 | A1 | 12/2008 | Walker et al. |
| 2008/0318655 | A1 | 12/2008 | Davies |
| 2009/0098943 | A1 | 4/2009 | Weber et al. |
| 2009/0104954 | A1 | 4/2009 | Weber et al. |
| 2009/0125429 | A1 | 5/2009 | Takayama |
| 2009/0156303 | A1 | 6/2009 | Kiely et al. |
| 2009/0197684 | A1 | 8/2009 | Arezina et al. |
| 2009/0209350 | A1 | 8/2009 | Kelly et al. |
| 2009/0233705 | A1 | 9/2009 | Lemay et al. |
| 2010/0105454 | A1 | 4/2010 | Weber et al. |
| 2010/0190553 | A1 | 7/2010 | Buchholz et al. |
| 2010/0219234 | A1 | 9/2010 | Forbes |
| 2010/0304855 | A1 | 12/2010 | Acres |
| 2011/0003642 | A1 | 1/2011 | Russell et al. |
| 2011/0098104 | A1 | 4/2011 | Meyerhofer |
| 2014/0221099 | A1 | 8/2014 | Johnson et al. |
| 2015/0246283 | A1 | 9/2015 | Russo et al. |

FOREIGN PATENT DOCUMENTS

| | | |
|---|---|---|
| AU | 199650576 | 4/1997 |
| AU | 775882 | 11/2000 |
| AU | 775882 | 8/2004 |
| EP | 0 454 423 | 10/1991 |
| EP | 0 484 103 | 5/1992 |
| EP | 0 769 769 | 4/1997 |
| EP | 0769769 | 4/1997 |
| EP | 0 997 857 | 10/1999 |
| EP | 0727245 | 5/2000 |
| EP | 0997857 | 5/2000 |
| EP | 1 195 184 | 4/2002 |
| EP | 1195184 | 4/2002 |
| EP | 1 255 234 | 11/2002 |
| EP | 1 260 928 | 11/2002 |
| EP | 1255234 | 11/2002 |
| EP | 1 282 088 | 2/2003 |
| EP | 1 462 152 | 9/2004 |
| EP | 1 492 063 | 12/2004 |
| EP | 1492063 | 12/2004 |
| EP | 1 524 617 | 4/2005 |
| EP | 1524617 | 4/2005 |
| GB | 1 464 896 | 2/1977 |
| GB | 1464896 | 2/1977 |
| GB | 1559496 | 1/1980 |
| GB | 2 120 506 | 11/1983 |
| GB | 2120506 | 11/1983 |
| JP | 04-220276 | 8/1992 |
| JP | 06-043425 | 2/1994 |
| JP | 07-124290 | 5/1995 |
| JP | 2000-300729 | 10/2000 |
| JP | 2000300729 | 10/2000 |
| JP | 00-350805 | 12/2000 |
| JP | 2000350805 | 12/2000 |
| JP | 01-062032 | 3/2001 |
| JP | 2001062032 | 3/2001 |
| JP | 01-238995 | 9/2001 |
| JP | 01-252393 | 9/2001 |
| JP | 01-252394 | 9/2001 |
| JP | 02-085624 | 3/2002 |
| JP | 2002085624 | 3/2002 |
| JP | 2004-089707 | 3/2004 |
| JP | 2004089707 | 3/2004 |
| JP | 2004-105616 | 4/2004 |
| JP | 2004105616 | 4/2004 |
| JP | 04-166879 | 6/2004 |
| JP | 2004220276 | 8/2004 |
| JP | 2005-253561 | 9/2005 |
| JP | 2005-266387 | 9/2005 |
| JP | 2005-266388 | 9/2005 |
| JP | 2005253561 | 9/2005 |
| JP | 2005266387 | 9/2005 |
| JP | 2005266388 | 9/2005 |
| JP | 2005-274906 | 10/2005 |
| JP | 2005-274907 | 10/2005 |
| JP | 2005-283864 | 10/2005 |
| JP | 2005274906 | 10/2005 |
| JP | 2005274907 | 10/2005 |
| JP | 2005283864 | 10/2005 |
| JP | 2006043425 | 2/2006 |
| JP | 2006-346226 | 12/2006 |
| JP | 2006346226 | 12/2006 |
| JP | 2007124290 | 5/2007 |
| WO | 98/52665 | 11/1998 |
| WO | 1998/052665 | 11/1998 |
| WO | 99/42889 | 8/1999 |
| WO | 99/44095 | 9/1999 |
| WO | 2001/009664 | 2/2001 |
| WO | 01/15127 | 3/2001 |
| WO | 01/15128 | 3/2001 |
| WO | 01/15132 | 3/2001 |
| WO | 2001/015128 | 3/2001 |
| WO | 2001/015132 | 3/2001 |
| WO | 01/09664 | 8/2001 |
| WO | 2001/072387 | 10/2001 |
| WO | 2002/021467 | 3/2002 |
| WO | 02/073501 | 9/2002 |
| WO | 2002/073501 | 9/2002 |
| WO | 2003/009664 | 1/2003 |
| WO | 03/023647 | 3/2003 |
| WO | 03/039699 | 5/2003 |
| WO | 2004/001486 | 12/2003 |
| WO | 2004/025583 | 3/2004 |
| WO | 2004/102520 | 11/2004 |
| WO | 2006/033986 | 3/2006 |
| WO | 2006/034192 | 3/2006 |
| WO | 2006/038819 | 4/2006 |
| WO | 2006/039132 | 4/2006 |
| WO | 2006/093146 | 9/2006 |
| WO | 2007/032916 | 3/2007 |
| WO | 2007/040413 | 4/2007 |
| WO | 2007/117418 | 10/2007 |
| WO | 2007/120444 | 10/2007 |
| WO | 2007/120450 | 10/2007 |
| WO | 2008/056844 | 5/2008 |
| WO | 2008/061068 | 5/2008 |
| WO | 2009/009269 | 1/2009 |
| WO | 2009/036445 | 3/2009 |
| WO | 2009/140096 | 5/2009 |

(56) References Cited

FOREIGN PATENT DOCUMENTS

| | | |
|---|---|---|
| WO | 2009/143274 | 11/2009 |
| WO | 2010/056418 | 5/2010 |
| WO | 2010/120451 | 10/2010 |

OTHER PUBLICATIONS

Australian Patent Examination Report No. 2 dated Jun. 20, 2012 issued in AU 2007239023.
Australian Examiner's First Report dated May 25, 2011 issued in AU 2007239029.
Australian Patent Examination Report No. 2 dated Jun. 20, 2012 issued in AU 2007239029.
Australian Examiner's First Report dated Jul. 7, 2011 issued in AU 2007319331.
Australian Notice of Acceptance and Allowed Claims dated Aug. 20, 2012 issued in AU 2007319331.
Australian Patent Examination Report No. 1 dated Jul. 11, 2012 issued in AU 2008298501.
Australian Examiner's First Report dated May 25,2012 issued in AU 2008275477.
Bonsor, Kevin, "How Smart Windows Work," HowStuffWorks, Inc., www.howstuffworks.com, 1998-2004, 9 pages.
Bonsor, Kevin, "How Smart Windows Will Work," Howstuffworks, Inc. 1998-2002, http://www.howstuffworks.com/smart-window.htm/printable Printed Nov. 25, 2002 (5 pages).
Chinese First Office Action dated Mar. 25, 2010 issued in CN 200780021699.8.
Chinese Second Office Action dated Aug. 24, 2010 issued in CN 200780021699.8.
Chinese Third Office Action dated Dec. 3, 2010 issued in CN 200780021699.8.
Chinese Fourth Office Action dated Feb. 23, 2011 issued in CN 200780021699.8.
Chinese Fifth Office Action dated May 25, 2011 issued in CN 200780021699.8.
Chinese Sixth Office Action dated Dec. 7, 2011 issued in CN 200780021699.8.
Chinese First Office Action dated May 18, 2010 issued in CN 200780021740.1.
Chinese Second Office Action dated Nov. 16, 2011 issued in CN 200780021740.1.
Chinese Third Office Action dated Apr. 17, 2012 issued in CN 200780021740.1.
Chinese Fourth Office Action dated Sep. 13, 2012 issued in CN 200780021740.1.
"Debut of Let's Make a Deal Slot Machine," Let's Make a Deal 1999-2002, http: /www.letsmakeadeal.com/pr01 .htm. Printed Dec. 3, 2002 (2 pages).
European Examination Report dated Apr. 20, 2009 issued in EP 07754175.3; 6 pgs.
European Examination Report dated Oct. 28, 2009 issued in EP07845059.0.
European Examination Report dated Apr. 20, 2009 from EP0 7754383.3, 7 pgs.
European Exam Report dated Sep. 13, 2007 from related EP Application No. 05 705 315.9.
Great Britain Examination Report dated Feb. 15, 2012 issued in GB 1020135.8.
International Search Report and Written Opinion dated Sep. 26, 2008 from PCT Application No. PCT/US2008/067543, 11 pgs.
International Search Report and Written Opinion dated Dec. 11, 2008 from related PCT Application No. PCT/US2008/076428, 8 pgs.
International Search Report dated Jun. 6, 2005 from PCT Application No. PCT/US2005/000950, 5 pages.
International Search Report dated Sep. 21, 2007 from PCT Application No. PCT/US2007/007617, 5 pages.
International Search Report dated Sep. 21, 2007 from International Application No. PCT/US2007/007857, 4 pages.
International Search Report dated May 7, 2008 from PCT Application No. PCT/US2007/08412.
International Search Report dated May 2, 2008 from PCT Application No. PCT/US2007/084459.
"Light Valve". Retrieved from the internet URL http: /www.meko.co.uk/lightvalve.shtml [retrieved on Nov. 15, 2005, 1 page.
"Liquid Crystal Display". Retrieved from the internet URL http: /en.wikipedia.org/wiki/LCD [retrieved on Nov. 16, 2005, 6 pages.
Living in a flat world? Advertisement written by Deep Video Imaging Ltd., published 2000.
Novel 3-D Video Display Technology Developed, News release: Aug. 30, 1996, www.eurekalert.org/summaries/1199.html, printed from Internet Archive using date Sep. 2, 2000.
PCT International Search Report and Written Opinion dated Sep. 8, 2009 issued in PCT/US2009/042741.
PCT International Search Report and Written Opinion dated Dec. 4, 2009 issued in PCT/US2009/057551.
PCT International Preliminary Report on Patentability and Written Opinion dated Oct. 14, 2008 issued in PCT/US2007/007617.
PCT International Search Report dated Aug. 3, 2010 issued in PCT/US2010/028368 (WO 2010/120451).
PCT International Preliminary Report on Patentability and Written Opinion dated Mar. 16, 2010 issued in PCT/US2008/076428 (WO 2009/036445).
PCT International Preliminary Report on Patentability and Written Opinion dated May 17, 2011 issued in PCT/US2009/057551.
PCT International Preliminary Report on Patentability and Written Opinion dated May 12, 2009 issued in PCT/US2007/084459 (WO 2008/061068).
PCT International Preliminary Report on Patentability and Written Opinion dated Nov. 25, 2010 issued in PCT/US2009/042741.
PCT International Search Report dated Jul. 24, 2009 issued in PCT/US2009/044716.
PCT International Preliminary Report on Patentability and Written Opinion dated Dec. 2, 2010 issued in PCT/US2009/044716.
PCT International Preliminary Report on Patentability and Written Opinion dated Oct. 14, 2008 issued in PCT/US2007/007857 (WO 2007/120450).
PCT International Preliminary Report on Patentability and Written Opinion dated Jan. 12, 2010 issued in PCT/US2008/067543.
PCT International Preliminary Report on Patentability and Written Opinion dated Oct. 27, 2011 issued in PCT/US2010/028368.
Miser, Brad, "Using Mac OS 8.5," Nov. 1998, Que Publishing accessed at <http://www.netlibrary.com/nlreader.d11?bookid=8218&fllename=Page.sub.- --ii.html>.
Office Action for Chinese Application No. 201080027463.7 (and it's English translation), dated Jul. 10, 2013 (16 pages).
Regulation 14 of Regulations of the Nevada Gaming Commission and State Gaming Control Board, Regulation 14.230 adopted Jul. 1989, Nevada Gaming Commission and State Gaming Control Board, 15 pp.
Saxe et al., "Suspended-Particle Devices," www.refr-spd.com, Apr./May 1996, 5 pages.
"SPD," Malvino Inc., www.malvino.com, Jul. 19, 1999, 10 pages.
Time Multiplexed Optical Shutter (TMOS): A Revolutionary Flat Screen Display Technology, http: /web.archive.org/web/19991006064049/http: /www.vea.com/TMOS.html, Apr. 8, 1999, printed from Internet on Oct. 6, 1999.
Time Multiplexed Optical Shutter (TMOS): A Revolutionary Flat Screen Display Technology, http: /web.archive.org/web/20010814143641/www.tralas.com/TMOS.html, printed from internet on Apr. 11, 2001.
U.S. Office Action dated Feb. 10, 2009 issued in U.S. Appl. No. 11/595,774.
U.S. Examiner Interview Summary dated May 22, 2009, issued in U.S. Appl. No. 11/595,774.
U.S. Office Action Final dated Aug. 26, 2009 issued in U.S. Appl. No. 11/595,774.
U.S. Office Action—Supplemental Final dated Sep. 16, 2009 issued in U.S. Appl. No. 11/595,774.

(56) References Cited

OTHER PUBLICATIONS

U.S. Office Action Final dated Oct. 14, 2011 issued in U.S. Appl. No. 11/595,774.
U.S. Office Action dated Jun. 19, 2009 issued in U.S. Appl. No. 11/682,253.
U.S. Examiner Interview Summary dated Aug. 14, 2009 issued in U.S. Appl. No. 11/682,253.
U.S. Office Action Final dated Nov. 30, 2009 issued in U.S. Appl. No. 11/682,253.
U.S. Office Action dated Feb. 12, 2009 issued in U.S. Appl. No. 11/595,798.
U.S. Examiner Interview Summary dated May 22, 2009 issued in U.S. Appl. No. 11/595,798.
U.S. Office Action Final dated Sep. 24, 2009 issued in U.S. Appl. No. 11/595,798.
U.S. Office Action dated Apr. 15, 2011 issued in U.S. Appl. No. 11/595,774.
U.S. Office Action dated Aug. 3, 2011 issued in U.S. Appl. No. 12/426,165.
U.S. Office Action dated Jun. 24, 2011 issued in U.S. Appl. No. 12/209,608.
U.S. Office Action dated Jan. 20, 2011 issued in U.S. Appl. No. 11/983,770.
U.S. Office Action Final dated May 16, 2011 issued in U.S. Appl. No. 11/983,770.
U.S. Office Action Final dated Apr. 14, 2011 issued in U.S. Appl. No. 11/595,798.
U.S. Office Action Supplemental dated Apr. 29, 2011 issued in U.S. Appl. No. 11/595,798.
U.S. Office Action Final dated Feb. 17, 2012 issued in U.S. Appl. No. 12/426,165.
U.S. Office Action Final dated Jan. 26, 2012 issued in U.S. Appl. No. 11/682,253.
U.S. Office Action Final dated Jul. 17, 2012 issued in U.S. Appl. No. 11/682,253.
U.S. Office Action Final dated Mar. 16, 2012 issued in U.S. Appl. No. 12/209,608.
U.S. Office Action dated Feb. 15, 2012 issued in U.S. Appl. No. 12/120,191.
U.S. Office Action Final dated Jun. 7, 2012 issued in U.S. Appl. No. 12/120,191.
U.S. Office Action dated Sep. 30, 2011 issued in U.S. Appl. No. 12/435,962.
U.S. Office Action Final dated Apr. 16, 2012 issued in U.S. Appl. No. 12/435,962.
U.S. Office Action Final dated Oct. 14, 2011 issued in U.S. Appl. No. 11/595,798.
U.S. Office Action dated Oct. 27, 2011 issued in U.S. Appl. No. 11/827,060.
"What is SPD?" SPD Systems, Inc. 2002, http:/ /www.spd-systems.com/spdq.htm. Printed Dec. 4, 2002 (2 pages).
Written Opinion of the International Searching Authority dated Sep. 21, 2007 from PCT Application No. PCT/US2007/007617, 8 pages.
Written Opinion dated May 7, 2008 from PCT Application No. PCT/US2007/08412.
Written Opinion of the International Searching Authority dated Jun. 6, 2005 from PCT Application No. PCT/US2005/000950, 7 pages.
Written Opinion of the International Searching Authority dated Sep. 21, 2007 from PCT Application No. PCT/US2007/007857, 7 pages.
Written Opinion of the International Searching Authority dated May 25, 2005 from PCT Application No. PCT/US2005/000597.
Written Opinion dated May 2, 2008 from PCT Application No. PCT/US2007/084459.

* cited by examiner

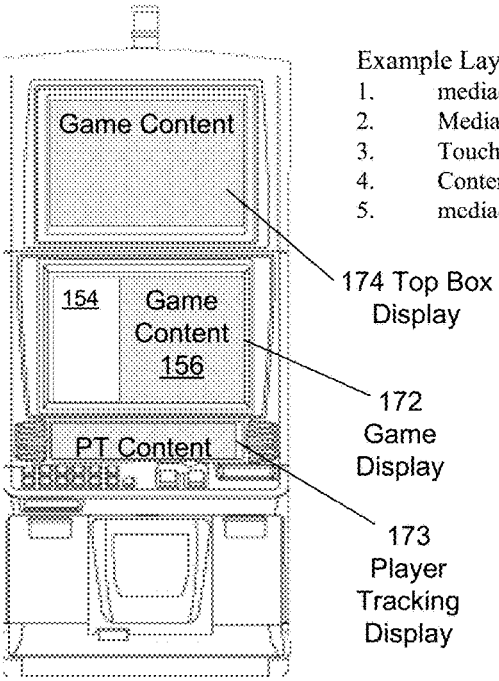

Example Layout: Media Display 154

1. mediadisplaytype= "Game Display" 172
2. MediaDisplayDescription = "Service Window"
3. Touchscreencapable= "True"
4. ContentWidth= 256
5. mediadisplayposition= "Left"

FIG. 4B

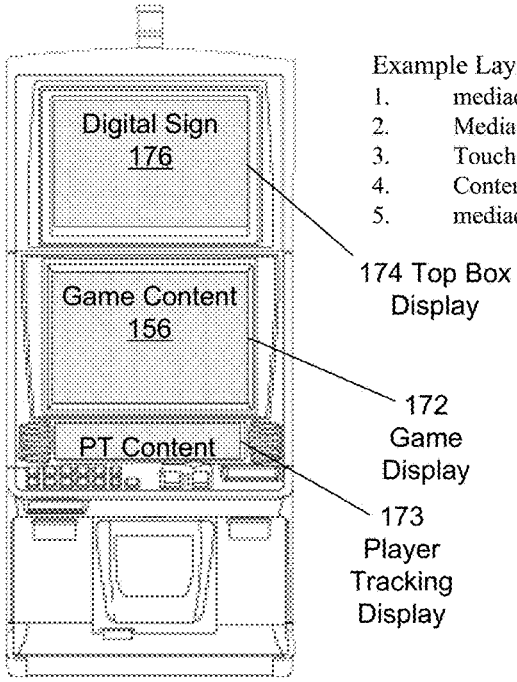

Example Layout: Media Display 176

1. mediadisplaytype= "Top Box" 174
2. MediaDisplayDescription = "Digital Sign"
3. Touchscreencapable= "False"
4. ContentWidth= 800
5. mediadisplayposition= "Full"

FIG. 4C

BONUSING ARCHITECTURES IN A GAMING ENVIRONMENT

CROSS-REFERENCE TO RELATED APPLICATIONS

This application is a continuation of, and claims priority to and the benefit of, U.S. patent application Ser. No. 12/271,884, which was filed on Nov. 15, 2008, which is a continuation-in-part of, and claims priority to and the benefit of, U.S. patent application Ser. No. 12/209,608, which was filed on Sep. 12, 2008, and issued as U.S. Pat. No. 9,311,774 on Apr. 12, 2016, which: (1) claims priority to and the benefit of U.S. Provisional Patent Application No. 61/055,316, which was filed on May 22, 2008, (2) claims priority to and the benefit of U.S. Provisional Patent Application No. 60/993,985, which was filed on Sep. 13, 2007, and (2) is a continuation-in-part of, and claims priority to and the benefit of, U.S. patent application Ser. No. 11/595,774, which was filed on Nov. 10, 2006, and issued as U.S. Pat. No. 8,777,737 on Jul. 15, 2014, the entire contents of each of which are incorporated herein by reference.

COPYRIGHT NOTICE

A portion of the invention of this patent document contains or may contain material which is subject to copyright protection. The copyright owner has no objection to the photocopy reproduction by anyone of the patent document or the patent invention in exactly the form it appears in the Patent and Trademark Office patent file or records, but otherwise reserves all copyright rights whatsoever.

TECHNICAL FIELD

The present invention relates generally to gaming devices and systems, and more specifically to remote content management and bonus games with persistence elements on a gaming machine.

BACKGROUND

Casinos and other forms of gaming comprise a growing multi-billion dollar industry both domestically and abroad, with electronic and microprocessor based gaming machines being more popular than ever. A gaming entity that provides gaming services may control gaming devices that are globally distributed in many different types of establishments. For example, gaming machines may be placed in casinos, convenience stores, racetracks, supermarkets, bars and boats. Further, via a remote server, a gaming entity may provide gaming services in locale of a user's choosing, such as on a home computer or on a mobile device carried by the user.

Electronic and microprocessor based gaming machines can include various hardware and software components to provide a wide variety of game types and game playing capabilities, with such hardware and software components being generally well known in the art. For example, bill validators, coin acceptors, card readers, keypads, buttons, levers, touch screens, displays, coin hoppers, player tracking units and the like are examples of hardware that can be coupled to a gaming machine. Software components can include, for example, boot and initialization routines, various game play programs and subroutines, credit and payout routines, image and audio generation programs, security monitoring programs, authentication programs and a random number generator, among others.

The functions available on a gaming machine may depend on whether the gaming machine is linked to other gaming devices. For instance, when connected to other remote gaming devices, a gaming machine may provide progressive jackpots, player tracking and loyalty points programs, cashless gaming, and bonusing among other items. Many of these added components, features and programs can involve the implementation of various back-end and/or networked systems, including more hardware and software elements, as is generally known.

In a typical casino-based electronic gaming machine, such as a slot machine, video poker machine, video keno machine or the like, a game play is initiated through a wager of money or credit, whereupon the gaming machine determines a game outcome, presents the game outcome to the player and then potentially dispenses an award of some type, including a monetary award, depending upon the game outcome. In this instance, the gaming machine is operable to receive, store and dispense indicia of credit or cash as well as calculate a gaming outcome that could result in a large monetary award. The gaming machine is enabled to operate in this manner because it is placed typically in a location that is monitored (e.g., a casino), the gaming machine hardware and software components are secured within a locked cabinet and the gaming machine includes a security system for detecting fraud or theft attempts.

Because gaming machines can be operable to accept, store, dispense and/or award large sums of money, gaming machines are often the targets of theft attempts. Thus, besides including a security system, gaming software and gaming hardware are designed and/or selected to resist theft attempts and include many security features not present in personal computers or other gaming platforms. For example, a hardware-based security method for preventing illegal software modification is to store gaming software on an unalterable memory, such as an on EPROM, a read-only CD/DVD optical disc or a read-only disk memory with write capability disabled. As another example, a software-based security method for preventing/detecting illegal software modifications is to execute authentication routines that compare information stored and programs executed on the gaming machine against known and trusted information. The trusted information and authentication routines can be stored in a trusted memory location such as a verified EPROM on the gaming machine.

One advantage of utilizing the hardware and software based security methods described above is that the potential for fraud and theft is greatly reduced. Further, for gaming software approved by a gaming regulator to ensure fairness, another advantage is that the hardware and software based security methods can be used to detect any subsequent modifications to the gaming software that might put a player at an unfair disadvantage. One disadvantage of the security methods described above is that the ability to later alter or expand gaming software to add additional features or correct errors is somewhat limited. For instance, for gaming machines that utilize EPROM's to store executable gaming software, the EPROM has to be physically replaced in the gaming machine to alter the gaming software.

A gaming entity may provide gaming services to tens of thousands of users. For instance, a single land-based casino may include thousands of gaming machines. Player's gaming interests are constantly changing and the effort associated with providing fresh content to users is quite costly. The ability of a casino operator to maximize their operating profits and keep their customers happy is directly linked to their ability to provide new and desirable gaming content. In view of the above, it would be desirable to provide gaming apparatus and method that reduce the costs associated with providing new gaming content on gaming devices.

SUMMARY

The present invention addresses the need described above by providing a gaming system. The gaming system may comprise a number of host devices each coupled to one or more gaming machines. The gaming machines may be operable to provide wagering on an outcome of a game of chance, display the outcome of the game of chance, accept cash or an indicia of credit and dispense an award, such as cash or indicia of credit, to a player utilizing the gaming machine.

Aspects of the present invention may comprise gaming system including a plurality of gaming machines. The gaming machines may be configured to provide bonus games with persistent. Further, the gaming machines may be configured to allow a player to enroll in bonus game with persistence and generate a record locator, such as printed ticket that allows a record of a state in the bonus game with persistence to be accessed at a later time. A server coupled to the plurality of gaming machines may maintain records of various states in the bonus game with persistence. When a valid record locator is presented at a gaming machine, these records may be checked out and updated via game play at the gaming machine.

One aspect of the present invention may be generally characterized as providing a server comprising: 1) a processor; 2) a communication interface; 3) a memory storing a plurality of records related to states in a bonus game with persistence, wherein each of the plurality of records includes information regarding at least one record locator, an expiration time associated with the record and information regarding a state in the bonus game with persistence, said information regarding the state including a status of a plurality of achievements.

The server may be designed or configured to: 1) communicate with a plurality of gaming machine via the communication interface, 2) receive information from a gaming machine related to a first record locator detected at the gaming machine; 3) locate the record associated with the first record locator; 4) compare information stored on the server pertaining to a record locator associated with the record with the information received from the gaming machine relating to the first record locator; 5) send information regarding a first state in the bonus game associated with the record to the gaming machine and instantiate a session wherein during the session only the gaming machine is permitted to provide to the server an update to the first state associated with bonus game; 6) in response to receiving information from the gaming machine related to a change in the status of one of the plurality of achievements associated with the state of the bonus game, update the record from the first state to a second state to reflect the change in the status of the one of the plurality of achievements; and 7) check the expiration time of each of the plurality of records, determine based upon the expiration time that a first record is to be closed, and in response to the determination, determine a value of the first record based upon at least the status of the plurality of achievements associated with the first record and close out the first record wherein the value associated with the first record is credited to an award pool. The plurality of records may include a first set of records associated with a first bonus game with persistence and second set of records associated with a second bonus game with persistence wherein achievements associated with the first bonus game are different than achievements associated with the second bonus game.

In particular embodiments, the server may be further designed or configured to determine a second record is to be closed and in response to the determination, determine a value of the second record based upon at least the status of the plurality of achievements associated with the second record wherein the value associated with the second record is offered as an award in a bonus game played on one of the plurality of gaming machines. Further, the server may be further designed or configured to receive a request for enrollment in the bonus game with persistence and in response create the record, said creation of the record comprising specifying an initial status for each of the plurality of achievements in the record and storing information relating to the record locator with the record. In response to receiving the response to create the record, the server may send a command to the first gaming machine to print a ticket that is to be used as the record locator associated with record. In general, the record locator may be one of a printed ticket, a smart card, a magnetic-striped card or a portable wireless device. In particular, the record locator may be a player tracking card associated with a loyalty program.

In other embodiments, the server may be further designed or configured to receive a message from the gaming machine indicating the session is terminated. After the session is terminated, the server may be further designed or configured to receive information from the gaming machine related to the first record locator detected at the gaming machine; 3) locate the record associated with the first record locator; 4) compare information stored on the server pertaining to the record locator associated with the record with the information received from the gaming machine relating to the first record locator and 5) send information regarding a current state in the bonus game to the gaming machine and instantiate a new session where updates to the record are permitted only by the gaming machine.

The server may be further designed or configured, after receiving the information from the gaming machine related to the first record locator, to download a media application to the gaming machine or provide information to the gaming machine that allows the gaming machine to download the media application from another source, said media application executable on the gaming machine to provide content associated with the bonus game with persistence. The content is related to one of a status interface for the bonus game with persistence, an award presentation for the bonus game with persistence or enrollment interface for the bonus game with persistence.

The server may be further designed or configured to receive a request from the gaming machine to associate a new record locator with the record. In response to receiving the request, the server is further designed or configured to send a command to the gaming machine to print a ticket to be used as the new record locator, receive information that uniquely identifies the ticket and store the information that uniquely identifies the ticket with the record. The server may be further designed or configured to receive a message from the gaming machine indicating all of the achievements associated with the bonus game with persistent have been obtained and in response close out the record.

The server may be further designed or configured to determine a new expiration time is needed for the first record locator, determine the new expiration time and send the new expiration time to the gaming machine and store the new expiration time with the record. In addition, the server may be further designed or configured to send a command to the gaming machine to print a ticket to be used as the record locator for the record wherein the new expiration time is printed on the ticket and to store information associated with the ticket to the record to allow the ticket to be used subsequently as the record locator. The server is further designed or configured to determine the new expiration time based upon when the bonus game with persistence is to end.

In particular embodiments, for a second record in the plurality of records an expiration time may be associated with a first achievement that is obtained in the plurality of achievements associated with the bonus game with persistence. The server may be further designed or configured to determine the first achievement in the plurality of achievements is expired based upon the expiration time and in response change a status of the first achievement from 'obtained' to 'not obtained' in the second record. Also, the server may be further designed or configured to send to the gaming machine the expiration time associated with the first achievement. The server may be further designed or configured to change the expiration time associated with the first achievement in response information received from the gaming machine.

In particular embodiments, the gaming machine may be operable to establish a communication link with a host device that enables content provided by the host device to be output on the gaming machine. To output the content provided by the remote host, a host-controlled process that may be authenticated by the gaming machine and executed in a secure memory location such that it may be isolated from other processes executing on the gaming machine may be utilized. The host-controlled processes may be decoupled from the process used to execute the game of chance played on the gaming machine such that the content output by the host-controlled process doesn't alter the play of game of chance.

In addition, the gaming machine may monitor the resources utilized by the host-controlled process to prevent the game play from being less than optimal. For instance, a host-controlled process could overburden the CPU on the gaming machine resulting in less than optimal graphical output for the game of chance or host-process could produce audio output that clashed with the audio output related to the play of the game of chance to produce an unpleasant gaming experience. In each of these instances, to prevent the game play experience on the gaming machine from degrading, the gaming machine may limit and/or prevent access to certain resources (e.g., CPU usage may be limited) and actively monitor resources utilized by the host-controlled process to insure that adequate game play performance is maintained.

Another aspect of the invention pertains to computer program products including a machine-readable medium on which are stored program instructions for implementing any of the methods described above. Any of the methods of this invention may be represented as program instructions and/or data structures, databases, etc. that can be provided on such computer readable media.

In one embodiment, each gaming machine in the gaming system disclosed herein may be operable to provide one or more locally controlled games (i.e., wagering games controlled by the master gaming controller which may comprise a gaming machine CPU or one or more processors) and also provide one or more externally controlled processes (i.e., remote host controlled processes), such as a process that provides content associated with a bonus game with persistence, wherein each externally controlled process must be authorized by the master gaming controller to maintain the integrity of the locally controlled game. In one such embodiment, if the externally controlled process is authorized by the master gaming controller, then the externally controlled process provides: (a) one or more services to the player; (b) one or more enhanced functions or features of the gaming machine to the player; (c) one or more outcomes to a player; or (d) a combination of such services, functions and outcomes to a player, wherein the externally controlled process may be based, at least in part, on one or more aspects of the locally controlled games. In other embodiments, if the externally controlled process is authorized by the gaming machine processor, then independent of the locally controlled games, the externally controlled process provides: (a) one or more services to the player; (b) one or more enhanced functions or features of the gaming machine to the player; (c) one or more outcomes to a player; or (d) a combination of such services, functions and outcomes to a player.

This embodiment may enable the gaming system to provide at least one outcome from a process (or one more process threads), which has previously obtained approval from a regulatory gaming commission (i.e., the game and game outcomes generated by the gaming machine's processor which utilize one or more approved random number generators and approved accounting procedures) and also provide at least one outcome from a process which has not previously obtained approval and may not require approval from a regulatory gaming commission (i.e., the outcome generated by the remote host).

In a particular embodiment, the master gaming controller that controls wager-based games played on a gaming machine may execute an interface program. The interface program may be approved for execution by the master gaming controller. The executed interface program may be utilized under control of a remote host to provide an interface on the gaming machine. The remote host may provide data, such as multimedia content and other instructions for utilizing capabilities of the executed interface program. The executed interface program may be designed/configured and utilized in a manner, such that, it may be unable to affect the outcome of the wager-based game played on the gaming machine.

The executed interface program may utilize various gaming machine resources (e.g., displays, input devices and output devices, storage devices, processors, communication interfaces, etc.). The utilization of these resources may occur while the gaming machine may be operable to provide play of the wager-based game of chance. In particular, the executed interface program may be used to output video and audio content provided from the remote host and receive input from devices coupled to the gaming machine, such as a touch screen. In this case, the executed program and its associated capabilities may be approved for execution on the gaming machine by the master gaming controller but specific instantiations of the interface provided by the executed program may not be pre-approved or even require jurisdiction approval. This capability allows the master gaming controller and gaming devices coupled to the gaming machine to be utilized to provide dynamically adjustable and customizable content on the gaming machine without requiring all of the content processed by the master gaming controller to be pre-approved for execution by the master gaming controller as has been done in the past.

In another embodiment, the gaming machine may not have to authorize an externally controlled process (or alternatively the externally controlled process may be pre-authorized by the gaming machine processor). In one such embodiment, the gaming device includes a separate display (or other devices) dedicated or substantially dedicated to providing any externally controlled processes to the player. In an alternative embodiment, one or more externally controlled processes may have a continuing or standing authorization. In one such embodiment, the authorization exists for one or more defined time periods. It should be appreciated that by utilizing the master gaming controller for at least one determination (i.e., the game of chance award determination described above) and by utilizing the remote host for at least another determination (i.e., a determined service, a determined enhanced gaming machine feature and/or a determined outcome provided via the externally controlled process), the gaming system disclosed herein may be operable to provide a plurality of determined aspects of the player's gaming experience wherein at least one determined aspect may be performed locally and at least one determined aspect may be performed remotely.

Accordingly, it should be appreciated a gaming device including a primary game operable upon a wager by a player, at least one display device, at least one input device, and a master gaming controller including at least one local processor may be provided. The master gaming controller may be programmed to communicate with a remote host, to enable the player to wager on a play of the primary game, generate a primary game outcome for the play of the primary game, cause all or a part of the display device to display the play of the primary game, and receive at least one request from the remote host to provide at least one remotely affectable process on the display device where the remotely affectable process may be executed by the master gaming controller. If the at least one request to provide the remotely affectable process is received, the master gaming controller may be programmed to determine an availability of at least one gaming device resource, such as all or a portion of the display. In a particular embodiment, when the gaming device resource is available and the gaming device resource is a display device, the master gaming controller may be programmed to accept the request to provide the remotely affectable process; and may enable the remote host to cause a portion of the display device to display content via the remotely affectable process, where the content displayed via the remotely affectable process is displayed simultaneously with the play of the primary game on the display device. If the gaming device resource is not available, the local processor may be programmed to reject the request to provide the remotely affectable process.

In another embodiment of the gaming system disclosed herein, the gaming system enables one or more players at one or more gaming machines to interact with the gaming machine and/or the remote host via a customizable interface under control of a remote host. In one embodiment, one or more aspects of the customizable interface may be affected in accordance with functions provided by the remote host and one or more aspects of the customizable interface may be affected in accordance with functions provided by the gaming machine. In this embodiment, the result of at least one player input via the customizable interface may cause a change related to the locally controlled game via a communication between the remote host and the gaming machine. For example, bonus credits won on the customizable interface may result in the bonus credits added to the credit meter on the gaming machine and subsequently displayed. Further, a result of at least another player input related to the play of the game or some other function on the gaming machine separate from the features provided by the customizable interface may affect a configuration of the customizable interface. For example, after a win of a large jackpot, the remote host may be notified and in response alter the configuration of the customizable interface, such as displaying a congratulatory message. This configuration enables different customizable features performed by different processors at different locations to be simultaneously displayed and altered by the player, thus enhancing the player's gaming experience.

In certain embodiments the devices and methods described herein include, but are not limited to any combination of two or more, three or more, or four or more, of the elements or features described above and/or any combination of two or more, or three or more, or four or more of the elements or features described herein.

Aspects of the invention may be implemented by networked gaming machines, game servers and other such devices. These and other features and benefits of aspects of the invention will be described in more detail below with reference to the associated drawings. In addition, other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and process steps for the disclosed inventive systems and methods for providing a bonus game with persistent. These drawings in no way limit any changes in form and detail that may be made to the invention by one skilled in the art without departing from the spirit and scope of the present invention.

FIGS. 4A-4F illustrate various embodiments of media display devices and associated content on a gaming device.

DETAILED DESCRIPTION

Figure 1A:
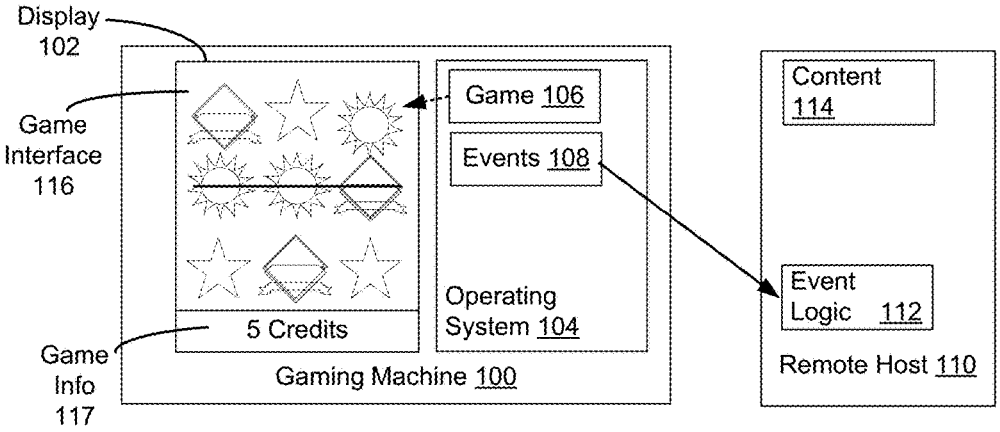
FIGS. 1A, 1B, and 1C are block diagrams illustrating an interaction between a host and gaming machine for one embodiment of the present invention.

Exemplary applications of systems and methods according to the present invention are described in this section. These examples are being provided solely to add context and aid in the understanding of the present invention. It will thus be apparent to one skilled in the art that the invention may be practiced without some or all of these specific details. In other instances, well known process steps have not been described in detail in order to avoid unnecessarily obscuring the present invention. Other applications are possible, such that the following example should not be taken as definitive or limiting either in scope or setting.

In the following detailed description, references are made to the accompanying drawings, which form a part of the description and in which are shown, by way of illustration, specific embodiments of the present invention. Although these embodiments are described in sufficient detail to enable one skilled in the art to practice the invention, it is understood that these examples are not limiting, such that other embodiments may be used and changes may be made without departing from the spirit and scope of the invention.

Although the present invention is directed primarily to gaming machines and systems, it is worth noting that some of the apparatuses, systems and methods disclosed herein might be adaptable for use in other types of devices, systems or environments, as applicable, such that their use is not restricted exclusively to gaming machines and contexts. Such other adaptations may become readily apparent upon review of the inventive apparatuses, systems and methods illustrated and discussed herein.

In the following figures, method and apparatus applicable to various gaming system configurations and their associated components are described. The gaming systems may comprise a network infrastructure for enabling one or more hosts to communicate with gaming machines. The gaming machines may be operable to provide wagering on a game of chance. A plurality of peripheral gaming devices, such as bill/ticket validators, printers, mechanical displays, video displays, coin hoppers, light panels, input buttons, touch screens, key pads, card readers, audio output devices, etc., may be coupled to the gaming machine. The gaming devices may be controlled by a master gaming controller executing authenticated software to provide a gaming interface for a game play experience on the gaming machine.

Aspects of the present invention describes method and apparatus for providing bonus games with persistence and externally based bonus content on a gaming machine configured to generate wager-based games. In particular, first, an embodiment of a gaming system providing bonus games with persistence is described with respect to FIG. 8. Next, interaction diagrams between a server and a gaming machine involving various aspects of persistent gaming are described for the purposes of illustration with respect to FIGS. 9A-9F. Next, in regards to FIGS. 1A-1C, embodiments of interactions between a host and a gaming machine utilizing an externally-controlled interface process are described. In particular embodiments, externally-controlled interface processes may be used to implement aspects of the persistent gaming embodiments described herein, such as but not limited to enrollment, a bonus status interface, updates and award presentations. In regards to FIGS. 2A-2B, embodiments of a gaming media management system that includes gaming machines and other gaming devices are described. In FIG. 3, interactions on a gaming machine hosting a media display device, which is an embodiment of an externally-controlled interface processes are described. In regards to FIGS. 4A-4F, various configurations of media display devices implemented on a wager-based gaming machine are described. Following FIGS. 4A-4F, additional details of a framework that allows media display devices to be implemented on gaming machines and other devices that may be provided in a gaming media management system are described. In FIG. 5, embodiments of method and apparatus related to resource monitoring on a gaming machine are described. Finally, in FIGS. 6 and 7, details of a wager-based gaming machine and an associated gaming system for embodiments of the present invention are described.

Bonus Game Architecture Including Bonus Games with Persistence

Figure 8:
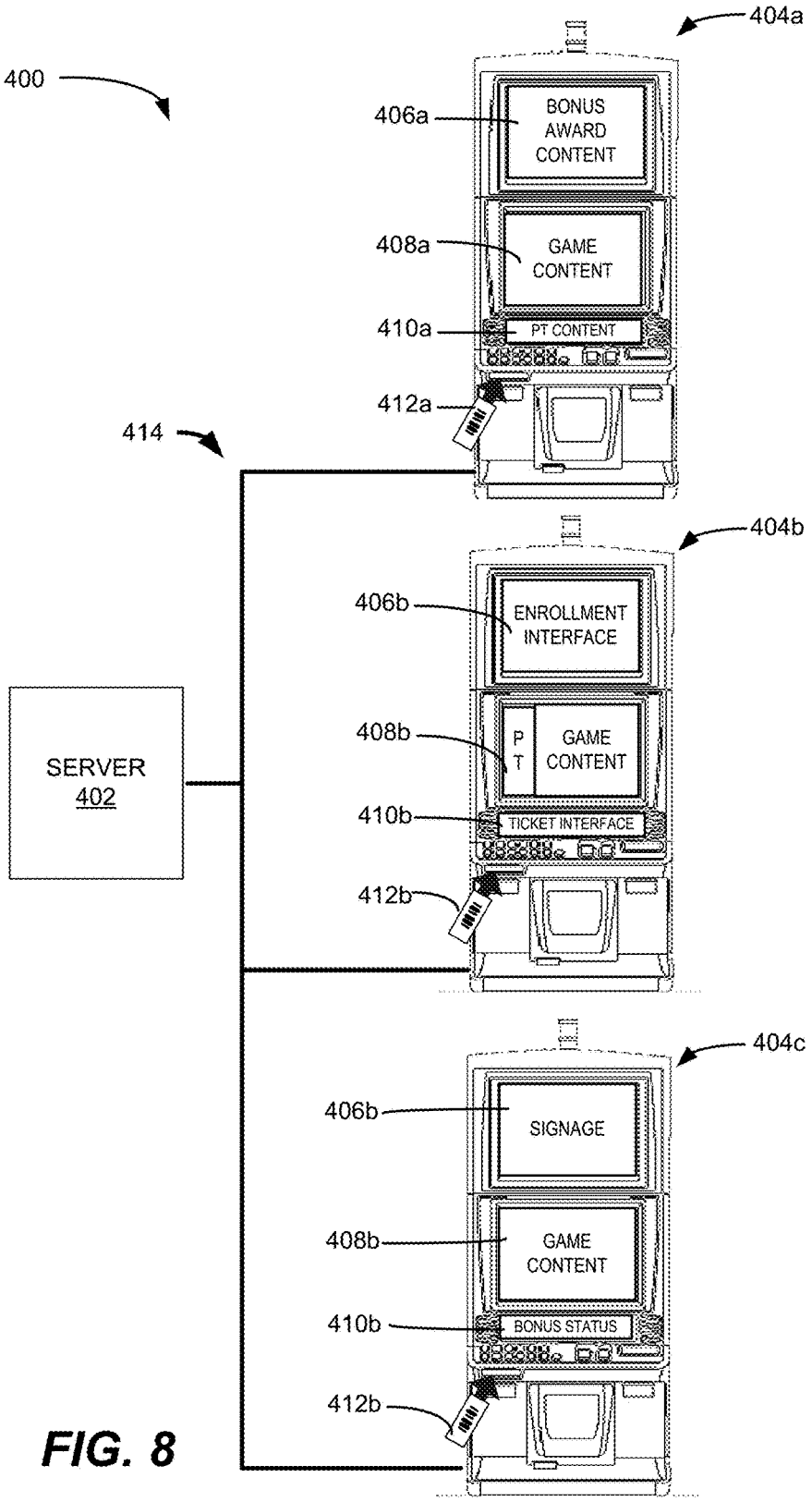
FIG. 8 illustrates a block diagram of a gaming system including persistent gaming for embodiments of the present invention.

FIG. 8 illustrates a block diagram of a gaming system 400 including persistent gaming for embodiments of the present invention. The gaming system 400 may include at least one server, such as 402, in communication with a plurality of gaming machines, such as 404*a*, 404*b* and 404*c*, via a network 414. The network may comprise one or more wireless and/or wired network links. The gaming machines may be operated in a single location, such as a casino, or may be spread out over multiple locations, such as multiple casinos. Thus, the network 414 may include local as well as wide area network links.

The gaming system 400 may provide persistent gaming. The persistent gaming may include obtaining achievements in one or more different types of games where an award may be provided after a set of achievements are reached. For instance, a persistence game may involve obtaining a first achievement during the play of a video slot game, a second achievement during the play of a slot game with a mechanical reel and a third achievement during the play of a video card game, such as a poker. When all three achievements are obtained an award may be provided. In another example, a persistence game may involve obtaining a plurality of achievements while playing a single type of game such as a slot game. In yet another example, the achievements may be associated with a particular type of game with a particular theme, such as video slot game with a particular theme. The specification of a particular video game may be used for promotional purposes.

In yet other embodiments, the achievement may be location and/or time dependent. In one example of location based achievement, the achievement may have to be obtained in a particular part of a casino. In another example of location based achievement, the achievement may have to be obtained at a particular site of a multi-site game. In an example of time dependent achievement, the achievement may have to be obtained during a certain time, such as between certain hours or on a certain day.

An outcome to a wager-based game is typically represented by a combination of indicia. For instance, an award to a slot game may be represented by a number of indicia, such as three or five, that appear along a payline. In another example, in a card game an outcome may be associated with a plurality of cards, such as a 5 cards for a poker game. In yet another example, in a bingo game an outcome may be represented by a series of numbers that are matched to a pattern.

In the embodiments described herein, the achievements may be associated with one or more indicia that are used as part of the presenting a game outcome to a wager-based game. The achievement may involve a combination of indicia or a single indicium. The indicia may be associated with an award or not associated award. For example, during a card game an achievement may be an appearance of a particular card, such as one-eyed jack or a particular hand, such as a heart flush. During a slot game, the achievement may be an appearance of a particular symbol or a combination of symbols, such as three cherries.

The achievements may be associated with parts of a game outcome presentation that don't involve a wager. For example, during a slot game a player may be presented with the opportunity to bet on a number of paylines. An achievement may be associated with an appearance of one or more symbols along a payline for which the player has not made a wager. In another embodiment, an achievement may only be obtained when one or more symbols appear along a payline for which the player has made a wager. In particular embodiments, the achievement may be associated with a winning or non-winning outcome.

In yet other embodiments, the achievements may be decoupled from the game outcomes. For instance, video and/or mechanical slot games may provide an array of symbols, such as a 3×3 array or a 3×5 array. The achievement could be associated with an appearance of a pattern of symbols in the array, such as a cherry on each corner of the array for a slot game using cherries as a symbol or an appearance of 6 cherries at one time in the 3×3 array or 10 cherries in a 3×5 array. In these examples, the patterns that trigger the milestones are not associated with a game outcome (e.g., an award may not be associated with 4 cherries appearing in the corners of a 3×3 array of symbols or an award may not be associated with 10 cherries appearing in a 3×5 array symbols.

In further embodiments, the achievements may be independent of a game type. For example, a player may have to win an award associated with a particular wager above a certain threshold amount, such as $100 dollars. This award threshold achievement may be triggered on any type of game, such as but not limited to a card game, a mechanical slot game, a video slot game or a bingo game. Thus, a player could play a game of their choosing to obtain the achievement. In this example, the achievement may be denomination independent. Thus, a player could play a $5 dollar denomination slot machine or a penny slot machine to obtain the achievement where the player is more likely to obtain the achievement as their wager amount goes up. In other embodiments, achievements may be denomination dependent where an achievement may be adjusted according to the denomination level, such as 10,000 credits for a penny wager versus 100 credits for a dollar wager.

In particular embodiments, the persistent games may involve player recognition of the achievement, may be automatically recognized by the gaming machine or combination thereof. For instance, akin to daubing in bingo, when a particular pattern associated with a persistent game appears during a game outcome presentation, a gaming machine may require an activation of a particular input device, such as a button, to recognize the achievement or the gaming machine may automatically recognize the achievement without player input. The gaming machines, such as 404*a*, 404*b* and 404*c*, may provide an interface that provides a description of achievements, such as a particular combination or patterns that are associated with a persistence game.

Returning to FIG. 8, in particular embodiments, the server 402 may act as host to provide functions relating to the play of bonus games with persistence (BGWP). For instance, the server may store records of states for one or BGWPs. The state of a particular BGWP may change instantiations of the same type of game are played or different types of games and their associated instantiations are played on a gaming machine. The server 402 may store and update records to reflect these changes and communicate with various gaming machines, such as 404*a*, 404*b* and 404*c*, at least at the beginning and at the end of a game play session on the gaming machine to maintain these records.

The server 402 may maintain one or more award pools associated with one or more BGWPs including award amounts. The server 402 may be configured to notify a plurality of gaming machines when a BGWP has been won or event associated with a bonus game with persistence has been triggered. For example, one player obtaining all or a portion of the achievements associated with a BGWP may trigger an award for a single player or a group of players. In another example, obtaining all or a portion of the achievements associated with a bonus game with persistence may trigger an event such as a group game or tournament game.

In another function, the server 402 may expire or reset achievements associated in records associated with a BGWP. In various embodiments, time limits may be associated the BGWPs and records of states associated with these bonus games. For example, after a certain time period a BGWP may be closed out and all records associated with the game may be closed out. As another example, after a period of inactivity associated with a record, the record may be closed out. In yet another example, after an award or event is triggered in a bonus game with persistence, it may be desirable to reset or change certain achievement associated with records associated with the BGWP in which the award or an event is triggered. Details of expiring or resetting records associated with BGWP are described with respect to FIGS. 9*a* and 9*b*.

In other embodiments, the server 402, may provide content or links to content that may be downloaded to a gaming machine and utilized in generating the bonus game with persistence on the gaming machines, such as 404*a*, 404*b* and 404*c*. As is described with respect to FIGS. 1-7, content associated with games, bonus games, player tracking and other applications may be downloaded and the embodiments described herein are not limited to content associated with bonus games with persistence. In some embodiments, the content, which may include video, audio components as well as instructions related to the operations of devices on a gaming machine may be compatible with a media player executed on the gaming machine, such as an Adobe Flash Player™ as is described in more detail with respect to FIGS. 1A-5. Examples of content that may be provided include but are not limited to 1) content associated with the bonus game with persistence that are imported into a game and output as part of a game presentation, such as special symbols associated with the BGWP, 2) content associated with an award or an event, such as a tournament, video content associated with enrollment into a BGWP, 3) content associated with a bonus status interface, such as a status interface that shows achievements obtained, achievements needed and/or awards associated with achievements for one or more BGWPs and 4) content associated with advertisements for BGWPs, such as content encouraging a player to participate.

Content associated with a BGWP may be displayed on various locations on a gaming machine, such 404*a*, 404*b* or 404*c* as well as signage or other displays associated with a gaming system. For example, on gaming machine 404*a*, game content associated with a game is shown on display 408*a* and an award associated with a BGWP is shown on display 406*a*. As described in the previous paragraph, the bonus award content may be downloaded from a remote device and output on the gaming machine, such as in 406*a*. Further, as described in the previous paragraph, the game content may include content on display 408*a*, such as special symbols, that may be downloaded from server 402 or another remote device.

On gaming machine 404*b*, an enrollment interface is shown on display 406*b*. The enrollment interface may allow a player to enroll in a BGWP. In response to an enrollment, the gaming machine, such as 404*b*, may generate and issue a record locator, such as a printed ticket voucher, that allows a status in a BGWP to be accesses during a subsequent gaming session. In one embodiment, the enrollment interface may be provided as part of the game of chance executed on the gaming machine. In another embodiment, the enrollment interface may be provided via an externally controlled interface (ECI) that is described with respect to FIGS. 1A-7 and may be decoupled from the game of chance.

The ticket interface shown on display 410*b* may be configured to allow a new ticket voucher, such 412*a*, 412*b* or 412*c*, to be printed as a record locator for a BGWP. For example, a new ticket voucher may be printed when a current ticket is worn or damaged. In one embodiment, the ticket interface that is configured to allow a replacement ticket to be generated may be only accessible to an operator. Thus, to access the ticket interface, the gaming machine may be configured to require that access information is first received. The access information may be input via a device, such as a card reader when an operator card is inserted. In another example, the access information may be input into the gaming machine via an input device, such as a key pad. In other embodiments, the gaming machine may detect an insertion of an operator key, such as a physical key or an electronic dongle, which may allow the ticket interface to be accessed.

On gaming machine 404*c*, signage related to the BGWP is shown on display 406*c*. The signage content may be downloaded from a remote device and in some embodiments may be an ECI. The signage may include advertisements or other information that may encourage enrollment in a BGWP. On display 410*c*, a bonus status interface is shown. The bonus status interface may provide information about a current status of a BGWP associated with a state instantiated and being update on gaming machine 404*c*.

The bonus status interface may include information regarding achievements obtained, achievement remaining and award information, such as awards associated with a particular BGWP. If, as part of the BGWP, multiple participants are competing to obtain a set of achievements, the bonus status interface may include information regarding the status of other participants in the BGWP, such as one or more participants with the most achievements. In one embodiment, the bonus status interface may be executed as a media application executed from a media player, such as a flash application executed from a flash player. The media application may be downloaded from a remote device when one or more BGWP are instantiated on a gaming machine.

Other information that may be displayed in a bonus interface associated with the BGWP may be a time limit associated with the BGWP, such as when the BGWP is going to be closed out. In addition, information associated with a particular record locator, such as a printed ticket, smart card, magnetic striped card, cell phone, RFID tag or other portable device, may be displayed. This information may include one or more BGWPs associated with the record locator, whether the record locator is still valid and expiration information associated with the record locator.

Various embodiments of gaming machines, such as 404*a*, 404*b* and 404*c*, may be configured to accept and configure one or more types of record locators associated with a BGWP. In one embodiment, the gaming machines in system 400 may recognize only printed tickets, such as 412*a*, 412*b*, 412*c*, to access information associated with a state in a BGWP stored on server 402. The tickets may be read via a ticket reader and bill validator device associated with the gaming machines.

The gaming machines in system 400, such as 404*a*, 404*b* and 404*c*, may be configured to provide player tracking services. In some embodiments, one or more of the gaming machines may provide player tracking services via a traditional player tracking device that is coupled to a master gaming controller on the gaming machine. The player tracking device may include a separate logic device and may control one or more peripheral devices, such as a display, a card reader and input device, such as a key pad or a touch screen where the card reader is used to input player tracking information. For example, display 410*a* on gaming machine 404*a* may be associated with a traditional player tracking device.

In other embodiments, as is described in more detail with respect to FIGS. 1-7, the player tracking services may be provided with an ECI. For example, an ECI providing player tracking functions is shown on a portion of display 408*b*. In one embodiment, this portion of the display may be opened and closed via an input button. The various interfaces shown on gaming machines, 404*a*, 404*b* and 404*c*, are provided for illustrated purposes only. Some gaming machines may include more or less displays. Further, at different times, a single display may be used for different purposes or only the same purpose. For example, a display, such as 410*a*, 410*b* or 410*c*, may be used in some embodiments to provide only player tracking functions. In other embodiments, at one time, the display may be used to provide a player tracking interface, a ticket interface or a BGWP status interface.

In a particular embodiment, player tracking sessions and BGWP sessions may be both initiated using only printed tickets. Thus, the gaming machines may not include card readers or may not be configured to recognize player tracking information input via a card reader. For instance, in one embodiment, a printed ticket may include a record locator to a player tracking account where insertion of a ticket initiates the player tracking session. In some embodiments, one or more BGWP states may be associated with a player tracking account. Thus, the player tracking account may include one or more record locators associated with a BGWP. Thus, a retrieval of the player tracking information may also include a retrieval of state information associated with a BGWP where in response to insertion of a single ticket voucher a player tracking session and a BGWP session may be both instantiated on one of the gaming machines.

In other embodiments, player tracking record locators and BGWP record locators may be stored on separate tickets. Thus, to initiate a player tracking session, a ticket voucher with player tracking information may be inserted in a ticket reader, such as a bill validator, may be read and then may be ejected from the bill validator. When the ticket is associated with a valid record, a player tracking session may be initiated. Further, the ejected ticket may be used again to initiate a future player tracking session. To initiate the BGWP session, a ticket voucher may be inserted into the bill validator and when matched to a valid record, a BGWP session may be initiated. This ticket may also be ejected from the ticket reading device, such as a bill validator, so that it may be used to initiate future sessions involving a BGWP. When a ticket voucher storing a credit amount is inserted into the bill validator or ticket reader, information stored on this ticket may be read and when the ticket is associated with a valid record credits may be deposited on the gaming machine. A ticket storing a credit value may be accepted and stored in the gaming machine.

In various embodiments, one or more of the player tracking ticket, the BGWP ticket, the ticket storing a credit amount or combinations thereof may be inserted during a gaming session. The gaming machines may be operable to accept an insertion of these tickets in any order. In various embodiments, the gaming machines may be configured to print each type of these tickets. In other embodiments, the gaming machines may be operable to accept and print tickets storing a credit amount but may be operable to accept but not print one of the player tracking tickets or the BGWP tickets. In a particular embodiment, a single device, such as server 402, may be operable to provide ticket services that involve validating/issuing tickets associated with BGWP, cashless gaming and/or player tracking via tickets or other instruments, such as cards.

Figure 9A:
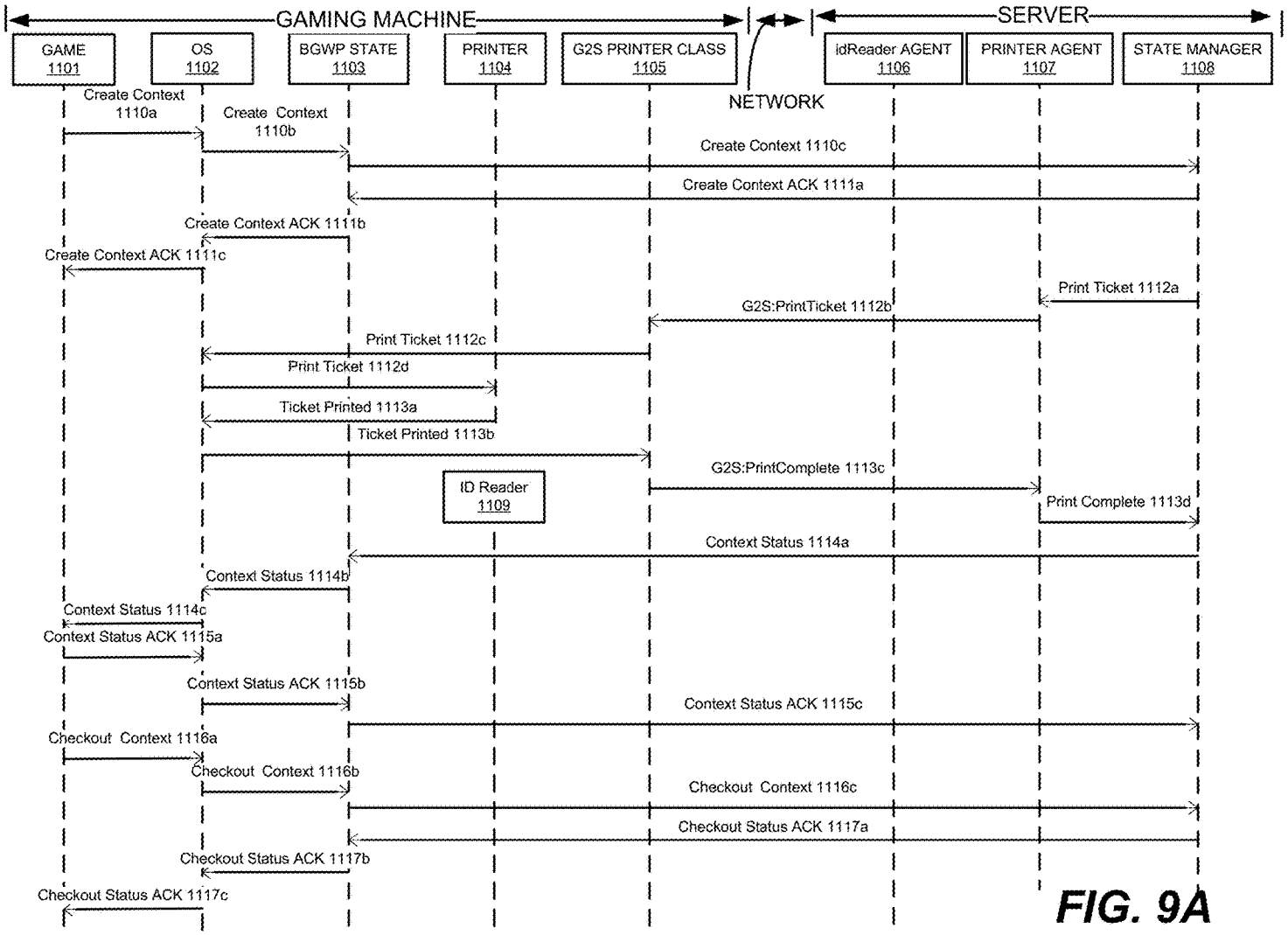
FIG. 9A-9F shown interaction diagrams between gaming machine components and server components for embodiments of the present invention.

FIG. 9A-9F shown interaction diagrams between gaming machine components and server components for embodiments of the present invention. In FIG. 9A aspects of an enrollment process for a BGWP are described. In one embodiment, a game 1101, which may comprise a plurality of software components, on a gaming machine may be configured to track achievements associated with a BGWP and provide an opportunity to enroll in the BGWP. In response, to an event on the gaming machine, such as but not limited to credits being deposited on the gaming machine, the game 1101 may display a message to indicate that it is possible to enroll in a BGWP. In response to detecting an activation of an input device, such as a button, configured to indicate a decision to enroll. The game 1101 may initiate an enrollment in the BGWP. In another embodiment, the game 1101 may be configured to automatically enroll a player in the BGWP independent of a player input.

In one embodiment, the game 1101 may be customized with graphics and sounds that may be used as part of an outcome presentation to indicate achievements to a user. For instance, the gaming machine may include special graphics, such as symbols, paylines or other indicators that are highlighted when an achievement is obtained. The game 1101 may also include the logic that determines whether an achievement associated with a BGWP has occurred and reporting functions that allow other logical entities that operate on this information to be notified, such as a remote server where records associated with states in a BGWP are stored. Further, the game 1101 may include logic to determine when a plurality of achievements are obtained that can result in an award and trigger an event indicating that the group of achievements are obtained where the event may be sent to other logic entities located locally on the gaming machine or remote from the gaming machine. In addition, the game 1101 may be configured to maintain a BGWP interface that is displayed on the gaming machine that indicates one or more of 1) achievements obtained in a BGWP, 2) achievements to be obtained in the BGWP, 3) associated awards with one or more groups of achievements, 4) general BGWP information, such as a time remaining before the BGWP is timed out, and 5) record locator information, such as a remaining time associated with a record locator, such as a printed ticket.

In other embodiments, one or more functions integrated into the game 1101 and associated with a BGWP may be decoupled from the game 1101 and provided by another logical entity. For example, in one embodiment, all of the BGWP associated functions may be provided by another logic entity where the game 1101 is not configured with any information associated with the BGWP. Thus, the game 1101 executes in the same manner whether the outcomes are associated with a BGWP or not associated with a BGWP.

In a particular embodiment, the game 1101 may be configured to allow one or more symbols associated with a game outcome to be exchanged. For instance, the game 1101 may include pointers to files for particular symbols where the gaming machine allows these files to be updated with different graphical components. In this example, the one or more symbols may be exchanged but the underlying game logic may still remain fixed. Thus, the game again may execute in the same manner whether it was associated with a BGWP but certain symbols may be used to provide a visual indicator to a player that a BGWP is being played.

In a particular embodiment, an ECI process may perform the BGWP functions, such as but not limited to 1) enrollment, 2) maintaining and reporting on a BGWP state, 3) presenting an award presented with a BGWP state and 4) presenting a BGWP interface. One or more ECI processes may be instantiated as media applications. The media applications may be downloaded from a remote device and executed from a media player on the gaming machine. The game 1101 may report the components of a game outcome presentation it has generated, such as all of the indicia associated with the game outcome presentation and associated awards. The BGWP media application(s) may include rules/conditions that allow the application to determine whether any achievements have been obtained when a game generates a particular game outcome. These rules may be developed for different type of games. These rules may be modified for a new BGWP by downloading a new BGWP media application.

More than one set of rules may be developed for the same game. Thus, in one embodiment, a play of a game may contribute achievements to two or more different BGWP games that are being concurrently played. For instance, in a card game, a four of a kind may be achievement for a first BGWP and four aces may be an achievement for a second BGWP. Thus, when a hand with four of a kind is generated by the game and received by a BGWP application, the BGWP application may determine that a first achievement is obtained for the first BGWP. In response, a bonus interface and a BGWP may be updated. When four aces is generated by a game and detected by a BGWP application, the BGWP application may determine that an achievement is obtained for the first BGWP and the second BGWP and in response, a bonus interface may be updated as well as the a state associated with the first BGWP and a state associated with the second BGWP. The second BGWP may be associated with more difficult achievements and thus, may be associated in general with a higher win value.

In yet another embodiment, during an enrollment phase a logical entity comprising one or more software components, may generate an enrollment interface that allows a user to select achievements for a BGWP. In one embodiment, the achievements may be equivalent in the sense that they have an equal or nearly equal chance of occurring and selections may be made from one or more groups of similar achievements which may occur during different games. In another embodiment, during an interface may be provided that allows a user to participate in a personal BGWP comprising a group of achievements input via a BGWP enrollment interface.

Returning to FIG. 9A, when the game 1101 determines that an enrollment is to occur in a BGWP, the game 1101 may generate a create context message 1101*a* that is posted to the operating system 1102 as an event. In response, a portion of non-volatile memory may be allocated that allows a state associated with the BGWP to be stored on the gaming machine and maintained in the event of a malfunction. For example, in the event of a malfunction on the gaming machine, such as power-failure, between a determination that an achievement associated with a BGWP has occurred, but prior to an update of a state maintained by the state manager 1106 on a remote server, when power is restored, the gaming machine may be operable to reboot and update the state manager 1106.

The BGWP state 1103 may receive the create context 1102*b* from the OS 1102. The BGWP state 1103 may handle communications with a remote sever. In particular, the remote server may host a state manager 1108 that maintains records associated with one or more BGWPs. The BGWP state 1103 may send a create context 1110*c* to the state manager 1108. In response, the state manager 1108 may create a new record that is associated with the new context that is to be created. The state manager 1108 may send an acknowledgement to the BGWP state 1103 that is then sent to the OS 1102 and then game 1101 via messages 1111*a*, 1110*b* and 1110*c*, respectively.

In addition, in one embodiment, when a ticket is being used as a record locator for the state stored by the state manager 1108, then the state manager 1108 may generate a unique identifier for the new record that is to be recorded on the ticket. If another type of storage media is employed, then this unique identifier may be recorded on the storage media. Recording to the storage media may involve printing the record to a substrate or altering a state of a memory comprising electronic, optical and/or magnetic-based memory units. This unique identifier may be used to access and update a record associated with a BGWP maintained by the state manager. In particular embodiments, the BGWP record may or may not include information that allows a particular player to be identified, such as a user name or a player tracking account number.

The state manager 1108 or another logical entity may determine one or more expiration times during the enrollment process. For instance, a first expiration time may be related to time period in which a particular BGWP game is to be provided, such as a time less than day, days, weeks or months. A particular BGWP may be provided for a time period as short as a few hours to a time period of months. A second expiration time may be associated with a time period between accesses to the record. For instance, if a record has not been accessed for over two months it may be expired. A third expiration time may be associated with the record locator. For instance, the record locator, such as a printed ticket may be valid for a time period of a particular length. These expirations may be the same or different and may change depending on the circumstances. For example, if the expiration time associated with the BGWP is less than the expiration time associated with the record or the record locator, than the expiration time associated with the record or the record locator may be set to a value that is the same or less than the BGWP expiration time. If the expiration time associated with the BGWP is greater than a default maximum associated with the record or the record locator than the expiration time of the record or the record locator may be set to a default maximum.

In one embodiment, an expiration time may be associated with individual achievements. Thus, when one of the achievements reaches its expiration time, the achievement may be removed and the achievement may have to be re-obtained to progress in the game. In one instance, one or more of the individual achievement expiration dates may be reset each time a record associated with the BGWP is checked out and game play associated with the BGWP is detected or after a certain amount of game play associated with the record has been detected, i.e., additional time may be allocated before one or more achievements is expired. In a particular embodiment, a default expiration time may be assigned to various achievements but the additional time may be awarded based upon a player's game play. For example, an award of additional time to obtain an achievement may be made based upon playing time or an amount wagered over time to encourage additional game play.

In another embodiment, an expiration of one or more achievements may be based upon obtaining another achievement. For example, after obtaining a first achievement, an amount of time is allocated to obtain a second achievement. If the second achievement is not obtained in the allocated amount of time, then the first achievement may expire and to advance in the BGWP, the first achievement may have to be re-obtained. The BGWP status interface may be configured to output information associated with achievement expirations and achievement time extensions. For example, the bonus status interface may show a timer where the time value associated with a particular achievement is decreasing but may be increased in increments to reflect time extension awards.

During a BGWP state session, where BGWP record is checked out and may be updated from game play associated with a BGWP, a logic entity on the gaming device providing the BGWP game play may check for any changes in achievement status as a result of an achievement time expiration occurring. Thus, an update from a gaming device, such as a gaming machine to a server storing, the records may include either an update relating to obtaining or losing an achievement. While the record is stored on the server (checked-in) the server may regular check BGWP records to determine whether any achievements may have been lost as a result of an achievement expiring.

The server may implement these checks continuously or at various time periods. For instance, the server may cycle through all of the records and when the check is complete restart at the beginning. In another example, the server may check records on an hourly basis or a daily basis. The interval between checks may be a specifiable parameter.

After a new record is created, the state manager 1106 may send a print ticket message to the printer 1104. The print ticket message may include a unique identifier associated with the record, information about the BGWP game and/or operator and one or more expiration times, such as expiration times for the record, the record locator and the BGWP game. In this embodiment, the printer agent 1107 may be in charge of receiving and processing printer communications from a gaming device, such as but not limited to a gaming machine providing wager-based games, a kiosk or an operator station. The G2S printer class 1105 may implement a game to server communication protocol on the gaming machine associated with the printer 1104 communications.

The print ticket message may be received respectively by the printer agent 1107, the G2S printer class 1105, the OS 1102 and the printer 1104, in messages 1112*a*, 1112*b*, 1112*c* and 1112*d*, respectively. The messages may be parsed, translated and processed as needed by each of the logic entities between the state manager and the printer 1104. In response, the printer 1104 may generate an acknowledgement that the ticket has been printed. If a magnetic striped card or some other media were used to record information, then a similar response message can be generated by a device associated with recording information to the media. The ticket printed message may be sent via the OS 1102, the G2S printer class 1105, the printer agent to the state manager 1108 via messages 1113*a*, 1113*b*, 1113*c* and 1113*d* respectively. The message may include information that uniquely identifies the record locator, such as a unique ticket number in the case of a printed ticket or a unique serial number in the case of a magnetic-striped card. This unique identifier may be used to later validate the record locator as being authentic.

After receiving the ticket printed message, the state manager 1108 may send a context status message to the game 1101 and receive an acknowledgement from the game 1101 via messages 1114*a*, 1114*b*, 1114*c*, 1115*a*, 1115*b* and 1115*c* respectively. In response to the record and the record locator being correctly generated, the context status message may indicate that a gaming session involving an updates and maintaining of a BGWP may be commenced. In response, the game 1101 may send a message to the state manager 1108 to "check out" the record associated with the BGWP state. While a record is checked out to a particular gaming device, the state manager 1108 other gaming devices may not be operable to check out the record and provide updates to the BGWP state. The request to checkout the record may be sent from the game 1101 to the state manager via the messages 1116*a*, 1116*b* and 1116*c* respectively. In response, the state manager may send an acknowledgement that the record is locked and may also send information regarding the initial state of BGWP associated with the record. The initial state may comprise no achievements or the initial may be created with one or more achievements already obtained.

When the record is checked out, for embodiments where the game 1101 doesn't include all of the functions or information needed to provide the BGWP, the server may send commands, instructions or data that allows the game 1101 separately or embodied in a media application that allows that BGWP to provided. For instance, the state manager may send a list of achievements to detect and report to the state manager that are associated with the game 1101. When the record was checked out, the game 1101 may send information that allows the server to determine what type of achievements that the game 1101 may be provided towards the BGWP and hence generate the list. If the BGWP is provided on a gaming machine where the game that is played may be changed during a gaming session, then each time the game is changed, a message may be sent to the state manager and a list of achievements that is associated with the current game may be provided to the gaming machine.

In some instances, depending on a selected game and a particular instantiation of a BGWP, no achievements may be earned during the play of the selected game. In some cases, no achievements may be earned during the play of the selected game because it is not part of the BGWP. For instance, the BGWP may be limited to particular types of games or game themes for a particular type of game. In other cases, an achievement may not be earned because all the achievements have been earned from playing the particular game and it may be required that a different game or games be played to earn the remaining achievements. This information may be indicated on the BGWP status interface. For instance, the BGWP status interface may receive an information regarding the current state of the BGWP, all the achievements and their associated games and provide a message that is output on the gaming machine, such as via a media display device described below as follows, "Achievements related to this game have already been obtained, select and play 'game x' to obtain 'achievement x' or 'game y' to obtain 'achievement y.'

In particular embodiments, the ID reader 1109 and idReader agent 1106 may implement a communication protocol that allows information associated with an ID, such as a magnetic striped card associated with a player tracking program, to be transmitted from a gaming machine to a remote server. In one embodiment, the record locator associated with the BGWP, such as the printed ticket is treated as an ID. When the ticket is inserted into the gaming machine, an instantiation of the ID reader 1109 is created, which receives information read from the printed ticket. The insertion the ticket may be treated like a 'card-in' event associated with a player tracking unit. The gaming machine may be operable to support multiple simultaneous instantiations of IDs, such as a 'card-in' event associated with an insertion of a ticket and a 'card-in' event associated with inserting a player tracking card in a card reader. Further details, of the ID reader 1109 and the idReader agent 1106 are described with respect to FIG. 9B.

Figure 9B:
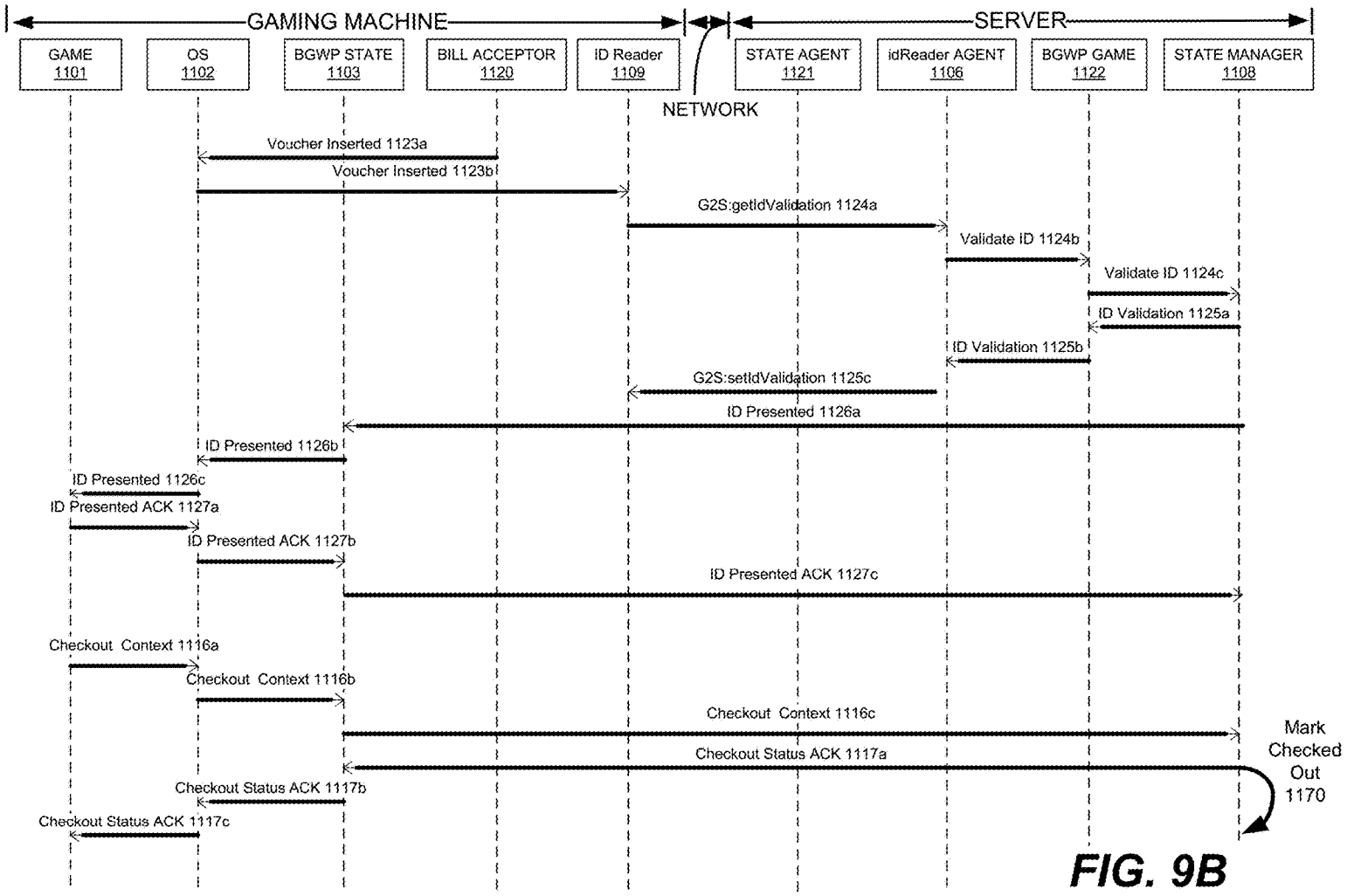

FIG. 9B is an interaction diagram between a gaming machine and a server for one embodiment of the present invention. In this embodiment, a gaming machine may read a record locator, which is a ticket voucher, associated with a BGWP game to initiate a BGWP session where a state associated with the BGWP may be updated. The ticket is inserted into a bill validator. Information read from the ticket may identify it as an ID associated with a BGWP game. In this case, an ID reader 1109 that correctly parses the information read from the ticket and that communicates with the iDReader agent 1121 on the server may be instantiated. Details in regards to information that may be recorded on a printed ticket, an RFID tag, a read-writeable thermal print card and other devices as well as card-in and card-out events associated with these devices that may be utilized with the embodiments described herein are described in co-pending U.S. application Ser. No. 10/214,936, titled, "Flexible Loyalty Points Programs," filed Aug. 6, 2002 and co-pending U.S. application Ser. No. 11/927,420, titled, "Circulating Data Card Apparatus and Management System," filed Oct. 29, 2007, each of which is incorporated by reference and for all purposes.

In 1123*a* and 1123*b*, information read from the ticket inserted into the bill acceptor 1120 is send to the ID reader 1109, which parses the information and generates a message that allows the ticket to be validated as an ID. This information is sent via messages 1124*a*, 1124*b* and 1124*c* to the state manager 1108. The BGWP game 1122 may be an instantiation of a particular BGWP and may determine whether the information from the record locator is associated and compatible with the BGWP. Further, BGWP game may process BGWP specific communications received from the BGWP state 1103 using a protocol associated with a BGWP class. The state manager 1108 may validate the record locator, such as by comparing information read from the record locator with information regarding a record associated with the record locator.

When the information matches, the state manager 1108 may send to the ID reader a message indicating a valid ID has been presented in 1125*a*, 1125*b* and 1125*c*. If the record associated with the record locator can't be found, is expired or checked out. The state manager 208 may generate an error message that may be logged locally and that may be sent to the gaming machine (not shown) and the ticket may be ejected.

The state manager 1108 may check the expiration date associated with the record locator. If the record locator is near its expiration date, the state manager 1108 may generate a print ticket message to have the gaming machine issue a new ticket voucher with a new expiration date. In this embodiment, only the new ticket may be associated the BGWP state and the old ticket may no longer be utilized. In another embodiment, the state manager may detect that the expiration date associated with the ticket voucher or the expiration date associated with the record is greater than the expiration date associated with the BGWP itself and issue a print ticket command to generate a new ticket.

In some embodiments, a history of record locators associated with a BGWP state may be stored. Thus, if a player somehow loses the new ticket voucher but has retained the old ticket voucher, it may be possible locate the BGWP state associated with the old ticket voucher. At the discretion of the operator, a new ticket voucher that is valid may be issued to the player.

In other embodiments, more than one record locator may be associated with a BGWP state. For example, a BGWP state may be associated with printed ticket and a player tracking card. When either instrument is detected at a gaming machine, this information may be sent to the state manager 1108, the ID may be validated and the gaming machine may be allowed to update the BGWP state via game play.

In particular embodiments, the printed voucher associated with the BGWP is distinguished from a cashless voucher associated with an indicia of credit amount. Cashless vouchers may be accepted into the bill acceptor 1120 and when the cashless voucher is valid, stored in the gaming machine. When the cashless voucher is not valid, it may be ejected from the gaming machine. The printed vouchers associated with the BGWP may be ejected when they are valid and not stored on the gaming machine. An exception may occur, as is described with respect to FIG. 9E, when a bonus game associated with the BGWP state is offered where an award associated with the bonus game corresponds to a value of the BGWP state. In this instance, after the award, the ticket voucher may be stored on the gaming machine.

When the record locator is valid, the state manager may notify the game 1101 or another logical entity providing the BGWP functions on the gaming machine that a valid record locator associated with a valid record has been inserted in the gaming machine via messages 1126*a*, 1126*b*, 1126*c*, 1127*a*, 1127*b* and 1127*c* respectively. As previously described, the BGWP state 1103 may receive and send these BGWP related communications. In response, the game 1101 may check out the record associated with a state of the BGWP stored on the server as described with respect to FIG. 9A. In 1170, the state manager may mark the record checked out. In the case of the ticket voucher, the ticket associated with the BGWP inserted in 1123*a* may be ejected.

When credits have been deposited on the gaming machine, the gaming machine, game play may begin where achievements associated with a BGWP may be obtained. In one embodiment, the state manager may expect an acknowledgement within a time period that game play on the gaming machine has begun. It is possible that a ticket voucher associated with a BGWP may be inserted in the gaming machine prior to credits being deposited on the gaming machine. Thus, if credits are not subsequently deposited and game play is not initiated within a particular time period, the gaming machine may mark the BGWP state checked back-in and display a message indicating the BGWP is no longer active on the gaming machine. In other embodiments, the gaming machine may not accept information read from a BGWP associated record locator, such as a ticket voucher, until credits have been deposited on the gaming machine. In the case of a ticket voucher associated with the BGWP, the ticket voucher may be ejected if it is inserted prior to credits being deposited on the gaming machine.

Figure 9C:
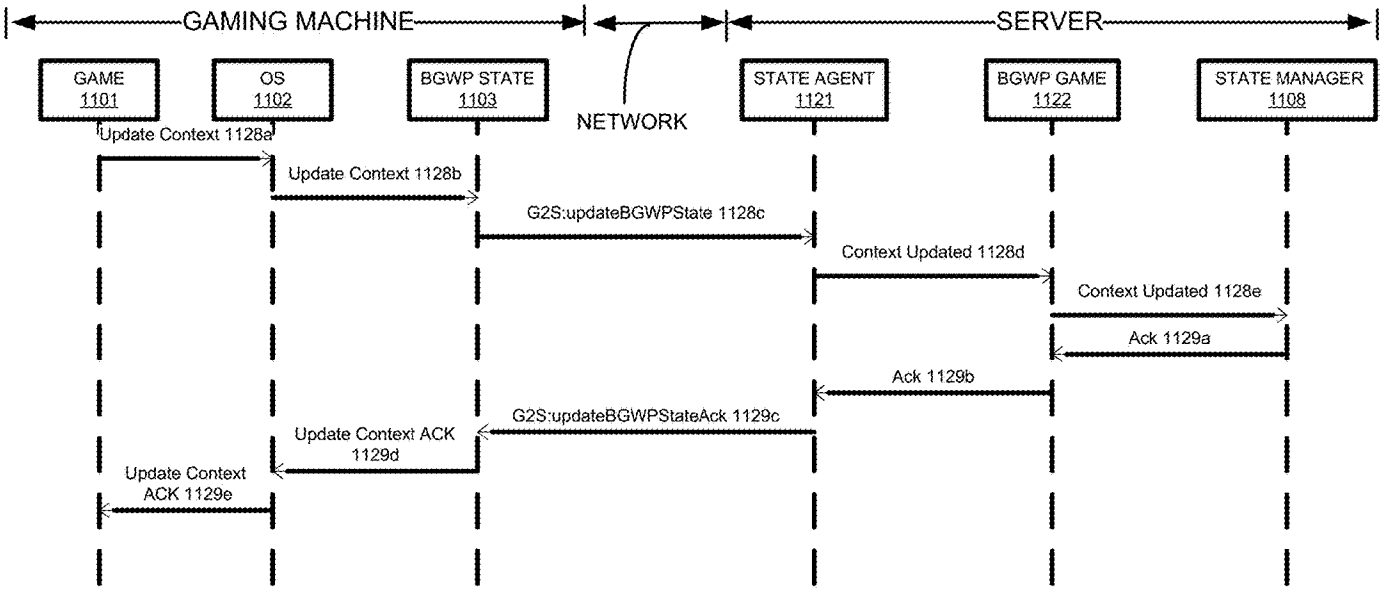
Figure 9D:
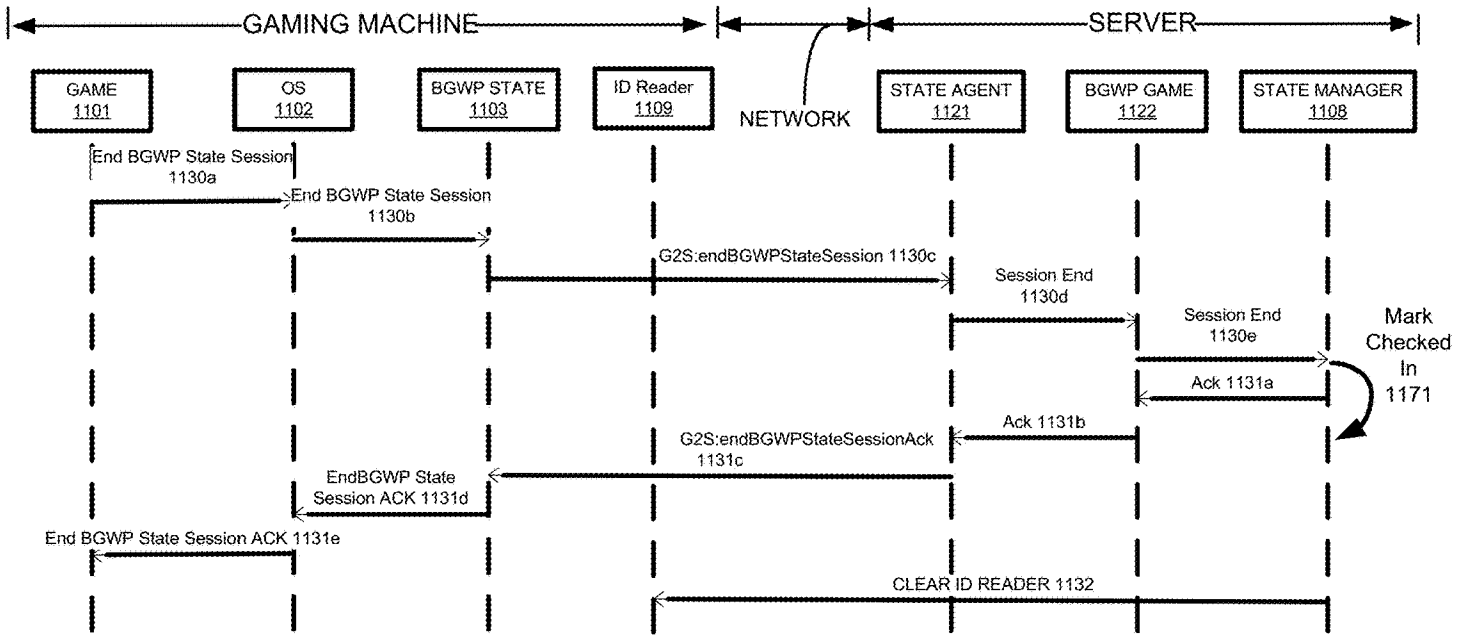

In FIG. 9C, an embodiment of a updating a BGWP state is illustrated. The game 1101 in this embodiment may determine an achievement has been obtained that is part of the BGWP. Thus, the game 1101 may be configured to determine which achievements have and have not been obtained based upon the state information received from the state manager 1108. In another embodiment, the state manager 1108 send each time a record is checked out and then subsequently updated a list of achievements that are available with the BGWP state. The game 1101 may compare a generated game outcome to this achievement list each time it generates a game outcome.

Via the various update context message 1128*a*, 1128*b*, 1128*c*, 1128*d* and 1128*e*, the state manager may update its record associated with the BGWP state. The gaming machine and in particular the game 1101 may receive an acknowledgement message from the state manager 1108 via the series of messages 1129*a*, 1129*b*, 1129*c*, 1129*d* and 1129*e*. In one embodiment, each time a BGWP state is update, the state manager 1108 may send the current BGWP state that is stored in the acknowledgement message. The game 1101 and may compare its current state with the state recorded by the BGWP. If the two states don't match, an error condition may be generated and sent to the state manager 1108. In some instances, the gaming machine may be placed in a tilt state.

In 9D, the game 1101 may detect an event and determine that the event is a trigger to end the BGWP state session. Examples of an event that may end a session include but are not limited to a detection of the credit meter reaching zero, a detection of a cash-out command, a period without gaming activity, a detection of an operator mode, an activation of an input device, such as a player activated input button, that indicates the session is to end, or a detection of a tilt condition on the gaming machine. In one embodiment, via messages 1130*a*, 1130*b*, 1130*c*, 1130*d* and 1130*e*, the game 1101 may send a message indicating the BGWP session is over. In one embodiment, a record of the last BGWP state may be sent with the message. The state manager 1108 may compare the BGWP state received from the gaming machine with its current record. An error condition may be generated when the records don't match. The state manager 1108 may keep a log for each BGWP state indicating when a record is checked out, when it was checked in, an identifier associated with a gaming device that checked the record in or out, when updates occurred and what was changed during any updates.

In 1171, after receiving the session end command, the state manager may mark the record checked-in, until the record is checked-in, it may remain locked and may be not be further updated. The state manager may send an acknowledgement message to the game 1101 via messages 1131*a*, 1131*b*, 1131*c*, 1131*d* and 1131*e*. In one embodiment, in response to receiving the acknowledgement message, the gaming machine may deallocate any non-volatile memory associated with maintaining the BGWP state. Further, the state manager may send a message to ID reader 1109 similar to a card-out message, via an IdReader agent not shown to clear the state of the ID reader. As described with respect to 9B, to continue the BGWP state, an ID associated with BGWP state may again have to be detected. For instance, the ticket voucher associated with the BGWP state may have to be reinserted into a bill acceptor.

In a particular embodiment, the end session BGWP session command may be delayed after detecting a triggering event. For example, after detecting a zero credit event, the end session command may be delayed to allow time for additional credits to be deposited into the gaming machine. If credits are deposited during the time period, then the end session command is not sent. In another embodiment, the gaming machine may include a proximity sensor that detects whether a person is standing in front of the gaming machine or not. If after detecting zero credits and an indication from the proximity sensor that no one is in front of the gaming machine, the end session command may be sent to the state manager 1108.

In one embodiment, BGWP state session may be ended when all of the achievements that are associated with the BGWP are obtained. The gaming machine in this instance may send a message to the state manger 1108 that an award condition has been met. In response, the state manager may record the award associated with the ticket and close out the record associated with the ticket. Further, the state manager may notify a pool manger, which may trigger the BGWP game to be closed out or an award associated with the BGWP game to be reset in some instances. When a game is closed out, all the records associated with the game may be expired as is described with respect to FIG. 9E.

In some embodiments, the state manager 1108 may reset or adjust achievements associated with various records after an award. For example, after all of the achievements in a BGWP are obtained, all of the other BGWP state records associated with the BGWP may be reset to a default or starting value. In other embodiments, depending on the achievements that have been obtained, the BGWP state may be reset but not all the way to a starting state, i.e., a BGWP state with many achievements may lose some but not all of the achievements that have been obtained when an award has been triggered. If a BGWP state record is checked out when the reset process occurs as a result of an award triggered from another BGWP state, a message may be displayed on a BGWP interface to indicate any changes in the BGWP state status. This update process may occur for plurality of BGWP states that are currently checked out.

In another embodiment, a determination of an award through obtaining a set of achievements may be made by the state manager 1108. For example, each time the state manager 1108 receives an update of a BGWP state as shown in FIG. 9C, it may check to determine whether an award associated with a group of achievement is obtained, it may then initiate a process to close out the record and end the session, notify the gaming machine where the award occurred to present an award and stop game play. In some embodiments, the state manager 1108 may initiate a new enrollment process for a BGWP state at the gaming machine where the award has occurred. The enrollment process may result in the creation of a new record an issuance of a new ticket voucher as described with respect to FIG. 9A. If the BGWP is closed out as a result of the award, then this enrollment process may also be initiated at any gaming machines where an active BGWP session is occurring.

In response to an award occurring, the game 1101 may generate an award outcome presentation. In one embodiment, the logic for generated the award outcome presentation may be integrated into the game 1101. In another embodiment, the game 1101 may generate the award outcome presentation in conjunction with content downloaded from a remote device. The content may be downloaded using methods described with respect to at least FIGS. 1A-4F. A download of the content may be initiated by the gaming machine or the server when an award condition is initiated. In another embodiment, the award presentation for the BGWP may be decoupled from the game 1101. For instance, the BGWP award presentation may be handled by a media application executing as an ECI on the gaming machine. The media application may be downloaded from a remote source and instantiated when the award condition is detected or it may have been downloaded prior to detection of the award condition, such as when a BGWP session is initiated but only instantiated on the gaming machine when an award condition is detected.

In particular embodiments, the award condition may not be limited to when all of the achievements associated are obtained for a BGWP. Award conditions may also be defined for sub-groups of achievements. For example, if the biggest award for a BGWP results from obtaining 10 achievements, an award condition may be triggered when the first 3 achievements are obtained and when the second three achievements are obtained. An award may be one or more of credits redeemable for cash or additional game play, one more additional achievements in the BGWP, promotional credits redeemable for only additional game play, goods or services.

Figure 9E:
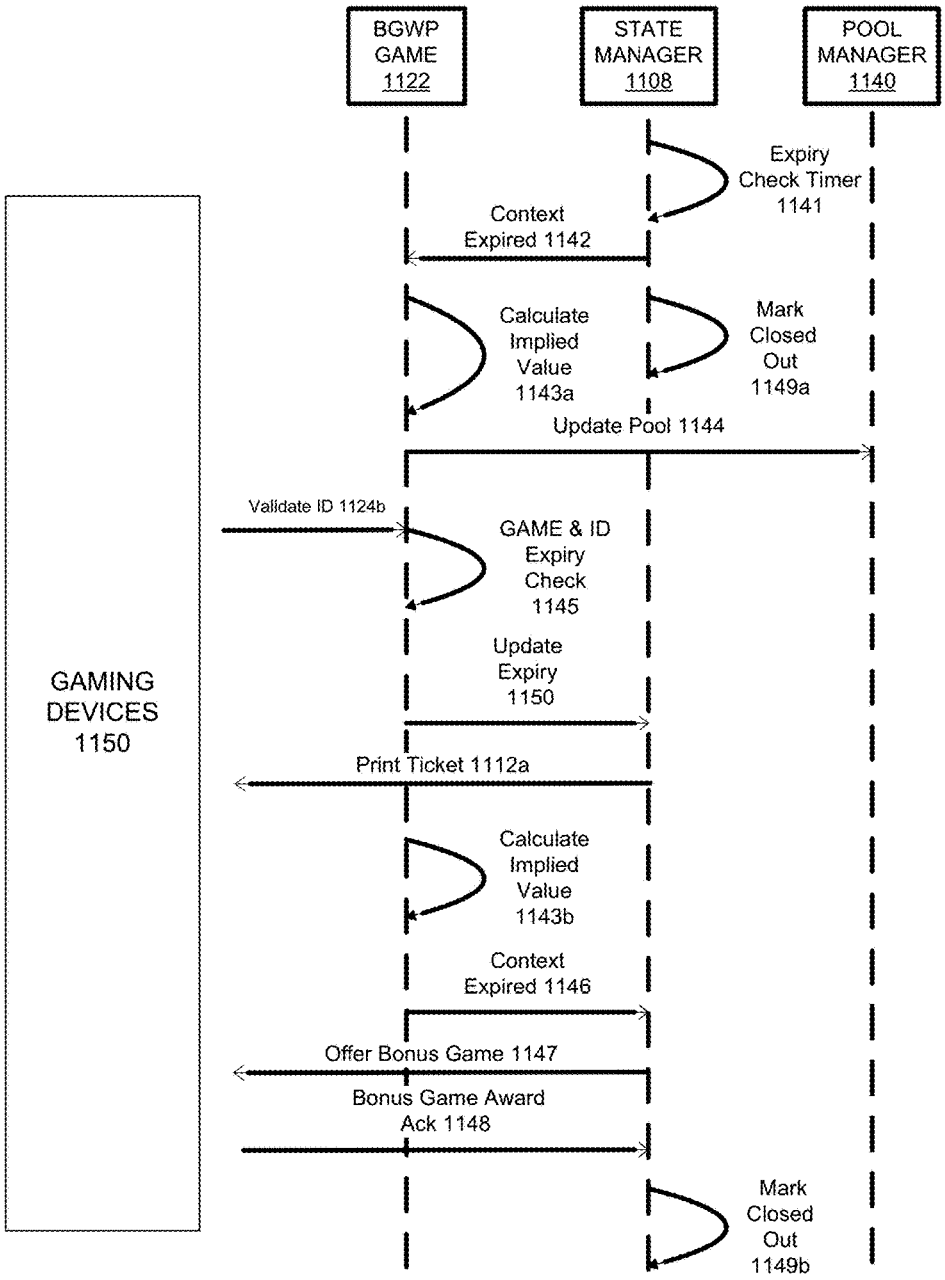

FIG. 9E is an interaction diagram associated with closing out records associated with a BGWP. In one embodiment, the state manager 1108 may check for records of states in the BGWP that have expired. The records may expire for various conditions including but not to the BGWP has ended, the record has not been accessed within a certain time period or record locator associated with the record has expired. In 1141, the records may be checked. When a record is determined to be expired, in one embodiment, the state manager 1108 may close out the record in 1149*a* and may notify the BGWP in 1142 that the context is expired. In this instance, the record may no longer be accessible using the record locator associated with the record. In response, the BGWP game may calculate an implied value for the ticket associated with the achievements that have been obtained in 1143*a*. This value calculation process may be required by regulators in some instances whenever a record is closed out. Until the record is closed out, it may be treated as an obligation or liability to the casino for accounting purposes.

The implied value may vary depending on the achievements associated with a particular BGWP. Details of this value calculation are described in the following section. In one embodiment, the implied value may be added to a bonus pool associated with another game, such as another BGWP pool.

In one embodiment, each time a validate ID message is received the BGWP 1122 or the state manager 1108 may check expirations associated with the record, such as in 1145, if the record or record locator is near some expiration threshold, such as the record locator is about to expire, a new expiration date may be determine in 1150. In response, the record and record locator may be updated with new expiration values. For example, a message to generate a new record locator or update an existing record locator with the new expiration date may be generated, such as a print ticket message 1112*a*.

In another embodiment, in response to checking one or more expiration times, an attempt to close out a record may be made by offering a bonus game to a player, in 1147. First a value associated with the record may be determined 1143*b*. An award for the bonus game may be based upon the value amount that is calculated. The gaming device may provide a bonus game where the outcome is always a win. When the state manager receives an acknowledgement that the bonus award has been credited on the gaming device 1150, then the record may be marked out closed out in 1149*b*. In some embodiments, after the award or during the award process, an enrollment for a new BGWP may be offered at the gaming device. The enrollment may be automatic or may depend on a detection of an input signal indicating an offer to enroll is accepted.

In yet another embodiment, rather an offering a bonus game with the award calculated in 1143*b*, the implied value may be compared to implied values associated with obtaining various achievements in a new BGWP. An offer may be made that allows their achievements in the current BGWP game to be converted to achievements in the new BGWP. A message may be generated that the BGWP is about to end and enrollment in the new BGWP is available where the achievements in the current BGWP are converted to achievements in the new BGWP. The message may indicate that if all the achievements in the new BGWP are not obtained by a particular time, then the value associated with the achievements may be rolled into a new bonus pool and the record may be closed out.

In a particular embodiment, an offer may be made that allows achievements to be combined to obtain one or more achievements in the new BGWP. For instance, a menu of selections may be presented, such as 'select 1 to convert achievements x, y and z obtained in the current BGWP to achievement a in the new BGWP' or 'select 2 to convert achievements x, y and z obtained in the current BGWP to achievements b, c and d in the new BGWP.' In conversion of achievements from one BGWP to another BGWP, all of implied value from the current BGWP may not be used during the conversion process. In some instance, all of the implied value may not be used because the implied values associated with the new BGWP don't exactly match up with the implied values of the current BGWP and thus, extra implied value will remain. This extra implied value may be rolled into a bonus pool as shown in 1144. It also may be desirable to allow only an offer of the selected percentage of the implied value to be converted while the remaining percentage is rolled into a bonus pool.

Figure 9F:
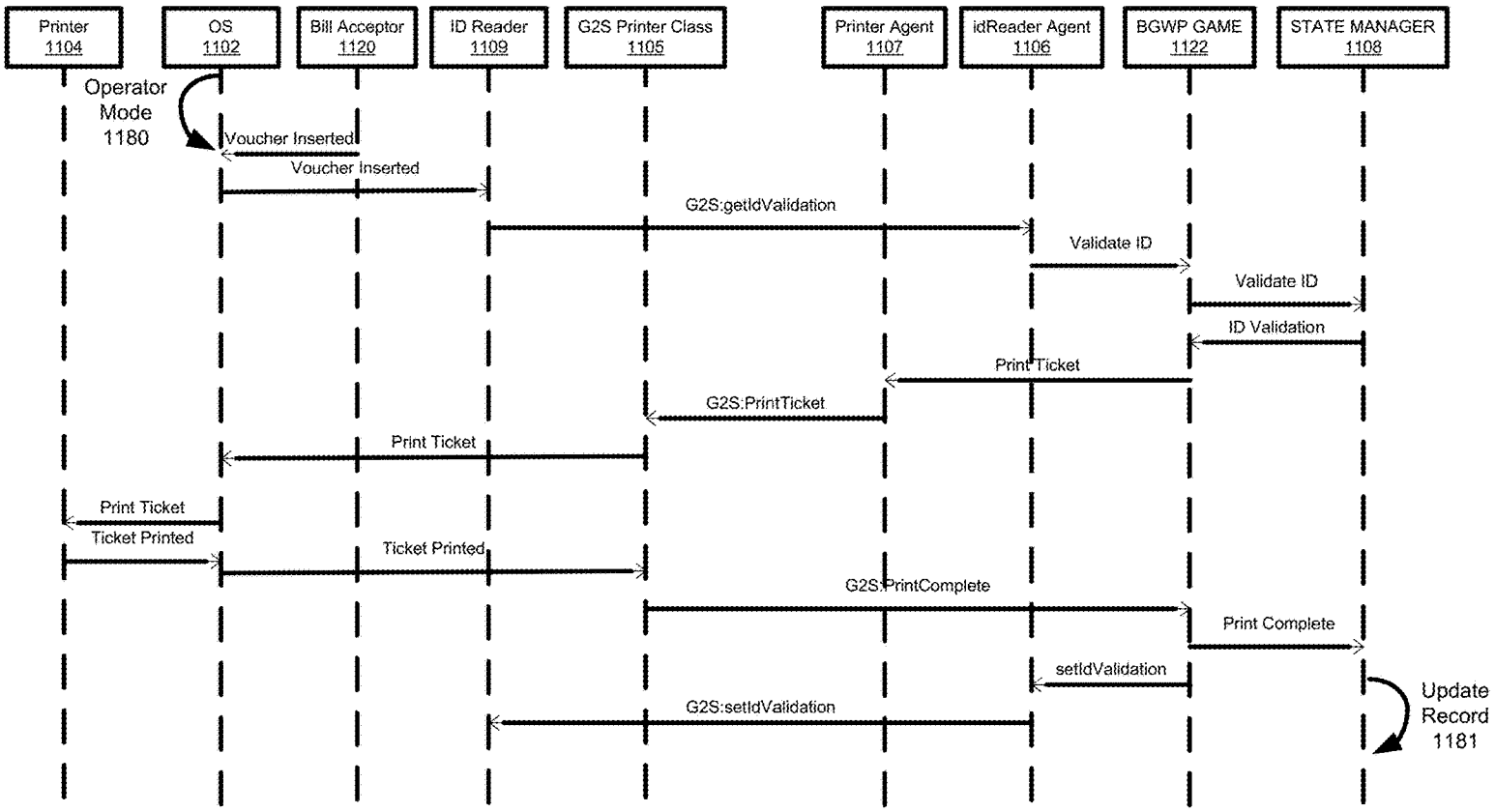

It may be possible from a gaming device, such as a gaming machine or an operator station, to trigger an issuance of new record locator, such as printed ticket voucher. For example, a request may be made for a new ticket when a current ticket is worn or damaged. An interaction diagram of this process for a generating a new ticket on a gaming machine is illustrated in FIG. 9F.

In 1180, the gaming machine may be placed in an operator mode. For instance, the gaming machine may detect an insertion of an operator key or an insertion of an operator card, lock game play and generate an operator menu. Then, a voucher may be inserted in the bill acceptor 1120, the OS may trigger a voucher inserted message that is passed to the state manager 1108 as is described with respect to FIG. 9B, to validate the current ID. In some embodiments, the record locator, such as the printed ticket may be too damaged to be read by the bill acceptor 1120, but may be readable by other means, such as via visual inspector, or with a bar-code scanner at an operator station. The interface generated at the gaming machine may provide an alternate method for entering record locator data, such as via a manual touch screen interface on the gaming machine. When the record locator is validate, a print ticket command may be triggered as is described with the respect to FIG. 9A. When the ticket is printed, the state manager may update record in 1181 and the new record locator may be used for initiating a BGWP session.

Calculation of Implied Value

Some wager-based games may be used in a long-term persistence game, in which they accumulate points, objects, symbols or resources toward the play of a bonus game. To allow the game to span a period longer than a single session of play, the player may print a ticket containing the current game state or another record locator may be used as described above. Further, the record locator itself may include the record, e.g., a smart card may be used to store a record. The ticket may contain the relevant information for storing or restoring the persistence game state.

To the casino, saved persistence game states may represent a liability. The value represented by the ticket (record in general) may be required to be saved for its eventual redemption. It may also represent an inconvenience to the player, if the player may have to return to a specific casino to complete a game to claim any stored value. If the player is only in the casino for a short visit, he may not be able to return in a reasonable amount of time. It may be advantageous to both the player and the casino to allow the player to redeem the value (or a partial value) of a partially completed game or game state or allow it to be rolled into another bonus pool. The player can collect some value from the ticket and the casino may clear the liability from their books. Even if the player decides not to redeem the ticket, or forgets to do so, the tickets may expire after a predetermined period. When a ticket expires, the casino may have to know the correct amount by which to reduce their liability, for accurate accounting, tax purposes, etc.

Typically, each play of the base game makes a contribution toward funding the persistence game. For example, 1% of every wager may be taken to fund the persistence game awards. At the time that a persistence game is designed, the average award may be computed. It may be typically equal to:

G=Average number of base games to be played to reach the persistence game

W=Average wager (or minimum required wager for persistence game eligibility)

C=Contribution percentage.

A=Average Persistence Award

A=G*W*C

The value of a saved persistence game state may be computed as:

G=Average number of base games left to be played to reach the persistence game (note difference from the previous paragraph).

W=Average wager (or minimum required wager for persistence game eligibility)

C=Contribution percentage.

A=Average Persistence Award

S=Saved state value

S=A−G*W*C

The average number of games to be played may vary depending on the style of the persistence game. Several variations are described below.

Collecting N Identical Items:

A persistence game in which the player may collect a number, N, of identical items (in description above, these items are referred to as achievements). For example, the player must collect N points, N occurrences of a scatter symbol, N wins or losses, N outcomes paying X or more, etc. The number of games required to collect N items may be:

I=Average number of items awarded per game.

N=Number of items to be collected.

Number of Games=N/I

Collecting N Different Items, in any Order, where Items are Drawn without Replacement:

A persistence game in which the player must collect N different items (e.g. 3 properties of the same color in monopoly). When the player receives an item, it may be drawn randomly out of all items which the player has yet to collect.

I=Average number of items awarded per game.

N=Number of items to be collected.

Number of Games=N/I

Collecting N Different Items, in Order, where Items are Drawn without Replacement:

When the player receives an item, it may be drawn randomly out of all items which the player has yet to collect. The players may need a specific next item and if the item drawn is not that specific item, the persistence game's state may not advance.

I=Average number of items awarded per game.

N=Number of items to be collected.

$$\text{Number of Games} = 1/I\sum_{j=1}^{j=N} j = N*(N+1)/(2*I)$$

Collecting N Different Items, in any Order, where Items are Drawn with Replacement:

When the player receives an item, it may be drawn randomly out of all possible items, without regard to the items the player has already collected ("drawing with replacement" means that items drawn out of the pool are put back into the pool for the next draw.). If the player already has that item, the persistence game's state may not advance. The number of games required to collect N items is:

I=Average number of items awarded per game.

N=Number of items to be collected.

$$\text{Number of Games} = N/I\sum_{j=1}^{j=N} (1/j)$$

Collecting N Different Items, in Order, where Items are Drawn with Replacement:

When the player receives an item, it is drawn randomly out of all possible items, without regard to the items the player has already collected. If the item drawn is not the item the player needs, the persistence game's state may not advance, I=Average number of items awarded per game N=Number of items to be collected.

Number of Games=N*N/I

Of course, many other variations exist. For example, each item may have a unique probability of occurring, one item may substitute for one or more other items, etc., and the present invention is not limited to the examples provided above.

Communication Protocol: Example #1

As describe above, a communication protocol may be implemented between a gaming device, such as a gaming machine, and a server. For example, the BGWP game 1122 and the BGWP 1103 may handle these communications as shown in FIG. 9B. Some examples of messages that may be part of the communication protocol are described in this section and the following section. These messages may be utilized in the communications described with respect to FIGS. 8 and 9A-9F.

In one embodiment, TCP may be used as the communications transport in a server-client relationship. The EGM (Electronic Gaming machine) may connect to the BWP server using a configured IP Address or host name and port. The EGM may attempt to attach to the BGWP server as soon as its configuration requires BGWP communications, for instance, when the EGM powers up or has its configuration changed to enable the BGWP state protocol. If the connection fails, the EGM may periodically retry until the connection is established. If the socket is closed for any reason after having been established, and the configuration still require BGWP related communication, the EGM may begin attempting to connect to the BGWP server.

Errors may be divided into two categories, connection errors and application errors. If there are connection errors, such as the connection is closed or the message header cannot be parsed, the socket may be closed immediately. Errors may be appropriately logged. The EGM may use its normal connecting logic to recover communications after an error. If there are application errors, such as message response timeouts or responses not matching requests, the connection may not need to be closed. Error of this type may be appropriately logged.

The EGM and BWGP server may be configured with a reasonable time to wait for responses to commands. If a response is not received in the configured time, this condition may be considered an application error and handled as such. The game (e.g., 1101) may send a game heartbeat if no message has been sent in the last 5 seconds. The BGWP server may consider it an application error if no message is received from an EGM for 15 seconds.

An application ID may be sent from a gaming device to the BGWP server. The application ID may contain enough information to uniquely identify the application that uses the data. It may be possible for a single application ID to be used independently with multiple applications that are able to share a particular BGWP state.

In particular embodiments, the BGWP server may own the BGWP state. An EGM may have to be in a BGWP state session in order to update the BGWP state owned by the BGWP server. A BGWP state session may be entered when an EGM receives a Start BGWP State Session ACK command or checkout context ACK command. The BGWP state session (can also be referred to as a player state session) may be generally ended by the EGM sending an End BGWP State Session command (see FIG. 9D). A BGWP state session may also be ended if there is a connection error or application error. If a message is received that is not appropriate in the current state, then the BGWP state session may also be ended. Examples of this are unexpected replies, such as an EGM sending a start BGWP state session command while it is in a player states session.

Many messages may have a status fields. A status of zero may indicate success. Any value other than zero may indicate a failure.

TABLE 1

| Example Status Values | |
|---|---|
| Status Value | Meaning |
| 0 | Success |
| 1 | Failure |
| 2 | Record Not Found |
| 3 | Record Already Exists |
| 4 | Record Already Locked |
| 5 | Record Not Locked |
| 6 | Resource Busy |

The following table organizes the commands contained within an embodiment of the BGWP State Protocol into request-response pairs:

TABLE 2

| Request Response PAIRS | |
|---|---|
| Request | Response |
| Connect | Connect ACK |
| Create BGWP ID | Create BGWP ID ACK |
| Update BGWP State | Update BGWP State ACK |
| Start BGWP State Session | Start BGWP State Session ACK |
| End BGWP State Session | End BGWP State Session ACK |
| Reprint Ticket | Reprint Ticket ACK |
| Game Heartbeat | Game Heartbeat ACK |
| BGWP ID Presented | Player ID Presented ACK |

Messages may begin with the following fields. Additional fields may follow the header. Any required additional fields are documented with the specific command. Bytes beyond the last field may be ignored.

TABLE 3

| Message Header | | |
|---|---|---|
| Field | Type | Length in Bytes |
| Length of the entire message | Unsigned binary integer. Most significant byte first. | 4 |
| Command | Unsigned binary integer. Most significant byte first. | 4 |

Connect—Command 1

This command may be sent by the EGM to establish communication with BGWP server.

TABLE 4

| Connect - Command 1 | | |
|---|---|---|
| Field | Type | Length in Bytes |
| EGM ID Length | Unsigned binary integer. Most significant byte first. | 4 |
| EGM ID | String | EGM ID Length |

Connect ACK—Command 2

This command may be sent by the BGWP in response to a Connect command. It also may establish the maximum number of seconds between Update BGWP State commands to keep a BGWP session active.

TABLE 5

| Connect ACK - Command 2 | | |
|---|---|---|
| Field | Type | Length in Bytes |
| Status | Unsigned binary integer. Most significant byte first. | 4 |
| Session End Timer Seconds | Unsigned binary integer. Most significant byte first. | 4 |

Create BGWP ID—Command 3

This command may be sent by the EGM to create a BGWP ID. This command may have no data.

Create BGWP ID ACK—Command 4

This command may be sent by the BGWP in response to a Create BGWP ID command.

TABLE 6

| Create BGWP ID ACK - Command 4 | | |
|---|---|---|
| Field | Type | Length in Bytes |
| Status | Unsigned binary integer. Most significant byte first. | 4 |

Update BGWP State—Command 5

This command may be sent by the EGM to update the BGWP state.

TABLE 7

| Update Player State - Command 5 | | |
|---|---|---|
| Field | Type | Length in Bytes |
| Application ID | Unsigned binary integer. Most significant byte first. | 4 |
| ID Reader Type Length | Unsigned binary integer. Most significant byte first. | 4 |
| ID Reader Type | String | ID Reader Type Length |
| BGWP ID Length | Unsigned binary integer. Most significant byte first. | 4 |
| BGWP ID | String | BGWP ID Length |
| BGWP State Length | Unsigned binary integer. Most significant byte first. | 4 |
| BGWP State | Binary | BGWP State Length |

Update BGWP State ACK—Command 6

This command may be sent by the BGWP server in response to an Update BGWP State command. If the Status field has a value other than 0, then the BGWP state session may be ended by the EGM. The BGWP server may not need to be notified that the BGWP session state has ended.

TABLE 8

| Update BGWP State ACK - Command 6 | | |
|---|---|---|
| Field | Type | Length in Bytes |
| Status | Unsigned binary integer. Most significant byte first. | 4 |

Start BGWP State Session—Command 7

This command may be sent by the EGM to start a BGWP state session. The session may not actually start until the Start BGWP State Session ACK command is received.

TABLE 9

| Start BGWP State Session - Command 7 | | |
|---|---|---|
| Field | Type | Length in Bytes |
| Application ID | Unsigned binary integer. Most significant byte first. | 4 |
| ID Reader Type Length | Unsigned binary integer. Most significant byte first. | 4 |
| ID Reader Type | String | ID Reader Type Length |
| BGWP ID Length | Unsigned binary integer. Most significant byte first. | 4 |
| BGWP ID | String | BGWP ID Length |

Start BGWP State Session ACK—Command 8

This command may be sent by the BGWP server in response to a Start BGWP State Session command. If the BGWP server cannot start the BGWP state session, the Status field may be set to a non-zero value. If the BGWP server does not have a BGWP State for the given Application ID and BGWP ID, it may create a zero length BGWP State and the EGM may create a new BGWP Context.

If the BGWP state session is not started, there may be no need for the EGM to send an End BGWP State Session command.

TABLE 10

| Start BGWP State Session ACK - Command 8 | | |
|---|---|---|
| Field | Type | Length in Bytes |
| Status | Unsigned binary integer. Most significant byte first. | 4 |
| Application ID | Unsigned binary integer. Most significant byte first. | 4 |
| ID Reader Type Length | Unsigned binary integer. Most significant byte first. | 4 |
| ID Reader Type | String | ID Reader Type Length |
| BGWP ID Length | Unsigned binary integer. Most significant byte first. | 4 |
| BGWP ID | String | BGWP ID Length |
| BGWP State Length | Unsigned binary integer. Most significant byte first. | 4 |
| BGWP State | Binary | BGWP State Length |

End BGWP State Session—Command 9

This command may be sent by the EGM to end a BGWP state session. This command may not need to be sent if the BGWP state session has ended because the connection to the BGWP server has been lost.

TABLE 11

| End BGWP State Session - Command 9 | | |
|---|---|---|
| Field | Type | Length in Bytes |
| Application ID | Unsigned binary integer. Most significant byte first. | 4 |

TABLE 11-continued

| End BGWP State Session - Command 9 | | |
|---|---|---|
| Field | Type | Length in Bytes |
| ID Reader Type Length | Unsigned binary integer. Most significant byte first. | 4 |
| ID Reader Type | String | ID Reader Type Length |
| BGWP ID Length | Unsigned binary integer. Most significant byte first. | 4 |
| BGWP ID | String | BGWP ID Length |

End BGWP State Session—ACK Command 10

This command may be sent by the BGWP server in response to an End BGWP State Session command.

TABLE 12

| End BGWP State Session ACK - Command 10 | | |
|---|---|---|
| Field | Type | Length in Bytes |
| Success | T for True<br>F for False | 1 |

Reprint Ticket—Command 11

This command may be sent by the EGM to request a ticket to be reprinted.

TABLE 13

| Reprint Ticket - Command 11 | | |
|---|---|---|
| Field | Type | Length in Bytes |
| BGWP ID Length | Unsigned binary integer. Most significant byte first. | 4 |
| BGWP ID | String | BGWP ID Length |

Reprint Ticket ACK—Command 12

This command may be sent by the BGWP server in response to a Reprint Ticket command.

TABLE 14

| Reprint Ticket ACK - Command 12 | | |
|---|---|---|
| Field | Type | Length in Bytes |
| Success | T for True<br>F for False | 1 |

BGWP ID Presented—Command 13

This command may be sent by the BGWP server to inform the EGM that a new BGWP ID has been presented to the EGM.

TABLE 15

| BGWP ID Presented - Command 13 | | |
|---|---|---|
| Field | Type | Length in Bytes |
| BGWP ID Length | Unsigned binary integer. Most significant byte first. | 4 |
| BGWP ID | String | BGWP ID Length |

BGWP ID Presented ACK—Command 14

This command may be sent by the EGM in response to a BGWP ID Presented command.

TABLE 16

| BGWP ID Presented ACK - Command 14 | | |
|---|---|---|
| Field | Type | Length in Bytes |
| Success | T for True<br>F for False | 1 |

Game Heartbeat—Command 15

This command may be sent by the game to ensure that the game is still active. It may be sent after 5 seconds without any message being sent. This command may have no data.

Game Heartbeat ACK—Command 16

This command may be sent by the BGWP server in response to the Game Heartbeat command. This command may have no data.

Communication Protocol: Example #2

The IGT BGWPContext class may be a single device class used by EGMs to create, check out, and update the BGWP state that may be centrally stored on a host system. This data may be in addition to traditional player tracking data, such as point balances, and may be decoupled to the player tracking host. The information itself may be represented in a generic nature, thereby allowing an EGM application to define persistent player data according to its own unique requirements.

Three operations that may occur between the EGM and a BGWPContext host:

BGWP context creation

Checking-in/Checking-out BGWP context data

Updating the BGWP context data

In a particular embodiment, the host may own the persistence of a BGWPContext and the EGM may be required to obtain a lock on the state for a specific record before updating the BGWOP state. This lock on a given BGWP-Context may be achieved through a check-out mechanism defined in this class. Once the EGM determines that it no longer needs permission to update the BGWPContext, such as after a patron removes their card, then the EGM may release its check-out of the BGWPContext.

To checkout a BGWP context, the EGM may sends to the host a checkoutBGWPContext message. The state of the checked out BGWPContext may be represented by the BGWPState attribute in the corresponding log entry.

The BGWPContext device can be related to one, or all idReader devices. This one-to-many relationship may allow the BGWPContext device to request a given BGWPContext associated with an idNumber that could have been sourced from more than the traditional idReader (e.g., a card reader). This relationship prevents an EGM from being limited to checking out a player's context only for IDs that are inserted into one physical device on the EGM. For example, an EGM may be able to request a BGWPContext from an ID that represents a traditional player card. Alternatively, the same BGWPContext device may request a BGWPContext associated with an ID that inserted into a note acceptor. Either a specific associated idReader may be identified in the BGWPContextProfile command, or all idReader devices may be identified by setting this attribute to −1, which represents all idReader devices on the EGM.

The BGWPcontext class may provide the facility for an EGM to create a given BGWPcontext. This mechanism may allow an EGM to effectively enroll a player into an application that requires a player to have a BGWPcontext. The creation of a BGWPcontext may not necessarily check out the newly created BGWPcontext. The BGWPcontext checkout request may also contain an identifier, called an applicationId, that allows an EGM to provide some context to the host in order to ensure checkout of a context appropriate for that player, and the application the EGM may need at that moment in time.

The BGWPcontext device may provide two facilities to detect loss of application-level communication with the host: an application-level heartbeat, and detection of no responses from the host. Whenever the BGWPcontext device is enabled, it may expect to receive messages from the host periodically. If the EGM doesn't receive a message from the host within the interval specified in the BGWP-contextProfile.noMessageTimer attribute, then the EGM may disable the BGWPcontext device and disable all devices (egmEnabled=false) that are in the BGWPcontext-Profile.relatedDeviceList.

The IGT_PCE111 Player Context Host Communications Lost event may be generated by the EGM whenever no messages are received from the BGWPcontext host within the noMessageTimer value. The IGT_PCE112 BGWP Context Host Communications Restored event may be generated by the EGM whenever: BGWPcontext communications with the host were previously lost, and the EGM receives any message from the BGWPcontext host Additionally, if the EGM had existing checkouts of BGWPcontexts, then the BGWPcontext host may undo those checkouts and allow other EGMs to checkout those BGWPcontexts. The host may then respond to update or checkout commands from the EGM with the original BGWPcontext checkout with error code IGT_PCX007 BGWP context not checked out. If the host determines the EGM has gone offline while a given BGWPcontext is checked out, then a manual reconciliation may need to occur in order to release that BGWP context. This manual reconciliation may be performed by an operator.

The following tables organize the commands contained within the BGWPcontext class into request-response pairs. The command originators are shown for illustrative purposes only and in other embodiments some of the commands may be initiated by the host as opposed to the EGM and vice-versa. The owner and guest attributes refer to whether another logical entity other than the host may implement a command. For instance, in this embodiment, another application may utilize a BGWPContextStatus to obtain a status of achievements in a BGWP game associated with a particular record which may be utilized by the application.

TABLE 17

| Commands Originated By EGM | |
|---|---|
| Request | Response |
| createBGWPcontext | createBGWPcontextStatus |
| checkoutBGWPcontext | checkoutBGWPcontextAck |
| updateBGWPcontext | updateBGWPcontextAck |
| checkinBGWPcontext | checkinBGWPcontextAck |
| reprintBGWPTicket | reprintBGWPTicketAck |

TABLE 18

| Commands Originated By Host | | | |
|---|---|---|---|
| Request | Response | Owner | Guest |
| getBGWPcontextStatus | BGWPcontextStatus | Yes | Yes |
| setBGWPcontextState | BGWPcontextStatus | Yes | No |
| BGWPcontextHeartbeat | BGWPcontextStatus | Yes | No |
| createBGWPcontextStatus | createBGWPcontextStatus Ack | Yes | No |
| getBGWPcontextProfile | BGWPcontextProfile | Yes | Yes |
| getBGWPcontextLogStatus | BGWPcontextLogStatus | Yes | Yes |
| getBGWPcontextLog | BGWPcontextLogList | Yes | Yes |

setBGWPcontextState Command

This command may be used by a host to enable or disable the BGWPcontext device for an EGM. In one embodiment, only the owner of the device may execute this command. A BGWPcontextStatus command may be sent in response to a setBGWPcontextState command.

TABLE 19

| setBGWPcontextState Attributes | | |
|---|---|---|
| Attribute | Example Definition | Description |
| enable | type: boolean<br>use: optional<br>default: true | May indicate whether the BGWPcontext device is to be enabled |
| disableText | type: textMessage<br>use: optional<br>default: <empty> | Optional message to display while the device is disabled. |

getBGWPcontextStatus Command

This command may used by a host to request the current status information for the BGWPcontext device from the EGM. The BGWPcontextStatus command may be sent in response to the getBGWPcontextStatus command.

BGWPcontextStatus Command

This command may be used by the EGM to send the current status of the BGWPcontext device to a host. The BGWPcontextStatus command may be sent in response to the setBGWPcontextState and getBGWPcontextStatus commands.

TABLE 20

| BGWPcontextStatus Attributes | | |
|---|---|---|
| Attribute | Example Definition | Description |
| configurationId | type: configurationId<br>use: optional<br>default: 0 | Configuration identifier that may be set by the host. |
| egmEnabled | type: boolean<br>use: optional<br>default: true | May indicate whether the device has been enabled by the EGM. |
| hostEnabled | type: boolean<br>use: optional<br>default: true | May indicate whether the device has been enabled by the host. |

getBGWPcontextProfile Command

This command may be used by a host to request the current profile of the BGWPcontext device from the EGM. A BGWPcontextProfile command may be sent in response to the getBGWPcontextProfile command.

BGWPcontextProfile Command

The command may be used by an EGM to report the current profile of the BGWPcontext device. The profile may contain the protocol-related configuration option selections for the BGWPcontext device. The configuration options can be set locally at the EGM or may be set remotely via a configuration server using commands within the optionConfig class. The BGWPcontextProfile command may be sent in response to a getBGWPcontextProfile command.

TABLE 21

| BGWPcontextProfile Attributes | | |
|---|---|---|
| Attribute | Example Definition | Description |
| configurationId | type: configurationId<br>use: optional<br>default: 0 | May be the last configuration identifier set by the G2s host; set to 0 (zero) when configuration changes are made by hosts other than G2S hosts. |
| restartStatus | type: boolean<br>use: optional<br>default: true | Status of hostEnabled at restart. |
| requiredForPlay | type: boolean<br>use: optional<br>default: false | May indicates whether the EGM is to be disabled if either egmEnabled or hostEnabled is set to false. |
| useDefaultConfig | type: boolean<br>use: optional<br>default: false | May indicate whether the default configuration for the device is to be used when the EGM restarts. |
| minLogEntries | type: int<br>use: required | May indicate the minimum number of log entries the EGM is to maintain in persistent memory (e.g. NV-RAM). |
| noMessageTimer | type: milliseconds<br>use: optional<br>default: 30000 | The time the BGWPcontext device may wait for a BGWPcontextHeartbeat command before considering the host to be offline. |
| idReaderId | type: deviceId<br>use: optional<br>default: −1 | May represent the related idReader device. A value of −1 represents a wildcard, and allows the BGWPcontext device to support IDs from any idReader devices supported by the EGM. |
| inactiveIdCheckin | type: Boolean<br>use: optional<br>default: true | May denotes whether the BGWP context object is to be checked in by the EGM whenever the related idReader device determines the ID has been abandoned. |

TABLE 22

| BGWPcontextProfile Elements | | |
|---|---|---|
| Element | Example Definition | Description |
| relatedDeviceList | minOcc: 1<br>maxOcc: 1 | May be a list of related devices that may need to be disabled if the host is determined to be offline. |

TABLE 23

| relatedDeviceList Elements | | |
|---|---|---|
| Element | Example Definition | Description |
| relatedDevice | minOcc: 0<br>maxOcc: □ | May represent a device that is required to be disabled if the BGWPcontext host is determined to be offline. |

TABLE 24

| relatedDevice Attributes | | |
|---|---|---|
| Attribute | Example Definition | Description |
| deviceClass | type: deviceClass<br>use: required | The class of the device that is required to be disabled when the BGWPcontext host goes offline. |
| deviceId | type: deviceId<br>use: required | The deviceId of the device that is required be disabled if the BGWPcontext host is determined to be offline. |

BGWPcontextHeartbeat Command

The BGWPcontextHeartbeat command may be sent by the host to the EGM as an application-level heartbeat. The EGM may determine the host to be offline if it hasn't received a BGWPcontextHeartbeat within the period defined by the noMessageTimer attribute in the BGWPcontextProfile, and may disable the BGWPcontext device. Additionally, whenever the BGWPcontext device is disabled, all of the related devices in the relatedDeviceList element in the BGWPcontextProfile command may be disabled by the EGM (relatedDeviceStatus egmEnabled=false). The BGWPcontextHeartbeatAck command may be sent in response to the BGWPcontextHeartbeat command.

createBGWPcontext Command

The createBGWPcontext command may provide an EGM a method to inform the host to create a new BGWPcontext stored on the server. The EGM may provide an application level identifier, that may be used by the host to identify which application (game, or otherwise) will own that specific BGWPcontext. The createBGWPcontextStatus command may be sent by the host in response. If the host does not support a given applicationId, then error code IGT_PCX001 Unknown application identifier may be sent in response.

TABLE 25

| createBGWPcontext Attributes | | |
|---|---|---|
| Attribute | Example Definition | Description |
| transactionId | type: transactionId<br>use: required<br>minIncl: 1 | May be a transactional identifier set by the EGM. |
| applicationId | type: applicationId<br>use: required | May be an application identifier that informs the BGWPcontext host that the EGM wishes to checkout a BGWP context related to a specific application. The use of this value may be application specific, and therefore may be set by the implementer. |

createBGWPcontextStatus Command

The createBGWPcontextStatus command may be sent by the host in response to a createBGWPcontext command, and may also be generated by the host whenever the status of the BGWPcontext creation has completed. The BGWPcontext creation process may be designated as completed when:

The BGWPcontext was successfully created

The BGWPcontext creation process resulted in an error condition

When the createBGWPcontextStatus command is generated by the host, the EGM may respond with a createBGWPcontextStatusAck command.

TABLE 26

| BGWPcontextStatus Attributes | | |
|---|---|---|
| Attribute | Example Definition | Description |
| transactionId | type: transactionId<br>use: required<br>minIncl: 1 | May be a transactional identifier set by the EGM. |
| BGWPcontextId | type: transactionId<br>use: required | May be an identifier set by the host, which identifies the lock the EGM has on a given BGWP session |
| BGWPcontextStatus | type: BGWPcontextStatuses<br>use: optional<br>default: IGT_pendingAck | Denotes the status of this BGWPcontext transaction. The value of this attribute may depends upon the state the transaction is in. |

createBGWPcontextStatusAck Command

The createBGWPcontextStatusAck may be generated by the EGM in response to a host-initiated createBGWPcontextStatus command that informs the EGM of an update to the status of the BGWPcontext creation.

TABLE 27

| createBGWPcontextStatusAck Attributes | | |
|---|---|---|
| Attribute | Example Definition | Description |
| transactionId | type: transactionId<br>use: required<br>minIncl: 1 | May be a transactional identifier set by the EGM. |
| BGWPcontextId | type: transactionId<br>use: required | May be an identifier set by the host, which identifies the BGWPcontext transaction. |

checkoutBGWPcontext Command

The checkoutBGWPcontext command may provide a method for the EGM to checkout a particular BGWP context from the host. This method may be implemented to ensure that the BGWP context isn't checked out, or manipulated by other EGMs while the BGWP context data is checked out. A checkoutBGWPcontextAck command may returned by the host.

If the host receives an unknown application identifier, then it may be required to respond with error code IGT_PCX001 Unknown application identifier. If the host receives an unknown idNumber in the request, then it may be required to respond with error code IGT_PCX002 Invalid or Unknown idNumber. If the player context was already checked out, then the host may respond with error code IGT_PCX004 Player context already checked out.

In particular embodiments, scenarios may exist where a BGWPcontext may not exist for a given idNumber and applicationId pair, but the idNumber may be known by the BGWPcontext host. In this scenario, it may be useful to create a new BGWPcontext for the new application associated to the already known idNumber. This scenario may be supported by a BGWPcontext host through the automatic creation of a BGWPcontext as a result of the checkoutBGWPcontext command, and reporting a null dataset in the checkoutBGWPcontextAck command.

Optional BGWPcontextId Command

This command may contain an optional BGWPcontextId. This command may be used to continue an already running transaction that was started with the creation of a given BGWPcontext. This attribute may be set to 0 if the EGM is starting a new transaction by checking out a BGWPcontext, as may be required if a BGWP associated ID is presented at the EGM.

TABLE 28

| checkoutBGWPcontext Attributes | | |
|---|---|---|
| Attribute | Example Definition | Description |
| transactionId | type: transactionId<br>use: required | May be a data lock request transaction identifier assigned by the EGM. |
| BGWPcontextId | type: transactionId<br>use: optional<br>default: 0 | May be an identifier set by the host, which identifies the BGWPcontext transaction. This identifier may be used if the EGM has already started a BGWPcontext |
| idReaderType | type: idReaderTypes<br>use: required | May be the type of the idReader as reported by the idReader class. |
| idReaderId | type: deviceId<br>use: required | The deviceId of the ID reader that resulted in the EGM to checkout this BGWPcontext. |
| idNumber | type: idNumber<br>use: required | May be an identification number as reported by the idReader class. |
| idType | type: idTypes<br>use: required | May be the type of the ID that was inserted. If a player card was inserted, then idType may be set as G2S_player. If a ticket was inserted, then idType may be set as G2S_anonymous. |
| playerId | type: playerId<br>use: optional<br>default: <empty> | May be the host defined identifier for the idNumber/idReaderType pair as reported by the idReader class. |
| applicationId | type: applicationId<br>use: required | May be an application context that informs the BGWPcontext host that the EGM is attempting to checkout a BGWP context related to some identifier. The use of this value may be application specific, and therefore may be up to the implementer of the application. |

checkoutBGWPcontextAck Command

The checkoutBGWPcontextAck command may be sent by the host in response to the EGM requesting to obtain a lock on a given BGWP context object. In one embodiment, once a BGWPcontext session is created for a given BGWP context then the data associated with the record may not be updated by any other EGM or gaming device until the session is released. This command may support a generic representation of the BGWP state in order to support use by a wide variety of applications.

TABLE 29

| checkoutBGWPcontextAck Attributes | | |
|---|---|---|
| Attribute | Example Definition | Description |
| transactionId | type: transactionId<br>use: required | May be a player data lock request transaction identifier assigned bythe EGM. |
| BGWPcontextId | type: transactionId<br>use: required | May be an identifier set by the host, which identifies the lock the EGM has on a given BGWP session |

TABLE 30

| checkoutBGWPcontextAck Elements | | |
|---|---|---|
| Element | Example Definition | Description |
| BGWPcontextData | type: base64binary<br>minOcc: 1<br>maxOcc: 1 | May contain a base64 representation of the BGWP state. |

updateBGWPcontext Command

In one embodiment, updates may be implemented periodically and the updateBGWPcontext command may be used by the EGM to periodically update the BGWPcontext on the host. Periodic updates may minimize the deltas in context state that may exist between the EGM and the host, thereby minimizing the amount of lost data if EGM failure occurs.

The updateBGWPcontext command may also introduce an updateId, which may be a sequentially increasing identifier that is owned by the EGM and is incremented for each updateBGWPcontext command. The identifier may be employed to ensure that communications failures do not result in retries overwriting a more recent EGM context update.

The updateBGWPcontextAck command may be returned by the EGM in response to a host-originated updateBGWPcontext command. If the host receives an updateBGWPcontext command with invalid context checkout identifiers, then it may respond with error code IGT_PCX003 Invalid transactionId/BGWPcontextId. If any host logic determines that the data contained in the player context update is invalid, then error code IGT_PCX005 Invalid player context update may be returned to the EGM. If the player context is already checked in, then the host may respond with error code IGT_PCX007 Player context not checked out.

TABLE 31

| updateBGWPcontext Attributes | | |
|---|---|---|
| Attribute | Example Definition | Description |
| transactionId | type: transactionId<br>use: required | May be the transactionId set by the EGM when the BGWPcontext session was created. |
| BGWPcontextId | type: transactionId<br>use: required | May be the identifier set by the host, which identifies the checkout the EGM has on a given player session |
| updateId | type: updateId<br>use: required | May uniquely identifies a particular BGWPcontext update. |

TABLE 32

| updateBGWPcontext Elements | | |
|---|---|---|
| Element | Example Definition | Description |
| BGWPcontextData | type: base64binary<br>minOcc: 1<br>maxOcc: 1 | May contains a base64 representation of the BGWP state. |

updateBGWPcontextAck Command

The updateBGWPcontextAck command may be issued by the host in response to an updateBGWPcontextAck command. This command may be used by the host to confirm that the player's state has been updated in the host's persistent storage.

TABLE 33 updateBGWPcontextAck Attributes

| Attribute | Example Definition | Description |
|---|---|---|
| transactionId | type: transactionId use: required | May be the transactionId set by the EGM when the BGWPcontext session was created. |
| BGWPcontextId | type: transactionId use: required | May be the identifier set by the host, which identifies the lock the EGM has on a given player session |
| updateId | type: updateId use: required | May uniquely identify this particular BGWPcontext update. |

checkinBGWPcontext Command

The checkinBGWPcontext command may allow the EGM to release its lock on the BGWP context. Once this command is acknowledged by the server, then any other EGM may be able to check out and subsequently manipulate the BGWP context. The checkinBGWPcontextAck command may be sent by the host in response. If the EGM has already checked in the BGWP context, and therefore the BGWP context doesn't need to be checked in again, the host may respond with error code IGT_PCX007 Player context not checked out.

TABLE 34 checkinBGWPcontext Attributes

| Attribute | Example Definition | Description |
|---|---|---|
| transactionId | type: transactionId use: required | May be an identifier assigned by the EGM that represents the lock the EGM has obtained on a given BGWP context. |
| BGWPcontextId | type: transactionId use: required | May be an identifier set by the host, which identifies the lock the EGM has on a given BGWP context. |

checkinBGWPcontextAck Command

The checkinBGWPcontextAck command may be sent in response to the checkinBGWPcontext command. This command may allow the host to acknowledge that the EGM's checkout of the BGWP context has been removed.

TABLE 35 checkinBGWPcontextAck Attributes

| Attribute | Example Definition | Description |
|---|---|---|
| transactionId | type: transactionId use: required | May be an identifier assigned by the EGM that represents the lock the EGM has obtained on a given BGWP state. |
| BGWPcontextId | type: transactionId use: required | May be an identifier set by the host, which identifies the lock the EGM has on a given player session |

reprintPlayerTicket Command

This command may be used by the EGM to request the host to initiate a reprint of a ticket that is used as a record locator for the BGWP context. The ticket may or may not include information that allows it to be associated with a bearer of the ticket. Typical use for this command may be to reprint a ticket that cannot be read by the bill validator, possibly due to a damaged or poorly printed barcode. A reprintPlayerTicketAck may be sent in response to this command if the validationId is recognized by the host. If the validationId is not recognized by the host, the host may return error code IGT_PCX008 Unknown Validation ID. If the ticket is associated with other host-defined validation policies, such as effective date and/or expiration date, and the additional validation fails, the host may return error code IGT_PCX009 Reprint Denied, and optionally may provide additional details in the errorText attribute.

TABLE 36 reprintPlayerTicket Attributes

| Attribute | Example Definition | Description |
|---|---|---|
| validationId | type: validationId use: required | May be the validation number of the ticket to be reprinted. |

reprintPlayerTicketAck Command

This command may be sent by the host in response to a reprintPlayerTicket request from an EGM. The response may indicate that the validationId met the host's validation requirements and that a print request has been, or will be, initiated by the host. If the validationId is not known by the host, an IGT_PCX008 error code may be returned. If the ticket requested for reprint no longer meets any host-defined policies, an IGT_PCX009 Reprint Denied error code may be returned.

getBGWPcontextLogStatus Command

This command may be used by the host to request the current status of the BGWPcontext log from an EGM. The response may include the sequence number of the last transaction and the total number of transactions in the log. A BGWPcontextLogStatus may be sent in response to a getBGWPcontextLogStatus command.

BGWPcontextLogStatus Command

This command may be used by the EGM to send the current status of the BGWPcontext log to a host. The BGWPcontextLogStatus command may be sent in response to the getBGWPcontextLogStatus command.

TABLE 37

BGWPcontextLogStatus Attributes

| Attribute | Example Definition | Description |
|---|---|---|
| lastSequence | type: logSequence use: optional default: 0 minIncl: 0 | May be the sequence number of the most recent transaction within the log; 0 (zero) if no records. |
| totalEntries | type: int use: required default: 0 minIncl: 0 | May be the total number of transactions within the log. |

getBGWPcontextLog Command

This command may be used by the host to request the contents of a transaction log from an EGM. The BGWPcontextLogList command may be sent in response to the getBGWPcontextLog command.

TABLE 38

| getBGWPcontextLog Attributes | | |
|---|---|---|
| Attribute | Example Definition | Description |
| lastSequence | type: logSequence<br>use: optional<br>default: 0<br>minIncl: 0 | May be the sequence number of the transaction that should be the first entry in the list; if 0 (zero) then default to the last transaction. |
| totalEntries | type: int<br>use: optional<br>default: 0<br>minIncl: 0 | May be the total number of transactions that should be included in the list; if 0 (zero) then default to all transactions. |

BGWPcontextLogList Command

This command may be used by the EGM to send the contents of the BGWPcontext log to a host. The BGWPcontextLogList command may be sent in response to the getBGWPcontextLog command. Each log entry may represents checkout of a specific BGWP context, and the lastUpdateId and lastUpdateDateTime attributes may represent the last EGM update of the BGWP context to the host.

TABLE 39

| BGWPcontextLogList Elements | | |
|---|---|---|
| Element | Example Definition | Description |
| BGWPcontextLog | minOcc: 0<br>maxOcc: □ | May contain information about BGWPcontext transactions. |

TABLE 40

| BGWPcontextLog Attributes | | |
|---|---|---|
| Attribute | Example Definition | Description |
| logSequence | type: logSequence<br>use: required | May be a unique log sequence number assigned by the EGM |
| deviceId | type: deviceId<br>use: required | May be a device id for the BGWPcontext device |
| transactionId | type: transactionId<br>use: required | May be an identifier assigned by the EGM that represents the lock the EGM has obtained on a given player's state. |
| BGWPcontextId | type: transactionId<br>use: required | May be an identifier set by the host, which identifies the lock the EGM has on a given player session |
| idReaderType | type: idReaderTypes<br>use: optional<br>default: G2S_none | May be the type of the idReader as reported by the idReader class. |
| idReaderId | type: deviceId<br>use: optional<br>default: −1 | May be the deviceId of the ID reader that is causing the EGM to checkout this BGWPcontext. |
| idNumber | type: idNumber<br>use: optional<br>default: <empty> | May be an identification number as reported by the idReader class. |
| idType | type: idTypes<br>use: optional<br>default: G2S_none | May be the type of the id that was inserted. For example, ff a player card was inserted, then idType = G2S_player or if an anonymous ticket was inserted, then idType = G2S_anonymous. |
| playerId | type: playerId<br>use: optional<br>default: <empty> | May be the host defined identifier for the idNumber/idReaderType pair as reported by the idReader class. |
| applicationId | type: applicationId<br>use: required | May be an application context that informs the BGWPcontext host that the EGM is attempting to checkout a BGWP context related to some identifier. The use of this value may application specific, and therefore may be up to the implementer. |

TABLE 40-continued

| BGWPcontextLog Attributes | | |
|---|---|---|
| Attribute | Example Definition | Description |
| checkoutStartDateTime | type: dateTime<br>use: optional<br>default: <null> | May be the time the BGWP state was checked out by the EGM. |
| checkoutEndDateTime | type: dateTime<br>use: optional<br>default: <null> | May be the time the BGWP state was checked in by the EGM. |
| BGWPcontextStatus | type: BGWPcontextStatuses<br>use: optional<br>default: IGT_checkedOut | May denote the status of this BGWPcontext checkout. |
| BGWPcontextException | type: BGWPcontextExceptions<br>use: optional<br>default: 0 | May be an exception code indicating reason for an error condition when BGWPcontextStatus = IGT_error. |
| lastUpdateId | type: updateId<br>use: optional<br>default: 0 | May be the most recent updateId set by the EGM when it updated the checked out BGWPcontext. |
| lastUpdateDateTime | type: dateTime<br>use: optional<br>default: <null> | May be the dateTime associated with the most recent successful update. |

Externally-Controlled Interface Processes

In particular embodiments, the gaming devices on the gaming machine may be controlled by software executed by a master gaming controller 46 on the gaming machine in conjunction with software executed by a remote logic device (e.g., a remote host, a central server or a central controller) in communication with the gaming machine. The master gaming controller may execute externally-controlled interface (ECI) processes, described in more detail below, that enable content generated and managed on the remote host to be output on the gaming machine. The gaming machine may receive and send events to the remote host that may affect the content output by one or more ECI processes as well as enable an ECI process to be initiated on the gaming machine.

The master gaming controller may be configured to limit the resources that can be utilized by the ECI processes executing on the gaming machine. Specific resource limitations may be predetermined, negotiated with a host device controlling an ECI prior to the execution of the ECI on the gaming machine or combinations thereof. To enforce any established resource limitations, the master gaming controller may constantly monitor resources utilized by the ECI processes and other gaming processes executing on the gaming machine.

The ECI's may be executed while a gaming machine is operable to provide a play of wager-based game of chance (During operation, one or more games and one or more executed simultaneously, one or more games may be executed without execution of an ECI or one or more ECIs may be executed while a game is not being played). Therefore, the resources may be limited to ensure that a gaming experience on the gaming machine is optimal while access to gaming resources is granted to a remote host. The resources allocated to ECI's may be limited for many reasons, such as ensuring the game play experience is adequate or for security purposes, and the examples described herein, which are provided for illustrative purposes only. For instance, the CPU cycles provided to executing ECI processes may be limited to ensure a minimal graphically rendered frame rate is maintained on the gaming machine. As another example, the ECI processes may not be allowed to directly control or access certain devices, such as money handling devices, to prevent the ECI from allowing cash or an indicia of credit to be input or output from the gaming machine.

It should be appreciated that the gaming device resources utilized by the ECI processes include, but are not limited to: graphic resources of the gaming machine (i.e., what graphical real estate is available on the display device without interfering with the graphics of the primary game), audio resources of the gaming machine (i.e., what audio content may be provided by the gaming machine without interfering with the audio of the primary game), timing resources available (i.e., has the primary game ended or is the primary game beginning), and/or CPU processing resources of the gaming machine. In one embodiment, access to such resources may be based on a priority system configured to maximize an optimal gaming experience for each player.

In particular embodiments, the host-controlled ECI processes may be decoupled from the processes used to generate the game of chance played on the gaming machine such that the content output by the host-controlled ECI processes doesn't alter the play of game of chance. Thus, the logic for the game processes may be designed such that information regarding the state or content generated by the ECI processes is not needed to generate the game of chance and/or the game and related processes may not recognize any information produced by the ECI's. The ECI processes may be designed in a similar manner.

An advantage of ECI software and game software decoupled in this manner may be that content may be provided from a remote host that enhances the functionality and features available on the gaming machine. The content can be easily varied with little or no modification to the gaming software resident on the gaming machine. For instance, many features and services on a gaming machine can be provided using a generic ECI that enables access to a display and a touch screen on the gaming machine. Externally controlled interfaces, the interaction between a remote host and a gaming machine, embodiments of hardware and software architectures on a gaming machine related to ECI's are described with respect to the following figures.

Figure 1B:
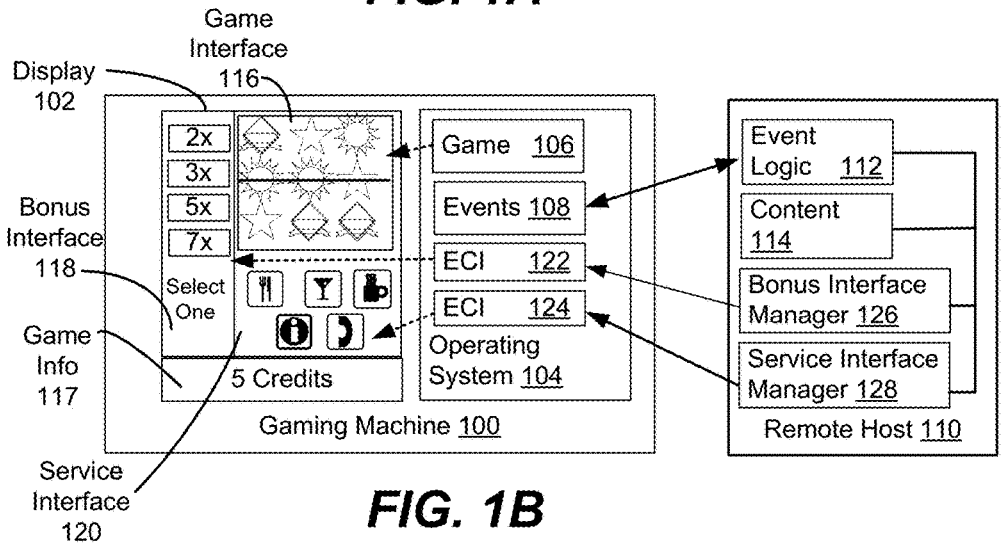
Figure 1C:
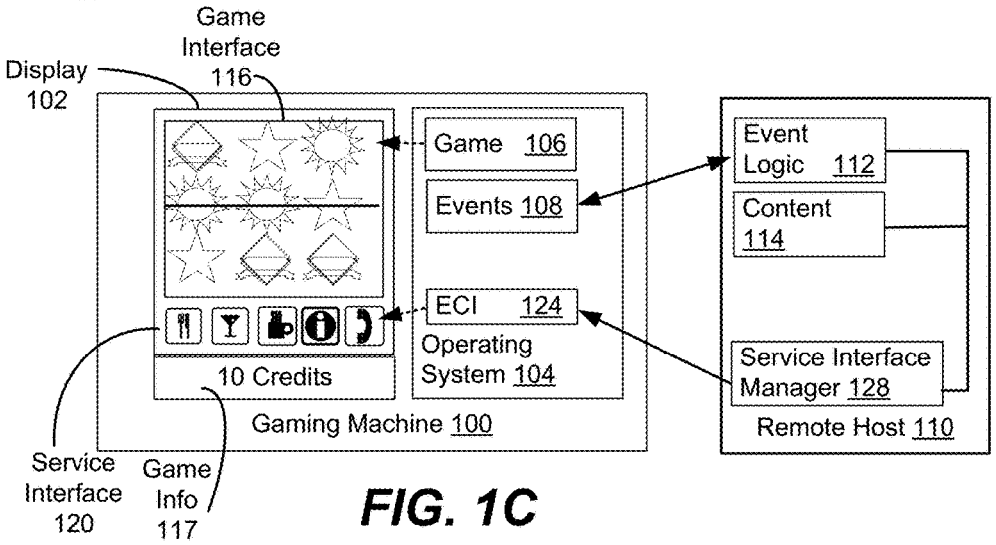

FIGS. 1A to 1C are block diagrams illustrating an interaction between a host and gaming machine for one embodiment of the present invention. In FIG. 1A, a block diagram of a gaming system comprising a gaming machine 100, a remote host 110 and a network that enables for communication between the gaming machine and the remote host 100 (not shown) is illustrated. The gaming system is provided for illustrative purposes only. Gaming systems comprising multiple gaming machines and multiple remote hosts are possible. Further, in some embodiments, the gaming machine 100 may perform functions of the remote host 100 or the remote host 110 may be a game server providing games that are output on other gaming devices or the remote host 110 may be a gaming machine similar to gaming machine 100. Further details of embodiments of gaming systems and gaming devices that may be used are described with respect to FIGS. 2-7.

The gaming machine 100 comprises a touch screen display 102 that may be a component of a game interface 116. The game interface 116 comprises the components on the gaming machine 100, such as input buttons (not shown), audio output devices (not shown), etc., that enable a game to be played on the gaming machine 100. An operating system 104 executes a number of processes including game logic 106 for providing a game on the game interface 116, event logic 108 and communication logic for communicating with the remote host 110 (not shown).

In FIG. 1A, the game interface 116 may be divided into two regions on the touch screen display 102. A first region includes symbols and paylines for a video slot game. A second region 117 includes game information including the number of credits available for wagering on the slot game. In the game state illustrated in the figure, five credits are available for wagering.

The remote host 110 comprises a processor, memory and a communication interface (each not shown). Content 114 that may be output on the gaming machine 100 and event logic 112 that enables the remote host 110 to respond to events and information received from the gaming machine and/or generate events to send to the gaming machine 100. Additional details of remote hosts are described with respect to U.S. patent application Ser. No. 11/595,774, previously incorporated herein.

In FIG. 1A, the event logic 108 detects an event message and sends an event message with information describing the event to the remote host 110. As is described with respect to FIG. 1B, the remote host 110 responds to the event by requesting the gaming machine to launch an externally controlled interface (ECI) that enables content 114 stored on the remote host 110 to be output on the gaming machine. A few examples of events occurring on the gaming machine 100 that may trigger an instantiation of an ECI to be launched on the gaming machine 100 include but are not limited to (1) a deposit of credits on the gaming machine, (2) a player tracking card inserted into a card reader, (3) information being read from a portable instrument carried by a player (e.g., a cell phone, RFID tag or other wireless device), (4) an actuation of button, such as a mechanical button or a touch screen button, (5) an event triggered from a play of the game 106, (6) a cash-out command detected on the gaming machine, (7) an input of a wager, (8) an initiation of the game 106, (9) a number of credits available on the gaming machine, (10) the result of one or more games, (11) the result of the generation of one or more symbols, (12) a designated win amount, (13) a player cashing out available credits, and (14) a player tracking card removed from a card reader. As is described in more detail with respect to U.S. patent application Ser. No. 11/595,774, previously incorporated herein, an event generated on the remote host may also trigger the launch of an ECI on the gaming machine.

The event sent from the gaming machine is evaluated by the event logic 112 on the remote host 110. In response to the receiving the event 110, the remote host 110 sends a message requesting access to resources on the gaming machine 100. In response, the gaming machine 100 may send a message to the remote 110 describing the resources it has available for external control and any usage limitations that are associated with the resources, such as a portion of the display 102 including its dimensions that may be utilized by the remote host.

The remote host 110 may use the resource information provided by the gaming machine 100 to determine what content to send to the gaming machine 100. For example, video content to be output on the portion of the display 102 allocated for use by the remote host may be generated and/or selected to be compatible with the size of the display window. The process of establishing a resource sharing arrangement between the remote host 110 and the gaming machine 100, which may involve a negotiation between the remote host 110 and gaming machine 100, are described in further detail with are described with respect to U.S. patent application Ser. No. 11/595,774, previously incorporated herein.

In FIG. 1B, a state of the gaming machine 100 and the remote host 110 is illustrated where the gaming machine 100 has launched two ECI's, 122 and 124, that enable the remote host 110 to output content for a bonus interface 118 and a service interface 120 on touch screen display 102. The bonus interface 118 may be just one example of an interface that may be provided. A multimedia player, such as a Flash Player™ by Adobe™ (Adobe Systems Incorporated, San Jose, Calif.), may be one example of software that may be used as an ECI, such as 122 and 124. The multimedia player may allow, as one of its features, multimedia content received from the remote host 110 to be displayed on the touch screen display 102 and/or output on other gaming devices, such as speakers coupled to the gaming machine.

The remote host may download the multimedia content as part of application files that are utilized by the ECI's, 122 and 124. The application files may include embedded content, data, scripts and other instructions for accessing the capabilities of the ECI to be utilized. For example, the Flash Player™ runs and/or parses flash files which may include Adobe Flash Action Script™ The flash files may include information relating to utilizing raster or vector graphics, a scripting language to control functions of the player and information for providing bidirectional streaming including audio and video information. In particular, an ECI may be operable to receive video and/or audio streaming of content from a remote host. The multimedia player and associated files, such as the Flash Player™ may be a component of a "Rich Internet Application," (RIA).

Rich Internet applications (RIA) are typically interface applications provided by a host to a client with downloadable components that have the features and the functionality of locally installed and executed programs. RIAs typically transfer the processing necessary for the interface generated by the application to the client but keep the bulk of the data (i.e., maintaining the state of the program, the data etc) back on the host. RIA's are not limited to web-based applications applied over the Internet and may be utilized in other network architectures. In an RIA involving a host device and a client device (e.g., remote host 110 may be considered a "host" and gaming machine 100 may be considered a "client" in particular embodiments), an application for generating an interface executed on the client may be operable to perform functions independently of the host, such as computations, send and retrieve data in the background, store data locally, redraw sections of the screen, and/or use audio and video in an integrated manner, etc.

The application for generating the interface may also share data with other applications locally executing. For example, two ECIs executing on gaming machine 100 may share data. The shared data may affect the content displayed on one or both ECIs. In particular embodiments, the ECIs may be prevented from directly sharing data with other processes executing on the gaming machine. For example, to share data with a non-ECI process, the ECI may have to send the information to the remote host first, which then may or may not perform additional processing on the data before communicating it back to the gaming machine.

Returning to FIG. 1B, after the ECI's, 122 and 124, have been launched by the operating system 104, the touch screen display 102 may be divided into four regions. The game interface 116 may be displayed in a first region, the bonus interface 118 may be displayed in a second region, the service interface 120 may be displayed in a third region and the game information 117 in a fourth region. The game interface 116 is configured to fit in a smaller region as compared to FIG. 1A, which may affect the graphical presentation of the game and may affect a mapping of touch screen buttons to the display 102 associated with the game interface 116.

In general, a master gaming controller in the gaming machine may be operable to provide content to display regions of different sizes. To provide content to display regions of different sizes, the gaming machine may perform one or more of the following, 1) select from among stored content, such as bitmaps, movies, animations, geometric models, etc., according to which content is more appropriate for a given display size, 2) rearrange a position of one or more components in a display window relative to one another, 3) scale content, 4) stretch content, 5) interpolate content, 6) generate new content, 7) adjust parameters of a 3-D graphical environment used to generate content and 8) combinations thereof.

In one embodiment, the wager-based games played on the gaming machine may be configured such that the manner in which a game is played or the manner in which an outcome is generated for the game may not be altered via any information from any instantiation of an ECI on the gaming machine 100. For example, in one embodiment, the bonus interface 118 may be used to provide a bonus multiplier for an award associated with an outcome of a game played on the gaming machine, such as a ten times bonus. In this example, the bonus multiplier doesn't affect how the game is played or how the outcome to the game is generated. But, the bonus multiplier does affect the award for the game, i.e., it is multiplied by a factor of ten.

In the example described in the preceding paragraph, the gaming program may include logic to generate a simple message that a bonus multiplier has been provided, such as a simple text message "You have won a bonus Multiplier." The bonus interface ECI 118 may be used to enhance and customize the presentation of the award of the bonus multiplier. For instance, in a particular embodiment, the bonus multiplier may be provided by a local casino and bonus interface ECI 118 may be used to display one or more of a casino logo, a custom message from the casino and a theme based presentation, such as a casino theme or a holiday theme as part of a presentation for the bonus multiplier award.

In many gaming jurisdictions, after a game is approved, the content of the game may not be altered. Thus, to customize a game for a particular casino or a particular gaming entity, customized content would have to be added to the game and then submitted to an associated gaming jurisdiction for approval at which point the content would be fixed (Gaming jurisdictions don't allow the gaming software to be altered in any way after it has been approved). The approval process is time consuming and expensive.

Prior to the approval process for a particular game, the gaming software provider for the particular game often doesn't know which casinos or other gaming entities are going to purchase the particular game. For instance, game purchasers often wait and see how the particular game is performing at other casinos before they choose to buy it. Thus, the desire for a customized version of the particular game generally arises after the content of the game has been fixed by the approval process. To provide desired customization after the approval process, the customized game would have to be resubmitted for approval, which is very expensive.

One advantage of using ECIs is that a presentation of a game may be enhanced using an ECI, such as by providing a presentation for a bonus multiplier, as described above, in conjunction with the presentation of the game. The content of the ECI may be customized and altered after the release of the game while the presentation provided by the game may not be altered after its release. The presentation provided via an ECI may be designed to look like a component of an associated game, e.g., it may use the same theme and may be displayed on the same screen, and thus, to the player may appear as another component of the presentation of the associated game even though as will be discussed further, the ECI may be a logical entity decoupled from the associated game. Thus, using an ECI, the appearance of game customization may be provided to a user without having to customize the actual game that is submitted for jurisdiction approval.

In yet another embodiment, the gaming device utilizes a plurality of display devices to display the game interface and one or more ECIs. For example, a first display device may display the game interface and a second display device may display each ECI communicated from the remote host. In one such embodiment, each display device may be controlled by one or more different processors such that each display device may generate and display information or data independently of (or alternatively dependent on) information or data displayed by the other display devices.

In another embodiment, the remote host may be in communication with each such processor to oversee (and possibly control) what may be displayed on one or more display devices of each gaming device in the gaming system. In this embodiment, the remote host may be either in direct communication with or indirect communication with (such as through a player tracking system) each gaming device in the gaming establishment. This configuration provides that even if the remote host is not directly in communication with a designated gaming device's CPU, the remote host may be still operable to communicate with and provide such designated gaming device (and all gaming devices in the gaming establishment) one or more ECIs as described herein. Examples of display devices that may be controlled via an ECI are described with respect to U.S. application Ser. No. 10/756,225, filed Jan. 12, 2004, entitled, "Virtual Glass for a Gaming Machine," by Lemay, et al, which is incorporated herein in its entirety and for all purposes.

The bonus interface 118 may enable a player to win a bonus award. In one embodiment, a player may be afforded an opportunity to select between a number of bonus multipliers where a probability of an award of the selected multiplier varies from multiplier to multiplier and may be calculated based upon which multiplier is selected. In one embodiment, the logic for determining whether the selection of a particular multiplier may reside on the remote host 110. In another embodiment, the logic for determining the selection of a particular multiplier resides on the remote host and uses data communicated from the gaming device, such as data based on a player tracking information.

When the player selects one of the multipliers, raw touch screen input data may be sent via event logic 108 and using necessary communication logic (not shown) to the event logic 112 on the remote host 110. When the ECI 122 for the bonus interface 118 is instantiated, a portion of the touch screen display 102 that may be used by the ECI 122 may be determined. This information provides a mapping in regards to which regions of the display are assigned to ECI's. With this information, the operating system 104 may determine whether a touch input received at a particular location is in a region assigned to an ECI and when it is determined that the input is in a region assigned to a particular ECI, route the touch information to a remote host controlling the particular ECI.

In another embodiment, the ECI, may be designed or configured to perform some data handling received from the touch screen. For instance, the ECI may be configured to receive raw touch screen data and determine whether a button has been activated. It may be possible to specify, prior to execution of the ECI what portion of a display screen is available to the ECI and its associated dimensions/coordinates. Thus, a remote host, such as 110, may download an application file including desired content for use by the ECI, such as 122 and 124, that allows the ECI to process touch input. For example, the application file may include a mapping of coordinate locations for each active area (i.e., an area for accepting touch inputs such as buttons on displayed on the display behind the touch screen). The mapping may allow the ECI to process the raw touch data and then send higher-level information to its external controller, i.e., host 110, such as, "Button A activated."

Input processing logic may be provided with an ECI for input devices other than a touch screen. For instance, as part of an instantiation of an ECI controlled by a first remote host, it may be agreed that when input from one or more input devices, such as a touch screen, card reader, a mechanical key pad, mechanical input buttons and combinations thereof, is detected, the input information is to be sent to the first remote host as long as the ECI is active or sent to the ECI for processing, which then may forward the processed information to the remote host. Thus, in general, as part of the initial instantiation of an ECI, information regarding what input devices are associated with the ECI and/or what types of input information to route to the ECI and/or to route directly to the remote host associated with the ECI may be determined and stored on the gaming machine. The information regarding what input devices are associated with the ECI may be determined during an initial negotiating process between the host and the gaming machine.

In another embodiment, the ECI may provide initial processing of information. For example, during the negotiation process, the gaming machine may specify information regarding inputs it receives from various input devices that it will share with the ECI. The specified information may include but is not limited to the type of device, manufacturer of the device, one or more inputs generated from the device and a format for the information for each the inputs. Using the specified information, the remote host may generate application files for an ECI or generate a new ECI application that performs the proper processing/filtering of the inputs received from the gaming machine and routes needed information to the remote host or remote hosts associated with the ECI.

As described in the previous paragraph, the gaming machine may not pass along information regarding all of the inputs it receives from devices coupled to the gaming machine. For instance, the gaming machine may not pass along input information generated by a bill validator or money handling devices coupled to the gaming machine. In one embodiment, the gaming machine may include logic for providing a standard set of device descriptions and associated inputs that may be provided to an ECI. In another embodiment, the gaming machine device descriptions and associated inputs may be varied depending on the remote host that is requesting resources for an ECI. Further details are described with respect to FIGS. 2-7.

As described above, even when the remote host or ECI is to receive input from an input device, not all of the input information received from an input device may be routed to the ECI and/or the remote host controlling the ECI. For instance, the remote host may specify that information read from a player tracking card is to be sent directly to the remote host or routed through the ECI but not information from a credit card. As another example, the remote host may specify that it is looking for input only from a portion of the mechanical input buttons on the gaming machines and that only input from the specified buttons is to be directly routed to the remote host or routed through the ECI but not other buttons. In yet another example, the remote host may specify that if the player inserts a ticket into the bill validator while the ECI is active that the gaming machine is to directly route the ticket information to the remote host or route it through the ECI.

Returning to FIG. 1B, after the remote host 110 receives from the gaming machine 100 the raw touch input corresponding to the selection of one of the bonus multipliers, in one embodiment, the bonus interface manager 126 on the remote host 110 determines that the raw touch input corresponds to a selection of the "2×" multiplier illustrated in FIG. 1B. In another embodiment, the raw touch input may be routed to ECI 122, which process the raw touch input and then notifies the remote host that the "2×" multiplier has been selected.

In response to the selection of the "2×" multiplier, the bonus interface manager may send updated content to gaming machine 100 that indicates the "2×" multiplier was selected, which may be displayed by the ECI process 122 to the display screen. For instance, the "2×" multiplier may be highlighted or emphasized in some manner in the bonus interface 118 on the touch screen display 102. In another embodiment, the ECI 122 may have the capability to update the display to indicate the "2×" multiplier has been selected without receiving additional content or instructions from the bonus interface manager 126.

In this example, the bonus interface manager 126 next generates a random number and determines that the player has won the "2×" multiplier. In response, the bonus interface manager 126 sends updated content indicating the player has won the "2×" multiplier, which may be displayed by the ECI process 122 to the display screen. Next, the remote host 110 may send two events to the gaming machine 100 which may be received and processed by the event logic on the gaming machine.

The first event received from the remote host 110 may cause the gaming machine 100 to double the credits in the credit meter stored on the gaming machine. The first event may be processed by event logic 108 on the gaming machine. When the credit meter has been doubled, as shown in FIG. 1C, the gaming machine 100 may send a message to the remote host 110 indicating the amount credited to the player. Both the gaming machine 100 and the remote 110 may store a record of this event (i.e., the award of the additional credits) for auditing and dispute resolution purposes to secure memory location, such as a Non-volatile memory. It should be appreciated that this first event illustrates an occurrence of an ECI (in this case, a 2× multiplier) modifying one or more aspects of the locally controlled game of chance.

The second event sent from the remote host 110 causes the gaming machine 100 to close down or hide the bonus interface 118 and terminate the ECI process 122 associated with the bonus interface (see at least FIG. 1C). The remote host 110 terminates the bonus interface manager 126 used to send content associate with the ECI 122 to the gaming machine 100 (see at least FIG. 1C). During the termination process, the gaming machine 100 and remote host 110 may exchange messages with information indicating the ECI 122 is no longer active and session termination information, such as a session associated with the ECI 122 ended at a certain time, date, etc.

In one embodiment, the gaming machine enables the player at least partial control in when to open and close down (or hide) the ECI. In one such embodiment, a player may open and close an ECI via a button connected to (or otherwise associated) with the remote host. In this embodiment, the master gaming controller may receive a message from the remote host indicating a desire to close down or hide the ECI. In another embodiment, a player may open and close an ECI via a button connected to (or otherwise associated) with the master gaming controller. For example, a dedicated mechanical input switch/button may be provided on the gaming machine that generates a signal indicating a desire to open or close an ECI.

When an ECI is initiated or terminated on the gaming machine, in response to an input from an input device on the gaming machine, such as the actuation of an input switch as described in the preceding paragraph, in response to some other event generated on the gaming machine, or in response to an event generated on a remote host, in one embodiment, the gaming machine may initiate a session with a remote host that is to provide the ECI or terminate a session with the remote host that provided the ECI.

In another embodiment, when a request is received to terminate an ECI, the gaming machine may maintain the session with the remote host but place the ECI into an inactive or hibernating state and notify the remote host of the ECI status. For example, when the ECI is used to output content to a portion of a display and a request is received to terminate the ECI, the gaming machine may display other content in the portion of the display previously utilized by the ECI, such as resizing the game interface to fit into this portion of the display, place the ECI into an inactive state and notify the remote host of its inactive state without terminating the session. When it is later determined that the ECI is to be reopened, the gaming machine may open the ECI in the display again and notify the remote host of the active status of the ECI. At this time, the gaming machine may or may not renegotiate resources for the ECI.

Returning to FIGS. 1B and 1C, after the bonus interface 118 and ECI 122 are terminated, additional resources related to the touch screen display 102 become available on the gaming machine. In this example, ECI 124 associated with the service interface 120 may be still active after the ECI 122 is terminated. Thus, the gaming machine 100 and the remote host 110 may renegotiate the resources assigned to ECI 124.

As is illustrated in FIG. 1C, after the renegotiation of resources, the game interface 116 and/or the service interface 120 may be resized and assigned to different areas of the touch screen display 102. In response, service interface manager 128 on the remote host 110 generates new content from the content 114 stored on the remote host 110 for the service interface 120 that is consistent with the new display area. In particular, the icons displayed in the service interface 120 may be rearranged as compared to FIG. 1B, to fit into the new display region and the remote host 110 may generate a new touch screen mapping that corresponds to the rearranged icons. The remote host 110 downloads content, information, applications files, etc, to the gaming machine to implement or all or a portion of the specified changes. The content provided from the remote host may be output on the gaming machine 100 via the ECI 124 associated with the service interface 120.

As illustrated in FIGS. 1B and 1C, the service interface 120 includes a number of icons that enable a user to select a service. These icons include food, drinks, coffee, information and communications with another person, such as another game player or a concierge associated with a casino. The types of icons displayed may depend on personal preferences and game play habits of the game player at gaming machine 100 as well operating conditions specified at the casino. For instance, a more valued game player may have access to food, drinks and coffee while a less valued game player may have access to only drinks and coffee. Accordingly, for the less valued game player, the food icon would not be displayed on the service interface 120. Additional details regarding service interfaces are described in U.S. patent application Ser. No. 11/595,774, previously incorporated herein.

To personalize an ECI, such as 124, if the remote host 110 does not store player information, the remote host 110 may receive player information from another gaming device, such as a player tracking server, that enables the ECI's controlled by the remote host to be personalized. The player information may include information regarding game play history for a particular player. In addition, while games are being played on the gaming machine 100, the remote host 110 may directly receive from the gaming machine 100 or via an intermediary device, game play information, such as wager amounts, amounts won, amounts lost, types of games played, amounts deposited to the gaming machine, number of games played, game started, game completed, etc. The game play information may or may not be associated with a particular player.

When an icon on the service interface 120 is selected, the touch screen input data may be sent to the remote 110 which determines what selection was made, i.e., food, coffee, drink, etc. In response, as further described in U.S. patent application Ser. No. 11/595,774, previously incorporated herein, the service interface manager 128 on the remote host 110 may generate new content to send to the gaming machine 100. For example, in response to a selection of the food icon, new content regarding food choices may be sent to the gaming machine 100. These food choices may be displayed in the service interface 120 region on the touch screen display 102 instead of the icons illustrated in FIGS. 1B and 1C.

After a food choice is selected, in one embodiment, the remote host 110 may contact a casino entity providing the food services and may place an order for the food. When the food is ready, it may be delivered to the gaming machine 100. In another embodiment, after the food choice is selected, the remote host 110 may place an order for the food and instruct the gaming machine 100 to print a ticket and/or display information indicating a time and/or a location where the food may be picked up by the game player.

As previously described, the remote host 110 may download information/content in an appropriate format, such as application files including embedded content, such as video and audio files, and other information and/or instructions for an ECI, such as 122 and 124. The application files may be stored locally on the gaming machine 100. In addition, when resources are available (resource monitoring is described in more detail in U.S. patent application Ser. No. 11/595,774, previously incorporated herein), one or more application files or one or more portions of an application file may be stored on the gaming machine 100 even after an ECI has completed execution.

The gaming machine 100 and/or remote host 110 may include logic in regards to storing or purging files. For example, some commonly used files may be stored permanently, other files may be stored for a certain time period, other files may be stored only as long as a particular ECI is active and other files may be stored as long as storage space is available. In another embodiment, all files may be stored in volatile memory such that the files are purged when the gaming machine powers-up and more persistent storage may be provided by a remote host. When application files executed are downloaded from the host 110 to the gaming machine, the host may provide information that helps the gaming machine manage it applications files. For example, the host 110 may designate some application files that are used regularly or are likely to be needed in the future. The gaming machine may use this information when determining where to store the application file or when determining a purge schedule for application files.

One advantage of saving one or more application files on the gaming machine may be that download times may be reduced. For example, if all or a portion of the application files used to generate the bonus interface 118 used by ECI 122 are stored on the gaming machine after the bonus interface is terminated, then a similar bonus interface 118 may be later instantiated on the gaming machine using the one or more stored application files rather downloading all of the need files in total each time.

Further, in some embodiments, two or more ECIs may be able to share application files or a portion of the data stored in an application file. For instance, a video image for a casino logo may be shared by the bonus interface 118 and the service interface 120. Thus, once the video image of the casino logo is downloaded and stored for either bonus interface 118 or the service interface 120, it may be possible to reduce a size of the download by letting the host 110 know that this video image is already available on the gaming machine. In particular embodiments, the gaming machine 100 or the host 110 may initiate a process where information regarding the application files or other content stored locally on the gaming machine 100 that may be utilized with an ECI is communicated between the remote 110 and the gaming machine 100. The remote host 100 may use this information to determine what information/content/instructions, such as application files or application file components to download to the gaming machine 100.

In yet another embodiment, ECIs, such as 118 and 120 may be operable to directly share information with one another. For example, the bonus interface 118 may allow a player to when a free meal. When a player has won a free meal, the ECI 122 generating the bonus interface 118 may be operable to share this information with the ECI 124 generating the service interface 120. The service interface 120 may be operable to provide dinner reservations. Thus, in response to information received from ECI 122, the service interface 120 may be modified to ask the player if they wish to make a reservation at the restaurant and to display information about the restaurant where the free meal was awarded.

In FIG. 1A-1C, the display screen 102 is divided into a number of portions where the size of the portions and the processes used to provide the content to the portions vary with time. The arrangement of display portions and their associated processes are provided for illustrative purposes only. In a particular embodiment, pixel dimension or screen coordinates for a display portion used to output content may be selected to provide various shapes, such as substantially circular, diamond shaped, triangular shaped, star-shaped, etc. For example, an ECI may be operable to output content to one or more of the diamonds or stars on the game interface 116 in FIG. 1A, 1B or 1C. In this example, the ECI may be operable to display content within a moving symbol. In general, the ECI may be operable to display content within a display portion that moves around the screen. For example, the display portion assigned to the ECI may be a shape that moves, such as appears to bounce and the ECI may output content to this remote shape.

In another embodiment, one display portion may be surrounded or overlap another display portion. For example, a first ECI or other process may output content to a rectangular display portion with a "hole" in it. The hole may simply be another display portion at the location of the hole that is controlled by a second ECI or other process, such as a game process. In one embodiment, the first ECI may be aware of the "hole" and arrange its content so that it does not fall with the hole.

In yet other embodiments, the gaming machine may be operable to provide display portions for utilization by an ECI, as "pop-up" windows that overlap or overlay one or more other display portions. The gaming machine may include logic that prevents a pop-up window from blocking an important gaming component on the display, such as a touch screen input button for a game that is being played, or from blocking important game information on the display, such as an outcome of a game that is being played. Whether the gaming component or the game information is important may vary with time, such as when a game is being played or not being played.

In general, the gaming machine may allow for "pop-up" windows (also, non-overlapping windows) that may be controlled by in certain locations in a time dependent manner. For instance, when a gaming machine has been idle of a particular amount of time, the gaming machine may allow a pop-up window for an attract feature where the attract feature is provided in the pop-window by an ECI and where the pop-up window blocks a portion of the game interface. The pop-up window for the attract feature may be closed when the gaming machine detects an event that may indicate that a player wishes to play a game, such as when a bill validator or coin acceptor is activated or when a card insert is detected at a card reader. In another example, a "pop-up" window that is controlled by an ECI may be allowed after an event indicating a player no longer wishes to play a game, such as when a player has pressed a cash-out button at this point a pop-up window or non-overlapping window, may appear where a remote host via an ECI provides content in the pop-window or non-overlapping window that may entice a player to continue playing (e.g., promotional credits, free spin, etc.) or to spend their winnings in some manner (redeem their winnings for a prize).

In particular embodiments, an ECI may be utilized to output content to a display portion on the display that is non-contiguous. For instance, the ECI may be permitted to output content to a display portion comprising a rectangular bar across the top of the display and a rectangular bar across the bottom display where the rectangular bar at the top of the display and the rectangular bar across the bottom of the display don't over-lap.

In yet particular embodiment, an ECI may be utilized to output content across a display portion that spans multiple displays. For instance, the ECI may be utilized to display content on all or a portion of a secondary display separate from display 102 and a portion of display 102. Thus, in one example, content may be provided that appears to move from one display to the other. As another example, the separate secondary display may not include a touch sensor while the portion of display 102 does include a touch sensor. Thus, the portion of the display 102 controlled by the ECI may be used to provide input buttons that affect content that is displayed on the secondary display controlled by the ECI when the ECI controls a portion of the touch screen display 102 and all or a portion of the secondary display.

Gaming Media Management System

Figure 2A:
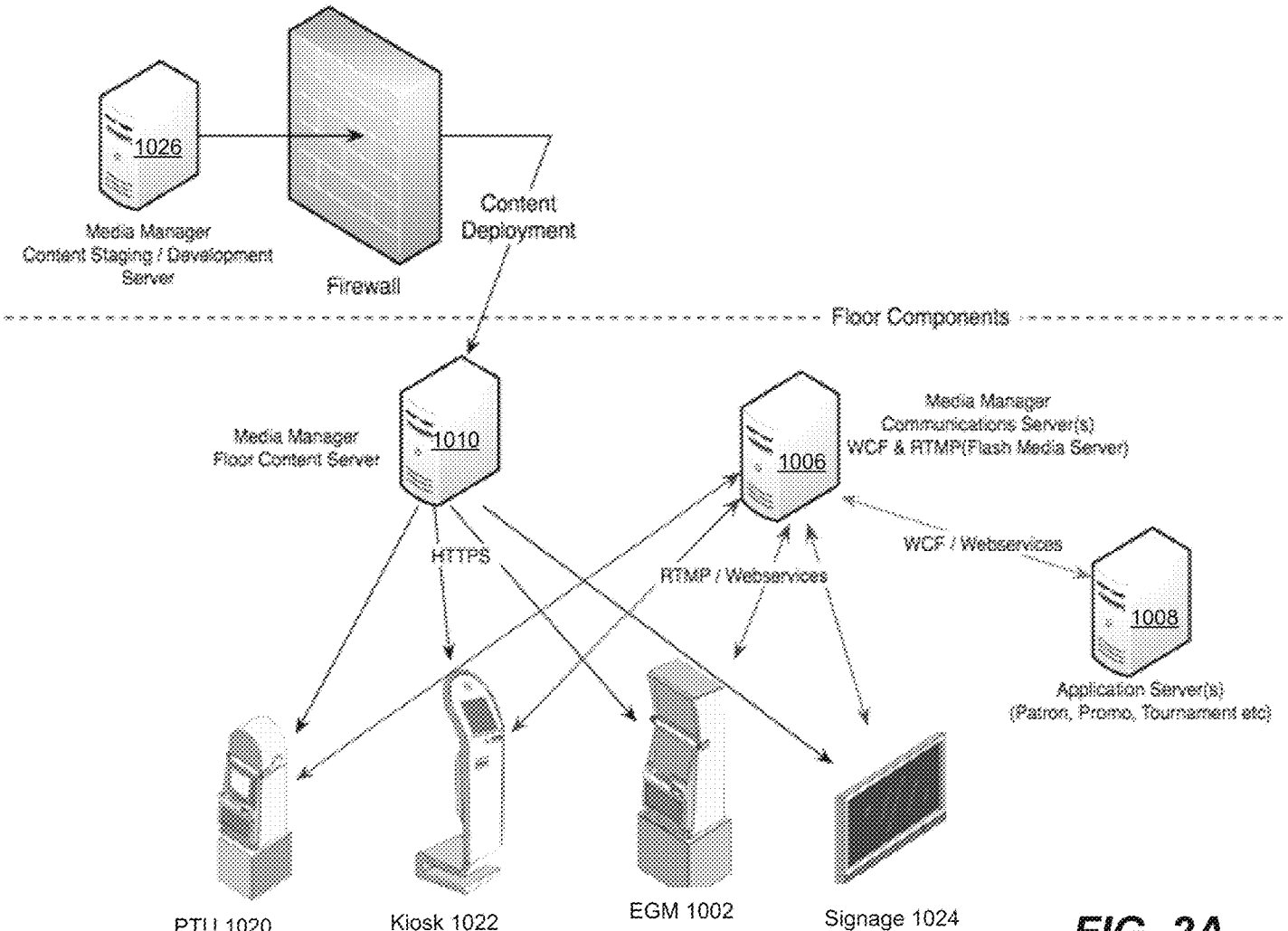
FIG. 2A is a diagram of components of a gaming media management system for one embodiment of the present invention.
Figure 3:
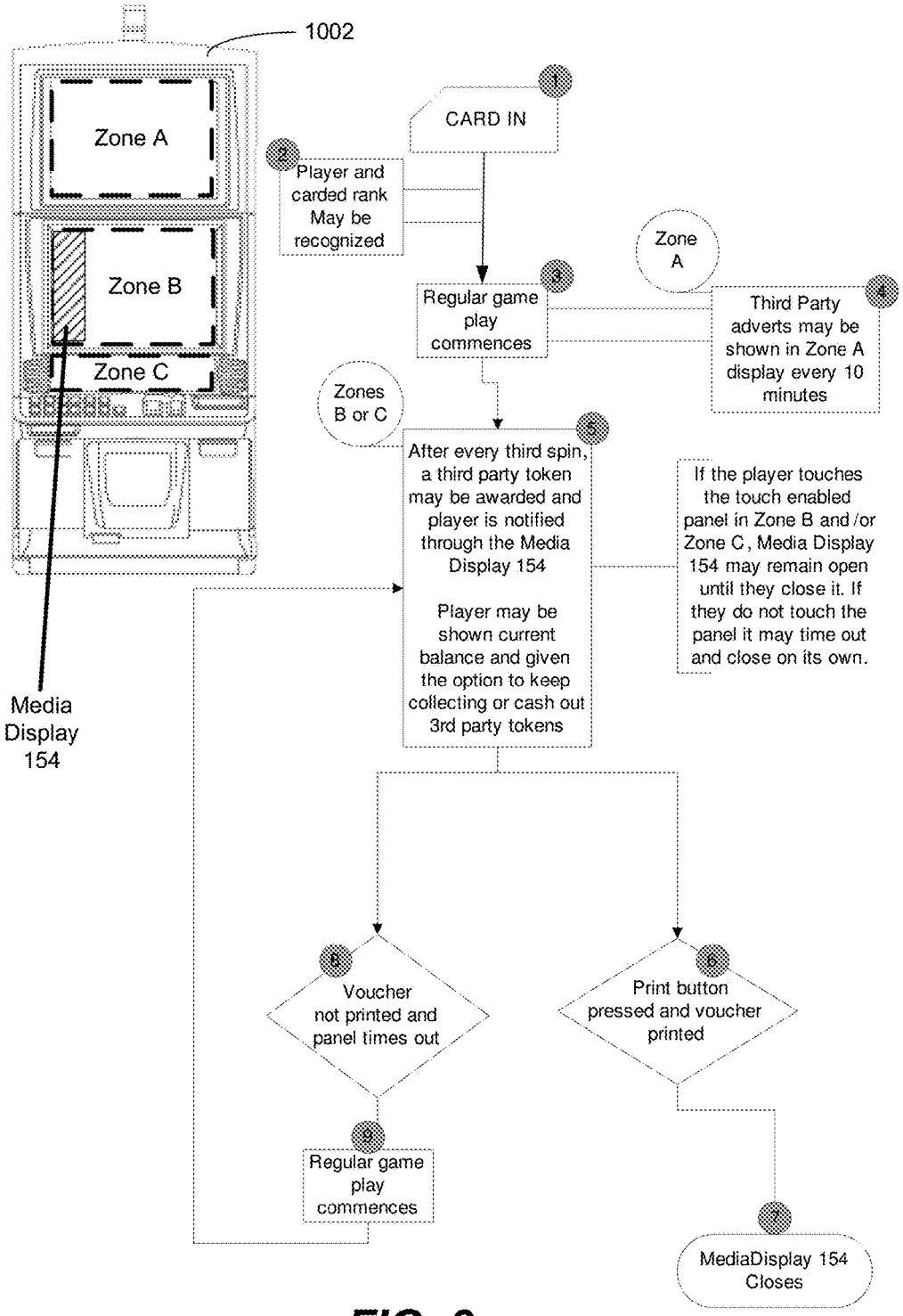
FIG. 3 is system diagram illustrating interactions involving a media display device on a gaming device for one embodiment of the present invention.

FIG. 2A is block diagram of a gaming media management system that includes ECI's implemented on various gaming devices. The system may include a media manager, which is hosted on 1006 in the embodiment of FIG. 2A. The media manager may securely manage the creation, layout and execution of content in various media manager display devices. The Media manager application infrastructure may provide a reusable framework for the development and deployment of application modules and isolated "skins" for those applications. It may also provide interfaces to abstract the framework to various hardware platforms.

The media manager display devices may be considered as particular embodiments of ECI's, which are provided for the purposes of illustration of only. The media manager display devices may be implemented on devices, such as but not limited to the player tracking unit 1020, kiosk 1022, electronic gaming machines 1002, signage 1024, portable gaming devices (not shown) and other hand-held devices.

In one embodiment, a framework may be utilized that allows a Flash Player that runs on the various display devices to be used in the content management infrastructure. The framework may allow an EGM (Electronic Gaming Machine) 1002 and other devices to directly interface with the media manager hosted on 1006. The framework may describe how navigation, prioritization and queuing of content are managed. The framework may also describe how connections and events to the Media manager server(s) 1006 are managed. Details of the framework are described with respect to and following FIGS. 4A-4F.

The gaming media management system may allow the use of both managed and unmanaged content to be deployed to the media manager display devices. Managed content may be controlled by media manager, which may include a policy for the development, verification and deployment of content. In one embodiment, content for use with the media display devices may be developed on a media manager content staging/development server 1026 and deployed to media management floor content server 1010 after verification by the media manager hosted on 1006. The floor content server 1010 may provide content to a number of gaming devices at a particular location, such as on a casino floor or within a casino complex, or to devices at multiple locations.

The gaming media management system may allow for unmanaged content provided by 3rd Party developers to be displayed on various gaming devices. For the unmanaged content, the 3rd party may have to implement their own content controls and verification mechanisms and provide an addition server for their content. In this embodiment, the media manager may provide a framework for accessing the various gaming devices and controlling the information/data flow between the gaming devices and the various servers.

Managed content for display in the media display devices may comprise application modules, which may include executable business logic, and associated module views or "skins." In one embodiment, the application module and the module view may be contained in separate compiled Flash files that may be loaded, linked and executed in the media manager display device at runtime. The managed content including the flash files may be hosted on 1010.

An application module may implement an application-programming interface (API). This API may provide a set of functions for loading and unloading application modules and module views. These functions are described in more detail below. The API may also be used to provide the application modules information about the state of the session such as the player profile of the currently player, the EGM id and other information.

The relationship between the application modules and the module views may be similar to the relationship between the gaming logic for a game of chance and the associated presentation logic. The gaming logic controls how a particular game will proceed, i.e., it implements the rules of the game, including the outcome while the presentation logic controls the "look and feel" of the game. The "look and feel" of a particular game may be changed by changing the presentation logic while leaving the gaming logic unchanged.

Similarly, the "look and feel" of a particular application module may be changed by changing a module view associated with the application module. For example, a generic application module that provides player bonuses may be generated. The generic application module may implement rules (business logic) for awarding the bonuses and may include various settable parameters. The generic application module may be applicable in a plurality of gaming establishments. For each gaming establishment, a custom module view may be generated that "brands" the application to each gaming establishment. For instance, the module view for each establishment may include logos and/or theme associated with the particular gaming establishment.

Since application modules may be operable to provide awards of a tangible value, the application modules may be controlled by the system for versioning, licensing and target hardware platform. The module views associated with the application modules may not be as controlled as the application modules. For instance, in some embodiments, module view may be created by designers working for a casino and then deployed in the gaming media management system.

Figure 2B:
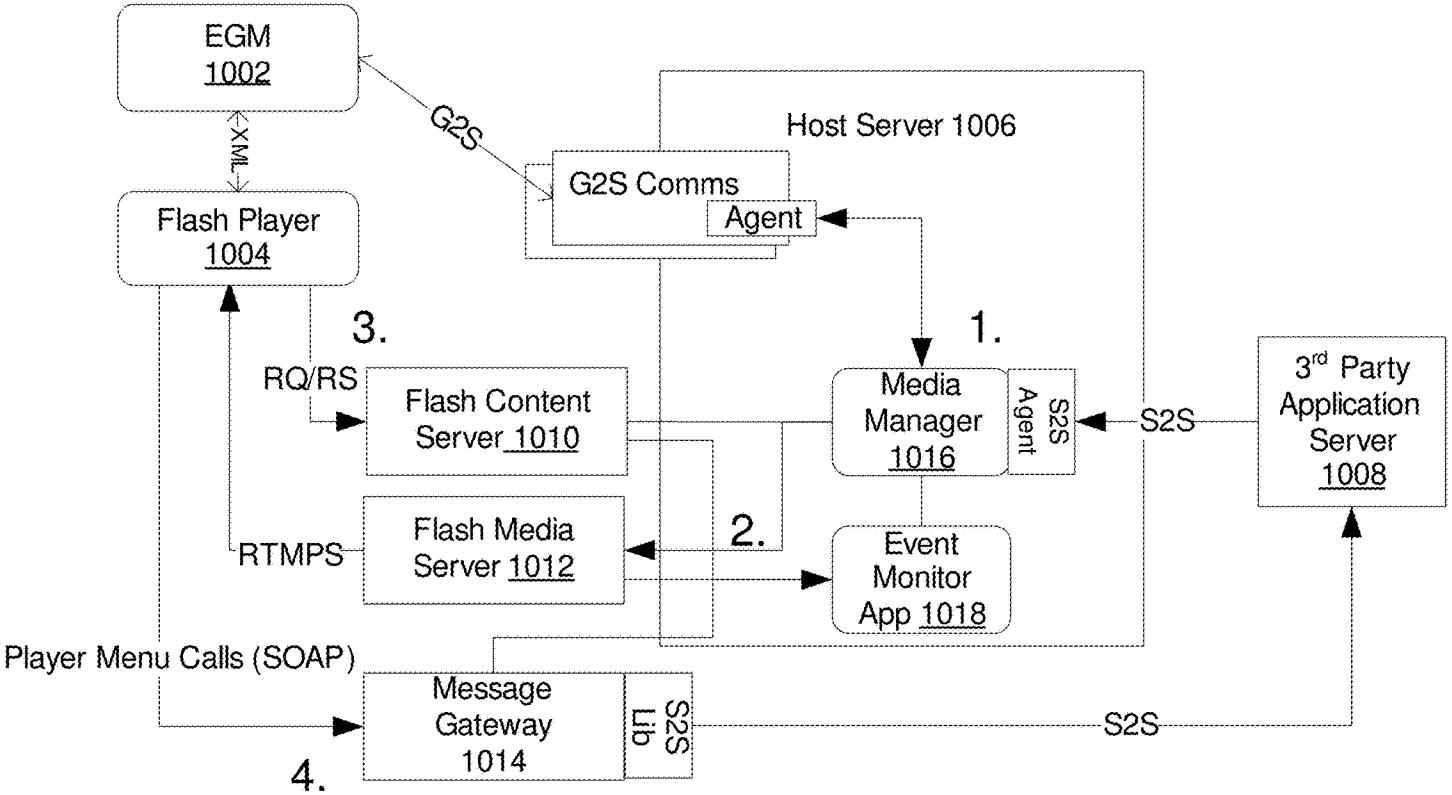
FIG. 2B is a diagram of components of a gaming media management system for one embodiment of the present invention.

FIG. 2B is a specific embodiment of a media management system. The system includes a media manager application on host server 1006, a flash content server 1010, a flash media server 1012, a 3rd party application server 1008, a media display device utilizing a flash player 1004 that executes on EGM 1002, a message gateway 1014 and an event monitoring application 1018. The flash content server 1010 may store a library of available flash content. The flash media server 1012 may be operable to deliver content to the flash player 1004. Additional details of this system are described with respect to U.S. Provisional Patent Application No. 61/055,316, previously incorporated above.

RQ/RS refers to request response pairs, which are described in more detail following FIGS. 4A-4F. S2S (system to system) and G2S (game to system) are two gaming related open communication protocols maintained by GSA (Gaming Standards Association, Fremont, Calif.). SOAP (Simple Object Access Protocol) is a communication protocol for accessing a web service based upon XML (extensible mark-up language). It is being developed as a W3C standard. These protocols and the protocols described below are provided for illustrative purposes only as the apparatus and methods described herein are not limited to the use of these communication protocols.

The Macromedia™ Flash Player may communicate with the Flash Media Server 1012 using RTMP, RTMPT or RTMPS. RTMP protocol communicates uses a default port 1935. RTMP uses HTTP protocol to transmit RTMP packets (HTTP tunneling). RTMPT protocol provides for tunneling via http—default port of 80. RTMPS provides for tunneling via https—default port of 443.

Two examples of pathways in which content may be requested and displayed in a given media display device are as follows. Content in a media display device, such as kiosk 1022 or EGM 1002, may be launched by a server-generated event or by a user navigating to content, such as via a menu or a button. The framework may be responsible for managing both pathways and may provide a mechanism for the prioritization and navigation to content.

As an illustration, in FIG. 2B, in response to a user navigating to content, a player menu executing via the flash player may use SOAP to communicate with the message gateway 1014. The message gateway 1014 may communicate with the flash content server 1010 and/or use S2S to communicate with 3rd party application server 1008. The flash content server 1010 may then, under control of the media manager 1016, upload content to the flash media server 1012. The flash media server may download the uploaded content to the flash player 1004.

The S2S communication from the message gateway 1014 to the 3rd party application server 1008 may allow the 3rd party application server 1008 to respond to menu selections or other information entered via the flash player 1004. The selections that may be made may vary from application to application. One example of selections that may made for a particular application that may be hosted on a 3rd party application server are described with respect to FIG. 3. In some embodiments, the system may be able to interpret the player selections and determine the content to load in response without additional information from 1008. In other embodiments, server 1008 may interpret the menu selections and provide information to the media manager 1016 that allows appropriate content to be loaded in response to the menu selections.

System driven content navigation may be managed through the Media Manager 1016. As an illustration, in FIG. 2B, the 3rd application server 1008 may control displayed on the flash player 1004. For example, the 3rd application server 1008 may request certain content to be output on the EGM in response to events occurring on the gaming machine. For instance, the EGM 1002 may communicate its status, such as that a "cash out" request has been detected, to the media manager 1016 using the G2S protocol. The media manager 1016 may then communicate this information to the 3rd party application server via the S2S protocol. The media manager may expose application events corresponding to each of the S2S commands exposed via Media Manager's 3rd party API. These event types may be configured within the event monitor application 1018 to persist, and to publish.

In response to an application event received from the media manager 1016, the 3rd party application server may request that an application involving an offer be output via the flash player 1004. The media manager 1016 may control the downloading of content to the flash player 1004 via the flash content server 1010 and the flash media server 1012.

When several server driven navigation events exist there is the potential of having multiple system navigation events trigger at the same time. The media manager 1016 may handle this race condition by providing a prioritization infrastructure that allows various devices seeking to utilize a media display device, such as the flash player 1004, to assign a level of priority to their corresponding events. Examples of event prioritization may be that an offer for a buffet would have a "low" priority while a bonus prize message would have a "high" priority. If multiple "high" priority events are triggered at the same time Media Manager may queue the events and execute them in succession by the order in which they were received until the queue is empty.

The system may manage application events related to content deployment, a content serving, message routing, the Flash player, and S2S events. Each of these event sources introduces a logging function. Examples of the logging functions of the media manager are indicated by the numbers 1-4 in FIG. 2B. The number 1 indicates that all or a portion of (inbound) commands received from S2S client(s) by media manager 1016 may be logged and may be subscribable (i.e., other devices may be able to obtain information regarding logged events.) The number 2 indicates that all or a portion of operations/messages related to change of content between the media manager 1016 and the flash media server 1012 may be logged and subscribable.

The number 3 indicates that all or a portion of messages between the flash player 1004 and the flash content server 1010 may be logged. The number 4 indicates that all or a portion of (outbound) messages processed by the message gateway 1014 may be logged. In particular embodiments, the message envelope of each message may be persisted and the body of each message may not be persisted.

Exemplary Media Display Devices and Associated Content

FIG. 3 is system diagram illustrating interactions involving a media display device on EGM 1002 for one embodiment of the present invention. The EGM 1002 includes 3 zones, A, B and C, on which visual aspects of content associated with a media display device may be output. Zone A is associated with a secondary display screen located in a top box, Zone B is associated with a primary display screen associated on which a wager-based game associated with the EGM 1002 is generated and Zone C is a secondary display associated with a player tracking functions implemented on the gaming machine. A media display device 154 is instantiated in Zone B in this embodiment. The content associated with a media display device may utilize sound, tactile feedback, still and motion images and other modes of communication that allow information to be transmitted from a gaming device to a user, such as light patterns flashing on a lighting device, and is not limited to visual content output on a video display screen. Further, the other devices as described with respect to FIG. 2A may be utilized to instantiate media display devices.

In 1, a card-in event may be detected on the EGM 1002. The card-in event may be recognized and information regarding the event may be forwarded to one or more network devices coupled directly or indirectly to EGM 1002. In 2, the player and carded rank may be recognized by the EGM 1002 and/or one or more network devices coupled to the EGM. In one embodiment, information about the player and their rank (rank may represent a value to a gaming entity) may be part of an event that triggers custom content to be selected for the player and readied for display on a media display device, such as 154. The custom content that may be selected may include application modules and associated module views. In 3, video game presentation may be generated in Zone B.

In 4, third party advertisements may be shown in Zone A every ten minutes. These third party advertisement may be controlled from a third party application server as described with respect to FIG. 2B. The advertisements may be customized for a venue in which the EGM 1002 is located, customized for the player at the EGM, generic advertising or combinations thereof. The advertising may be shown at various frequencies, such as every ten minutes, on a media display device (not shown) located at some position in Zone A.

At some point in time, either prior to game play commencing, such as after the card-in event is recognized or when credits are deposited on the EGM 1002, or during game play, a media display device 154 may be opened. The media display device 154 may be opened in Zone B or Zone C. In one embodiment, the display devices in Zone B or Zone may be operable to detect a touch input. For example, if a touch is detected in Zone B or Zone C, the media display device 154 may remain open until an input is detected to close/hide the media display device. As will be discussed following FIG. 4F, the touch media display device may close (terminate its execution) or may be hidden but executing after a time period elapses.

In 5, an example of an application via the media display device 154 is described. In this example, after every third spin, in the case of a slot type game, or after every third game, a third party token may be awarded and the player may be notified through the media display device. In one embodiment, the application executing on the EGM 1002 may receive game status information and be able to determine when each third spin has occurred. In another embodiment, this information may be sent to a remote network device. The remote network device may track the EGM 1002 status information and then send commands, instructions and/or data to initiate the award of the third party token via the media display device.

Within the media display device 154, a current balance of tokens may be displayed. When a cash out is initiated, an option may be displayed that allows the player to keep collecting the tokens or cash out the third party tokens. The third party tokens may be cashed out for game play credits, goods, services or discounts for goods and/or services or other items of tangible value. In 8, an input to cash out the tokens is not received. For example, the tokens may provide an offer that the player doesn't wish to redeem. Thus, a voucher indicating an award of the tokens may not printed out and the media display device 154 may be timed out and hidden or terminated. In 9, regular game play may continue. In 6, an indication to print a voucher for the third party tokens is detected and a voucher may be printed. In 7, the media display device 154 may be hidden or terminated.

FIGS. 4A-4F are block diagrams of EGM 1002 including various media display devices, associated content and configuration options for various embodiments. Further details of configuration options and communication framework for setting the configuration options are described with respect to FIGS. 4A-4F and following the description of FIGS. 4A and 4F. These examples are provided for illustrative purposes and are not meant to be limiting. For example, the media display devices may be implemented on gaming devices other than EGM 1002 and the number, size and or location of media display devices implemented on a gaming device may be varied.

The game display in the examples is a video display. However, the embodiments described herein are also compatible with EGMs where the game display comprises slot reels. In one embodiment, an ECI associated with a remote host may be able to control the position one or more slot reels as part of bonus scheme. For example, the slot reels may be moved to a position that is normally not associated with an award and then an award may be provided with the slots in this position. Visual information relating to the bonus scheme may be presented on a display coupled to the EGM with the slot reels, such as a top box display, player tracking display or other associated display. In other embodiments, information relating to the bonus scheme may be communicated via an audio communication.

Figure 4A:
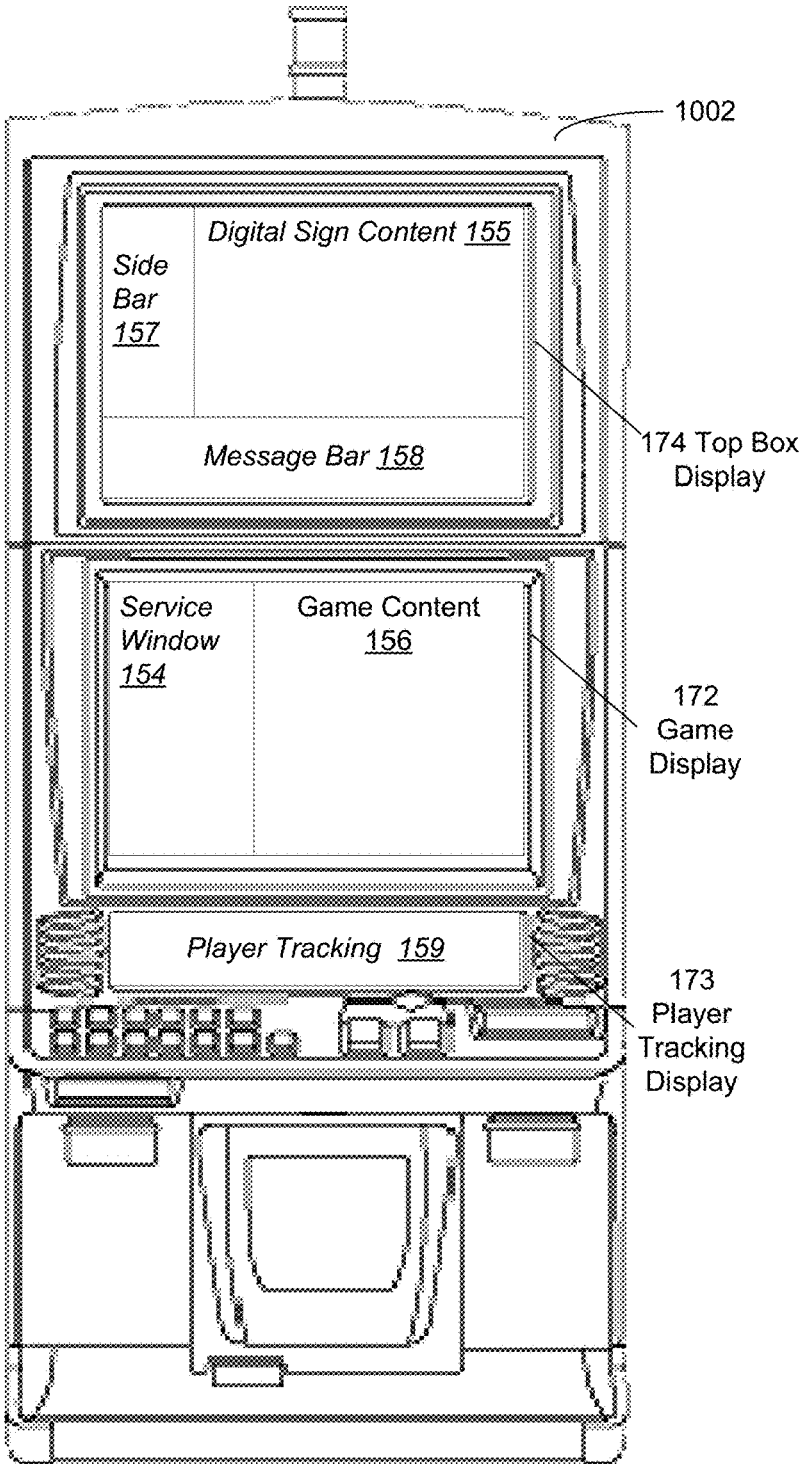
Figure 5:
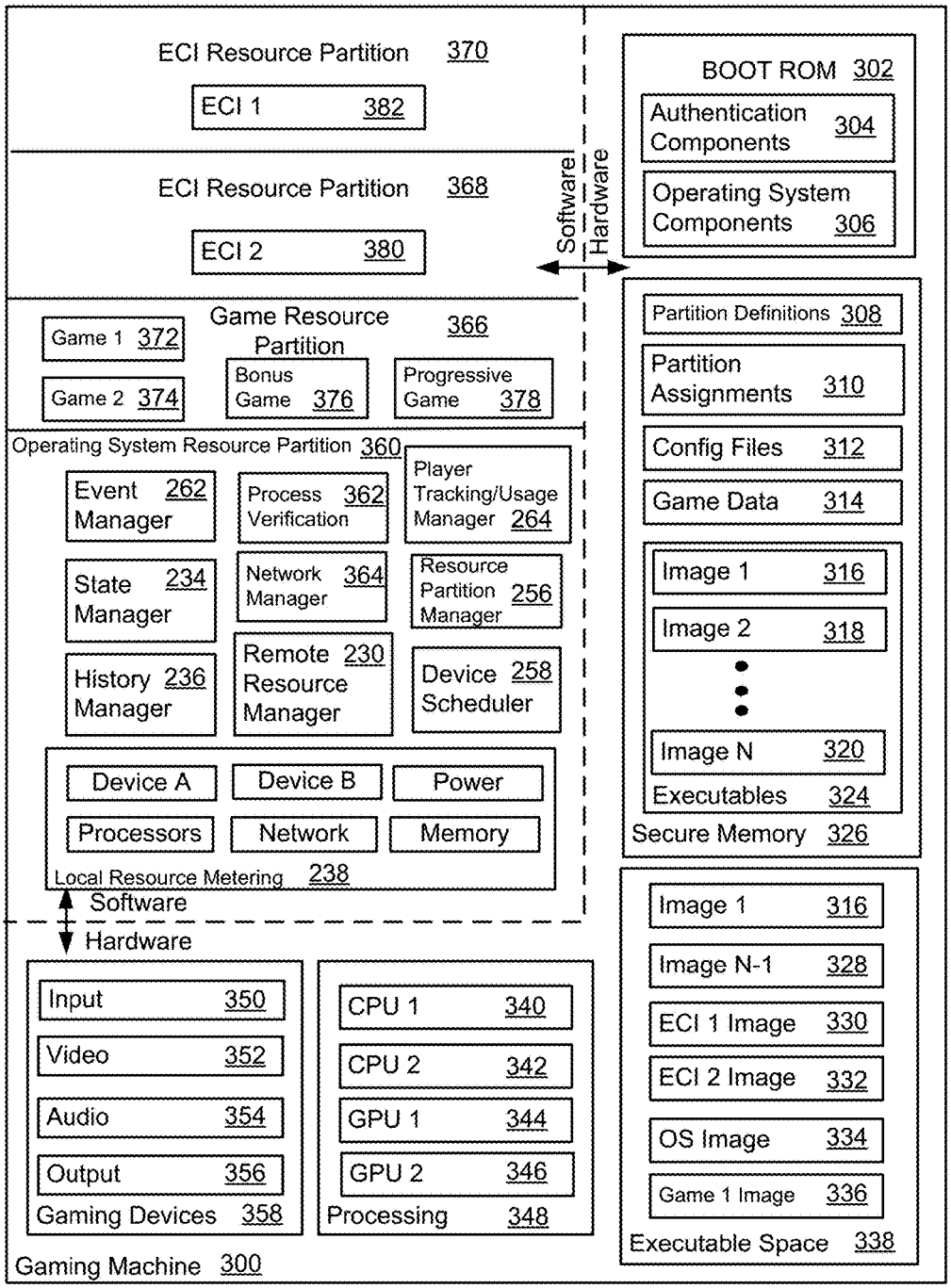
FIG. 5 is a block diagram of hardware and software components and their interactions on a gaming machine for embodiments of the present invention.

In FIG. 4A, EGM 1002 includes 3 displays, a top box display 174, a game display 172 and a player tracking display 173. The game content 156 may be displayed on the game display 172. Five media display devices, 154, 155, 157, 158 and 159 are shown. The five media devices have been given names relating to their location, size or functions, such side bar 157, which is located on the side, digital sign 155, which may provide advertising information, message bar 158, which is narrow and bar shaped, service window 154, which may be used to provide services and player tracking 159, which is located on the player tracking panel.

From zero to five of the media display devices may be open at a particular time. As will be described in more detail below, the EGM or another device in the gaming media management system may be operable to determine if two media devices invoked on the same display device overlap. For example, the native size and location of the side bar 157 and message bar 158 may be such that the size bar and the message bar overlap when both are invoked such that the side bar 157 may extend down the entire side of the top box display like the service window 154 in game display 172. To prevent the overlap, the side bar 157 and its associated content may be scaled to the size show in FIG. 4A. In another embodiment, the message bar 158 could be sized and its content scaled to allow the side bar 157 to extend down the length of display 174.

In FIG. 4B, a single media display device 154 is configured. Game content may be displayed on display 174 and 172 and player tracking functions on display 173. The game content 156 may be scaled to fit the full display size or a portion of the display size depending on whether the media display device 154 is shown or hidden. In some embodiments, the scaling options available for the game content 156 may dictate size parameters for the media display device.

It is usually important that the game content both maintain its "look and feel" and information to remain legible at all times. Therefore, the scaling of the game content may be given priority over any scaling issues associated with content displayed in the media display device. For example, the width of the game content portion of display 172 may be set to minimize scaling issues for the game content, which in some instances, may be at odds with a desired width or height for displaying content associated with a media display device. In general, a priority may be set for a particular media display device and/or particular content such that scaling issues associated with outputting multiple types of content simultaneously on the same display, such as game content and content in media display device 154 may be resolved.

Some configuration parameters for the media display device are shown. These parameters may be communicated to a host device that wishes to utilize a media display device. Further configuration parameters are described following FIG. 4F. The mediadisplaytype is use to indicate what screen the media display device is instantiated. In this embodiment, it is set to "game display." The mediadisplay description is a text descriptor of the media display device. In this example, it is called a "service window." The touchscreencapable variable is set to "true" to indicate that touch screen input may be detected. The contentwidth is set to 256 pixels and mediadisplayposition is set to "left" to indicate it is on the left side of the display screen.

The content width may be used to select content for display in the media display device 154. It may be desirable to select content that is close as possible to the native resolution of the media display device. When content of multiple resolution sizes is available, this selection may be made by an application, such as the media manager, previously described with respect to FIGS. 2A and 2B. The gaming device on which the media display device may be operable to perform additional scaling of the content, i.e., module view, if necessary.

In FIG. 4C, a single media display device 176 is configured for outputting content on top box display 174. The game content 156 is displayed on the full game display 172. The media display device 176 is configured as a "digital sign" for displaying advertisements. The mediadisplaytype is set to "Top Box." The mediadisplaydescription is set to "digital sign." The variable touchscreencapable is set to "false" to indicate touch screen input is not available via the display on which the media display device 176 is instantiated. The contentwidth is set to 800 and the mediadisplayposition is set to "full" to indicate the entire screen is used.

Figure 4D:
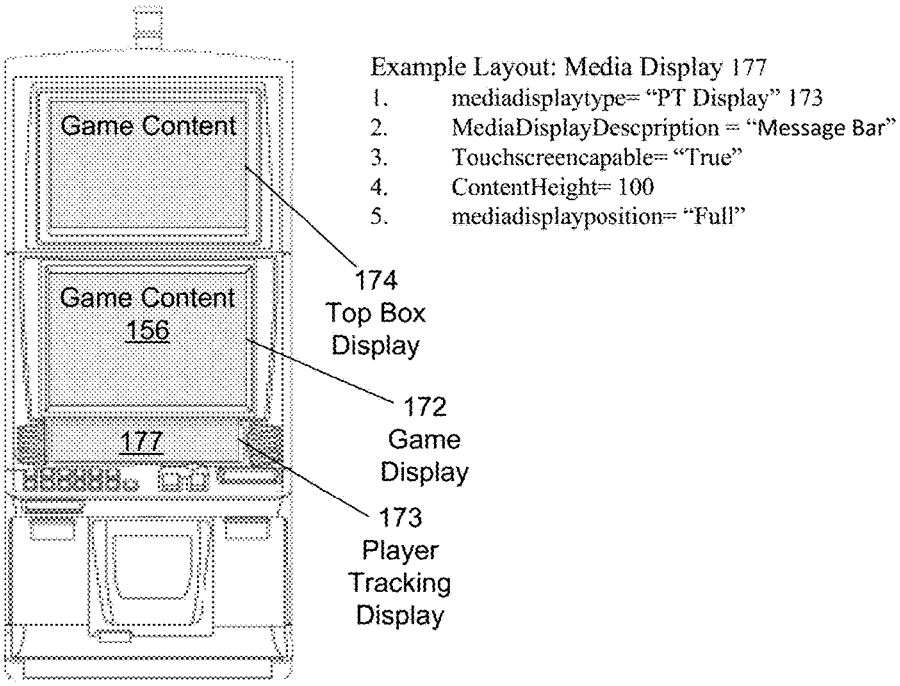

In FIG. 4D, a single media display device 177 is configured for outputting content on player tracking display 173. The game content 156 is displayed on the full game display 172 as well as the top box display 174. The media display device 177 is configured as a "message bar" for displaying news, advertisements, calendar of events, etc. The mediadisplaytype is set to "PT display" to indicate the player tracking display 173. The mediadisplaydescription is set to "Message bar." The variable touchscreencapable is set to "True" to indicate touch screen input is available via the display on which the media display device 177 is instantiated. The contentwidth is set to 100 and the mediadisplayposition is set to "full" to indicate the entire screen is used.

Figure 4E:
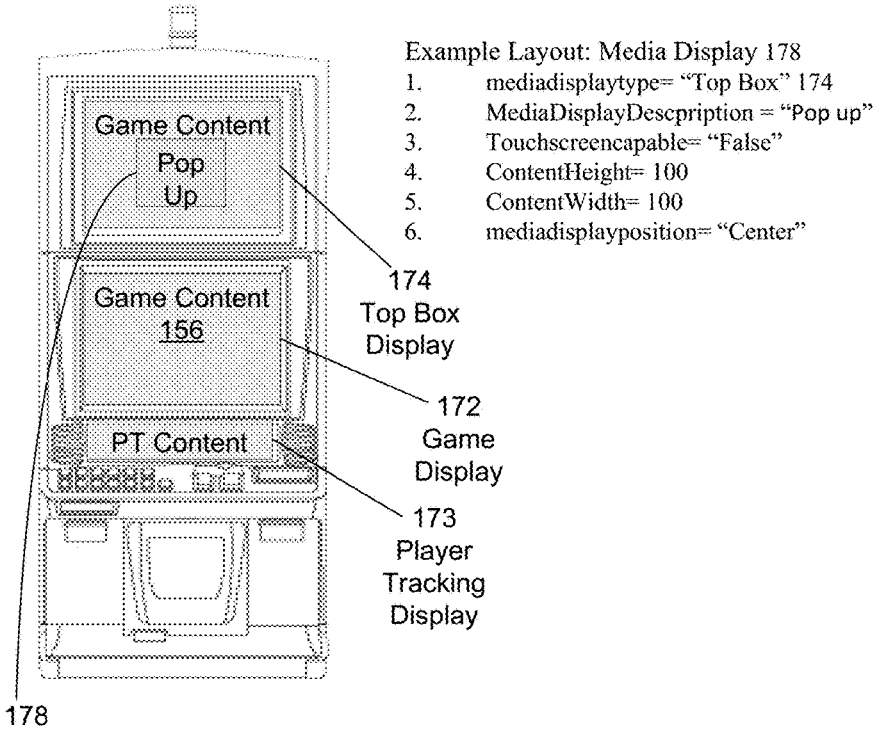

In FIG. 4E, a single media display device 178 is configured for outputting content on top box display 174. The window is a pop-up window similar to a picture in a picture display. The content output on the pop-up window blocks content, such as any content that may be output one top box display. The game content 156 is displayed on the full game display 172 as well as the top box display 174. The mediadisplaytype is set to "Top Box" to indicate the top box display 174. The mediadisplaydescription is set to "Pop up." The variable touchscreencapable is set to "false" to indicate touch screen input is not available via the display on which the media display device 177 is instantiated. The contentwidth is set to 100, the content height is set to 100 and the mediadisplayposition is set to "center" to indicate the pop-up window is located in the center of the display.

Figure 4F:
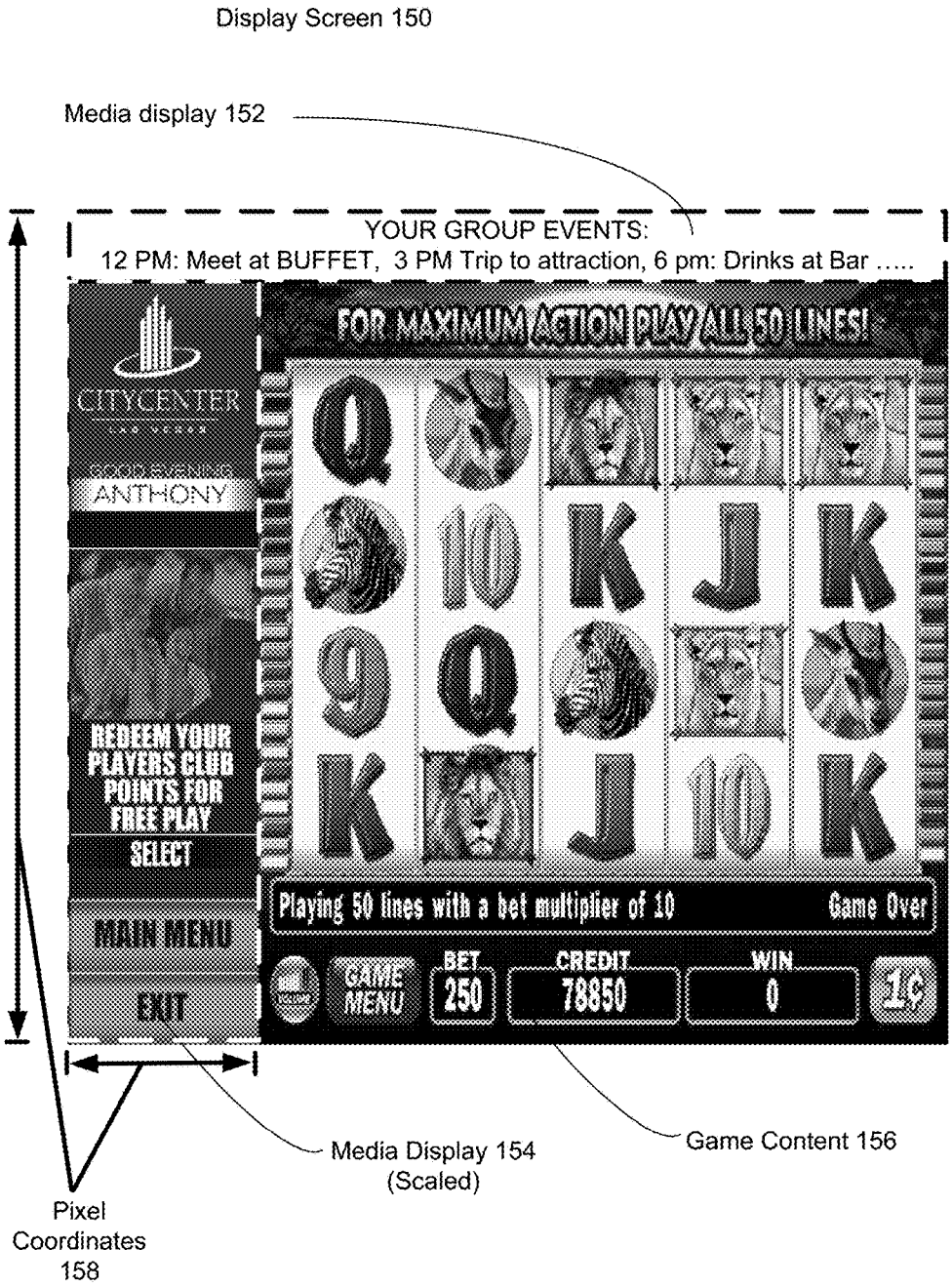

In FIG. 4F, content output on a display screen 150 is shown. Three sources of content are output. First, game content 156 associated with a wager-based game is output in a portion of the display. Second, a media display device 152 is configured as a message bar on the top of the display. The message bar 152 includes content that is customized for a particular player. In this example, the message bar displays group events and a schedule for a player that is a member of the group. Locations of media display devices and associated content may be specified in one embodiment using pixel coordinates 158. The pixel coordinates may be associated with an output resolution selected for display screen 150.

Service window type media display device 154 is output on the left side of the display screen. In this example, the native size and position of the media display device 154 overlaps with the media display device 152. A priority is set for the media display device 152 that is greater than the media display device 154. The media management gaming system may be configured to detect overlaps in media display devices, determine the priority setting of the media display device and or content intended for a particular display device and scale the media display devices and/or content associated with the media display devices as needed. In this example, the media display device 152 and/or its associated content have a higher priority than then the media display device 154 and its associated content. Thus, the media display device 154 and its associated content have been scaled to allow the message bar to output at its full size.

Communication and Configuration Framework

In the following paragraphs, different configuration parameters that may be set for a media display device and a communication protocol that allows a host to access a media display device on a game device are described for embodiments of the present invention. The mediaDisplay class may be used by a host to access display windows or 'mediaDisplays' on an EGM or other gaming devices. The mediaDisplay class may be a multi-device class. Each configured media display device used within an EGM may be assigned its own 'deviceId.'

As described above on a given screen there can be multiple media display devices displayed at a given time, which can cause non uniform scaling when a window associated with the media display device dimensions interfere with each other. Therefore, in one embodiment, the framework may provide that one media display on a screen maintains its default size regardless of the effects of other media display devices showing on the screen.

The loadContent command is used to initiate the transfer of content to the device. As described with respect to FIGS. 2A and 2B, the content may be stored on an intermediary device separate from requesting the content to be loaded. Once content has been loaded, it may be activated using the setActiveContent command. This allows for multiple pieces of content to be loaded into a mediaDisplay device at one time (preloading). The maxContentLoaded attribute of the mediaDisplayProfile command may define how many pieces of content can be loaded simultaneously by the EGM. If the EGM cannot load the content because of file size limitations of the device, IGT_MDE105 Content Error event may be generated and the contentException is set to 1—Content Transfer Failed.

In one embodiment, maximum number of pieces of content may be constrained for a particular media display device, such that the total of pieces of content, which may be from two or more different hosts are limited. For example, the maximum number of pieces content may be 5 where any combination of hosts up to 5 may be able at a given time to load content for the particular media display device (e.g., 5 hosts loading one piece of content each, 1 host loading 5 pieces of content, a first host loading 3 pieces of content and a second host loading 2 pieces of content, etc.)

In addition, the amount of content that a particular host may be allowed to load at a given time may be varied from host to host. For example, a first host may be allowed to load a greater number of pieces of content than other hosts. This limitation may be specific to a particular media display device and/or may be specific to a particular gaming device providing one or more media display devices. For example, a particular host may be limited to loading 2 pieces of content per media display device provided on a gaming device or a particular host may be limited to loading 2 pieces of content independent of how many media display devices are implemented on a gaming device.

In one embodiment, content may be screened for size prior to it being deployed to the gaming media management system where content over a max size may not be allowed to be deployed within the gaming media management system. Thus, the max content size times the maximum amount of pieces content that are allowed to be loaded for a given gaming device or a given host may constrain the maximum memory resources that are utilized on a particular gaming device. The amount of content that is allowed to be load on a particular gaming device may vary from gaming device to gaming device depending on its native resource.

In one embodiment, only one piece of content may be "executing" at a time in a given media display device. Content may be defined as executing when it is loaded and running in a media player on the device, such as a Flash Player™ Content may begin executing when it is set to active by the setActiveContent command. Only executing content may be shown, but content does not need to be showing to be executing. Content can execute off screen when the deviceVisibleState is set to "hidden."

Two hosts or more may simultaneously wish to access a particular media display device and may be allowed to each load their content. To prevent the content provided from one host to crash or degrade the performance of the media player associated with the media display device while content from a second host is outputting content via the media device, only the first content from the second host associated with the single media display device may be allowed to "execute." When the content associated with the second host is finished executing, the first host may be allowed to execute its content. A host may determine what content is active in a media display device by calling the getMediaDisplayStatus command. The contentId and transactionId generated in the mediaDisplayStatus command may identify the active content, if any.

In one embodiment, a host may be able to release content. When content is released it may be no longer available for execution in a media display device instantiated on a gaming device. A remote host may be able to release content using the releaseContent command. When content is released by a particular remote host then the content may longer count against the maximum number of pieces of content that remote host is allowed to control. In particular embodiments, the gaming device providing the media display device may release a particular piece of content if a content error is encountered.

In another embodiment, all or a portion of the pieces of content loaded on a gaming machine be released when the gaming device, such as an EGM, goes through a power cycle or in response to one or more error conditions, such as a tilt. In one embodiment, all or a portion of the pieces of content loaded on a particular gaming device hosting a media display device may be stored in a volatile memory, such that when the gaming device through a power cycle including a loss of power all of the loaded content associated with the volatile memory may be lost or not available from the volatile memory. Nevertheless, a record of what content is loaded may be stored in a non-volatile memory, such that after a power cycle involving a loss of power a record of what content was loaded prior to the power loss may be available.

The pieces of content loaded may not automatically released at the end of its execution. Thus, a piece of content may be reused by a particular host or another host. In one embodiment, two or more remote hosts may be able to share a particular piece of content loaded on a gaming device at a particular time.

In one embodiment, when the media player fails to run a particular piece of content successfully at any time, an error may be generated, such as a "Content Error Detected," and the contentException may set, such as to 3—Content runtime error. When the state of the media display device is shown and when a content exception error occurs, the state of the media display device may be changed to hidden so that it is not visible on the gaming device interface. The state of the media display device may be recorded in the deviceVisibleState. Thus, when Content runtime error occurs as state of the deviceVisibleState may be switched from "Shown" to "Hidden."

The mediaDisplayPriority may be a parameter for a number that the is assigned to each media display device exposed. The mediaDisplayPriority may indicate the precedence of the devices in regards to scaling when multiple media display devices are available for output to the same screen at the same time.

For example, if there are two mediaDisplay devices on the primary screen and two mediaDisplay devices on the secondary screen, their names and priorities might look something like: A) screenType=IGT_primary, (Name=Media Display, mediaDisplayPriority=1) and (Name=Message Bar, mediaDisplayPriority=2) and B)screenType=IGT_secondary, (Name=Topbox Media Display, mediaDisplayPriority=1) and (Name=Topbox message bar, mediaDisplayPriority=2). In one embodiment, each media display devices may be required to have a unique priority per screen, which is why Media Display and Topbox Media Display both may have a priority of one. In this example, since the media display has a higher priority than the message bar, if the Message Bar is open on the IGT_primary display and then the Media Display is opened, the size of the Message Bar display on the screen shrinks and its associated content may be scaled to allow for the smaller size on the screen.

The priority may be set in the mediaDisplayProfile by the gaming device providing the media display devices and may be determined based on the configuration and number of devices that the gaming device supports. In particular embodiments, the remote host may be able to configure the mediaDisplayPriority through optionConfig parameter only if the gaming device allows for remotely configured devices. Not all gaming devices may allow this parameter to be configured by a remote host. Further, not all remote hosts may be allowed to set this parameter even remote configuration of the media display priority is available on a particular gaming device.

If authorized, as described in the parameters in the loadContent command, executing content may be able to open an XML socket connection directly to the gaming device providing the media display device, such as an EGM to send and receive events and commands that are needed for real-time feedback. In one embodiment, a media access token is generated for each piece of content. This parameter may be referred to as mdAccessToken. The content may be required to present the mdAccessToken with the valid value to gaming device during the establishment of communications.

The gaming device providing the media display device may expose the commands and events it supports through the localEventList and localCommandList in the mediaDisplayProfile. The host specifying the content to load may also specify which events and commands the content is authorized to receive or execute when the content is loaded by setting items in the authorizedEventList and authorizedCommandList attributes of the loadContent command. The commandElement string may correspond to the command name and the eventCode may correspond to the event codes that are associated with the authorized command list and event list. The events and commands contained in the loadContent command may be required to be a subset of the events and commands listed in the mediaDisplayProfile. Providing a command or an event as authorized that is not supported by the gaming device may result in an error condition being generated.

ContentId may be an identifier assigned by the host in the loadContent command. The gaming device in communication with the host may generate a transactionId each time it receives the loadContent command with a new contentId. The transactionId may be incremented each time new content is loaded. The host may receive the transactionId in the mediaDisplayAck command returned from the gaming device, such as an EGM. From that point forward, the host may use the contentId/transactionId pair as parameters for setActiveContent and releaseContent, i.e., setting and releasing content. The gaming device providing the media display device may create a new log entry each time a new transactionId is generated so that there is one log entry for each content that is loaded. The log entry is finalized when the content is released, the gaming power cycles or error condition is generated. As described above, released content is no longer available for execution in a media display device.

The gaming device may be operable remove a finalized log entry in favor of a new transaction. Typically, oldest transactions may be removed first. The gaming device may be configured to log a certain number of transactions, e.g., a hundred, prior to beginning to remove old transaction records. The transaction log may be stored in a non-volatile memory location locally on the gaming device and/or on remote device in the gaming media management system.

The following table lists commands that may be originated by a host for embodiments of the present invention. A host seeking to load content in a media may be assigned different privileges, e.g., owner or guest. A host with owner privileges may be able to execute more commands than a host with guest privileges. Further, certain commands may not be allowed when the media display device is disabled, such as in the event of an error condition.

TABLE 1.1

Request/Response Pairs

| Request | Response | Owner | Guest | OK When Disabled |
|---|---|---|---|---|
| getMediaDisplayProfile | mediaDisplayProfile | Yes | Yes | Yes |
| setMediaDisplayState | mediaDisplayStatus | Yes | No | Yes |
| getMediaDisplayStatus | mediaDisplayStatus | Yes | Yes | Yes |
| setMediaDisplayLockOut | mediaDisplayStatus | Yes | No | Yes |
| loadContent | contentStatus | Yes | No | No |
| releaseContent | contentStatus | Yes | No | No |
| setActiveContent | contentStatus | Yes | No | No |
| getContentStatus | contentStatus | Yes | Yes | No |
| showMediaDisplay | mediaDisplayAck | Yes | No | No |
| hideMediaDisplay | mediaDisplayAck | Yes | No | No |
| getContentLogStatus | contentLogStatus | Yes | Yes | Yes |
| getContentLog | contentLogList | Yes | Yes | Yes |

This getMediaDisplayProfile command may be used by a host to request the current profile of a media display device from the gaming device. A mediaDisplayProfile command may be generated in response to the getMediaDisplayProfile command. The mediaDisplayProfile command may be used by a gaming device to report the current profile of the media display device. The profile may contain the protocol-related configuration option selections for the media display device. The options that can be configured may be set locally at the EGM, or remotely via a configuration server using commands within the optionConfig class. Some items in the profile may not be configured remotely.

The mediaDisplayProfile command may have a number of attributes. The mediaDisplayPosition attribute may be used to convey the general location of the media display device. The mediaDisplayPosition used in conjunction with the contentWidth and contentHeight may give the host information on how the content for the mediaDisplay device is to be authored. If the gaming device allows the host to configure media display devices, several other attributes may be needed so the host can control the position and size of the media display device. xPosition and yPosition may be used to indicate the coordinates of the upper left corner of the media display device, but may not be required to be exposed by the gaming device. MediaDisplayWidth and mediaDisplayHeight may be used to indicate the actual size of the mediaDisplay on the screen and may also not be required to be exposed by the gaming device.

MediaDisplayWidth and mediaDisplayHeight may be equal to contentHeight and contentWidth, respectively but they do not have to be. For example, the mediaDisplayWidth and mediaDisplayHeight may be 100 and 100, respectively, but due to gaming device's implementation of the mediaDisplay device, the ideal content width and height may be 50×50 (contentWidth=50 and contentHeight=50). The ideal content with may be associated with the contents native size where sizes other than the native size may require scaling.

Additional attributes of the mediaDisplayProfile that be utilized are described in the following table, which are provided for the purpose of illustration.

TABLE 1.2 mediaDisplayProfile Attributes

| Attribute | Restrictions | Description |
|---|---|---|
| configurationId | type: configurationId<br>use: optional<br>default: 0 | MediaDisplay configuration identifier. |
| configDateTime | type: dateTime<br>use: optional<br>default: <null> | Date and time that the configuration of the device was last changed. May be set when changes are applied locally via operator configuration at the gaming device or remotely via the commConfig or optionConfig classes. |
| configComplete | type: boolean<br>use: optional<br>default: true | May indicate whether the configuration of the device is complete. If the configComplete attribute is set to false then the gaming device may be required to set the egmEnabled attribute of the device to false. |
| restartStatus | type: boolean<br>use: optional<br>default: true | May indicate the state of hostEnabled when the gaming device restarts. |
| useDefaultConfig | type: boolean<br>use: optional<br>default: false | May indicate whether the default configuration for the device is required to be used when the gaming device restarts. |
| requiredForPlay | type: boolean<br>use: optional<br>default: false | May indicate whether gaming device is required to be disabled if either egmEnabled or hostEnabled is set to false. |
| minLogEntries | type: int<br>use: optional<br>minIncl: 1<br>default: 35 | May indicate the minimum number of log entries that the gaming device may be required to maintain in persistent memory. The minLogEntries attribute may also limit the total number of pending, loaded, and executing content files that can may be on the gaming device at a particular time. |
| timeToLive | type: timeToLive<br>use: optional<br>default: 30000 | May specify a maximum time allowed by the gaming device before commands requiring acknowledgements by the host are retried. |
| mediaDisplayPriority | type: int<br>use: optional<br>default: 1<br>minIncl: 1 | May denote the priority associated with this media display device related to the other available media display devices that share the same screenType. A value of 1 may be the highest priority. |
| screenType | type: extensibleList | Screen type |
| screenDescription | type: string<br>use: optional<br>minLen: 0<br>maxLen: 64<br>default: "Game Screen" | May be a human readable description of the screen on which the media display device is to be displayed. |
| mediaDisplayType | type:<br>use: optional<br>default: IGT_scale | May describe the behavior with relation to what is already being displayed on the screen, i.e., whether the size or position of the media display device may be adjusted when other media display devices are present. |
| mediaDisplayPosition | type:<br>use: optional<br>default: IGT_left | May specify the position of the mediaDisplay on the screen |

TABLE 1.2-continued

| mediaDisplayProfile Attributes | | |
|---|---|---|
| Attribute | Restrictions | Description |
| mediaDisplayDescription | type: string<br>use: optional<br>minLen: 0<br>maxLen: 64<br>default: "Media Display" | May be human readable description that relates to this instance of the mediaDisplay class. |
| maxContentLoaded | type: int<br>use: optional<br>default: 1 | May be the maximum content files that may be loaded simultaneously for the media display device. |
| xPosition | type: int<br>minIncl: −1<br>use: optional<br>default: −1 | May be the distance from the left edge of the screen where the media display device window may be located. A value of −1 may indicate that the gaming device doesn't expose this value to the host. |
| yPosition | type: int<br>minIncl: −1<br>use: optional<br>default: −1 | May be the distance from the top edge of the screen where the window associated with the media display device is to be located. A value of −1 may be used to indicate that the gaming device doesn't expose this value to the host. |
| contentHeight | type: int<br>use: optional<br>default: 1024 | May be a recommended height to which the content should be authored. |
| contentWidth | type: int<br>use: optional<br>default: 256 | May be recommended width to which the content is best authored. |
| mediaDisplayHeight | type: int<br>use: optional<br>default: −1 | May be a height of the media display device on the screen. A value of −1 may indicate that the gaming device doesn't expose this value. |
| mediaDisplayWidth | type: int<br>use: optional<br>default: −1 | May be a width of the media display device on the screen. A value of −1 may indicates that the gaming device doesn't expose this value. |
| touchscreenCapable | type: boolean<br>use: optional<br>default: true | May indicate whether the media display device can receive touch screen input. |
| localConnectionPort | type: int<br>use: optional<br>default: 15151<br>minIncl: 1023 | May be the port number that is available to make a local socket connection. If value is set to 1023 then a local connection may be disabled. |
| audioCapable | type: boolean<br>use: optional<br>default: true | May indicate whether the media display device can play audio. |

Table 1.3 provides a number of elements that may be provided within the context of the mediaDisplayProfile command. Details of each item that may be provided with each list and their functions are described following Table 1.3.

TABLE 1.3

| mediaDisplayProfile Elements | | |
|---|---|---|
| Element | Restrictions | Description |
| capabilitiesList | minOcc: 1<br>maxOcc: 1 | May be a list of features that the media display device may be capable of supporting. |
| localEventList | minOcc: 0<br>maxOcc: 1 | May be a list of events that the gaming device is capable of supporting for the media display device. |

TABLE 1.3-continued

| mediaDisplayProfile Elements | | |
|---|---|---|
| Element | Restrictions | Description |
| localCommandList | minOcc: 0<br>maxOcc: 1 | May be list of commands associated with the media display device that the gaming device is capable of supporting. |
| screenList | minOcc: 0<br>maxOcc: 1 | May be a list of screens on which the gaming device is capable of supporting media display devices. |

The capabilitiesList may include a number of capability items. The capability items may be used to describe the formats of content that the media device is able to display. Each capability item may include a type of software that is supported, such as flash player, a version number associated with the software and a file Extension, such as ".swf." In one embodiment, the media display device may be required to use the capabilityItem whose fileExtension matches the file extension of the file specified in the mediaURI of the loadContent command. For this embodiment, the fileExtension attribute may be required to be unique and the same file extension may not be used for two different combinations of software type and version.

The localEventList may include local event items. Each item may be an event that the gaming device is capable of supporting for the media display device. The localEventList may contain all of the events that the gaming device supports.

The localCommandlist may include local commands that the gaming device is capable of supporting for the media display device. Each item may be a command that the content executing in the media display device is allowed to call. In one embodiment, this list may only include commands that the content may originate.

The screenList may contain all of the screens on which a host may configure a media display device. Each screen may be listed as a screenItem in the list and a number of attributes may be associated with the screenItem, such as but not limited to a screen type, description, width (screenWidth variable) and height (screenHeight variable)). The screenWidth and screenHeight may be expressed in the same units as the mediaDisplayWidth and mediaDisplayHeight variables.

The setMediaDisplayState command may be used by a host to enable or disable the media display device for a gaming device. In one embodiment, only the owner of the device may execute this command. As described above owner and guest may designate access and configuration privileges associated with the media display device. A mediaDisplayStatus command may be generated in response to a setMediaDisplayState command.

If the host has sufficient privileges, the media display device may be disabled at any time by the host. If the mediaDisplay device is disabled while content is executing, gaming device may hide the media display device and then release any pending, loaded, or executing content. While the media display device is disabled, the gaming device may load any content for the media display device and may keep it hidden. In this state, the gaming device may deny any loadContent requests.

The mediaDisplayStatus command may include an attribute that allows a message to be displayed when the media display device is disabled. The text message contained in the disableText attribute may become eligible for display when the device becomes disabled—that is, following the event "Device Disabled by Host." The text message may no longer eligible for display once the device is re-enabled—that is, following the event, "Device Not Disabled by Host." The text message may be superseded by a subsequent setMediaDisplayState command for the same device. If the text message is empty, the text message may not be displayed.

The getMediaDisplayStatus command may be used by a host to request the current status information for a media display device from a gaming device. The mediaDisplayStatus command is generated in response to the getMediaDisplayStatus command. The mediaDisplayStatus command may be used by the gaming device to send the current status of the media display device to a host. The mediaDisplayStatus command may be generated in response to the setMediaDisplayState and getMediaDisplayStatus. Attributes of this command are described in the following table.

TABLE 1.4 mediaDisplayStatus Attributes

| Attribute | Restrictions | Description |
|---|---|---|
| configurationId | type: configurationId<br>use: optional<br>default: 0 | May be a configuration identifier set by the host. |
| configDateTime | type: dateTime<br>use: optional<br>default: <null> | May be a date and time that the configuration of the device was last changed. Set when changes are applied locally via operator configuration at the gaming device or remotely via the commConfig or optionConfig classes. |
| configComplete | type: boolean<br>use: optional<br>default: true | May indicate whether the configuration of the device is complete. If the configComplete attribute is set to false then the EGM may set the egmEnabled attribute of the device to false. |
| egmEnabled | type: boolean<br>use: optional<br>default: true | Indicates whether the device is enabled by the gaming device. |
| hostEnabled | type: boolean<br>use: optional<br>default: true | May indicate whether the device is enabled by the host. |
| hostLocked | type: boolean<br>use: optional<br>default: false | May indicate whether the gaming has been locked out from play by the media display device host. |
| transactionId | type: transactionId<br>use: optional<br>default: 0 | May be transaction identifier of the content that is currently active. May be set to zero if no content is active. |
| contentId | type:<br>use: optional<br>default: 0 | May be content identifier of the content that is currently active. May be set to zero if no content is active. |

TABLE 1.4-continued

| mediaDisplayStatus Attributes | | |
|---|---|---|
| Attribute | Restrictions | Description |
| deviceVisibleState | type:<br>use: optional<br>default: IGT_hidden | May describe the state of the media display device at the time the command was processed, i.e., shown or hidden. |

The setMediaDisplayLockOut command may be used by a host to lockout a gaming device. Attributes of this command include lockout indicating the gaming device is to be locked out, lockText, which is a text message to display when the gaming device is locked out and lockTimeOut, which a maximum time to lockout the device. In one embodiment, only the owner of the device may execute this command. The mediaDisplayStatus command may be generated in response to setMediaDisplayLockOut. While the EGM is locked out, the text message generated with this command may be displayed if the EGM has sufficient resources to do so. If the content is fullscreen, then this text message may not be displayed.

The loadContent command may direct the gaming device to load the specified content into the media display device. This command does not change the deviceVisibleState, i.e., shown or hidden. The contentStatus may be generated immediately after receiving the loadContent command, the contentState may be set to pending and a content pending event may be generated. Once the content has been loaded, the contentState may be set to "loaded" and a "content loaded" event may be generated. The contented, mediaURI and mdAccessToken parameters may be aspects of the loadContent command.

The transactionId and contentId pair may be used to uniquely identify the loaded content from the loadContent command through releaseContent. The EGM may be required to generate a new transactionId and create a new log entry when the loadContent command is called. If the EGM cannot load the requested content because the number of content files loaded is equal to maxContentLoaded an error indicating that content needs to be released may be generated. If a host sets the contentId to a value that is the same of content that is not finalized then an invalid contentId/transactionId error may be generated.

A media URI may specify the location of the media file to load. The mediaURI may be a well formed URI as defined by W3C in the anyURI definition (http://www.w3.org/TR/xmlschema-2/#anyURI). The media URI (uniform resource locator) is a string of characters is a compact string of characters used to identify or name a resource on the Internet.

If the gaming device cannot load the requested content because the content file is too large for the gaming device to load due to platform limitation, a content error event is generated and the contentException variable may be set to indicate that the content exceeds file size limitations. In particular embodiments, if the power is cycled on the gaming device, all content may be unloaded and the contentState in the log entry corresponding to each contentId and transactionId may be set to a variable indicating the content has been released. The contentReleasedDateTime may be set to the time that the log entry is updated as soon as the gaming device restarts.

The mdAccessToken parameter may be a randomly generated token used to ensure that only authorized content is loaded and can have access to the media display device on the gaming device. In one embodiment, setting the mdAccessToken parameter to 0 disables the local connection. The host may pass this token as a variable to the content in the mediaURI attribute. The mdAccessToken may be unique for all media display devices provided on a gaming device. If the loadContent command is received with an mdAccessToken that is currently in use by content loaded in another media display device on the same gaming device, an invalid mdAccessToken error may be generated.

The releaseContent command may be used to direct the gaming device to free the content associated with a specified contentId. The contentStatus command may be generated in response to the releaseContent command. If the gaming device, such as an EGM, receives this command with a contentId that does not match the contentId of any of the content that is currently contained in the log and not finalized it may generate an invalid contentId/transactionId error. If the content entry in the log has been finalized the gaming device may respond with an error condition indicating the content is not loaded.

The releaseContent command may also be used to disconnect all local connections between content, the gaming device and local servers hosting the content. Thus, the command may result in all settings to the local connection being deleted. The gaming device may also invalidate the mdAccessToken associated with the content and not allow any future connections to use that mdAccessToken unless it is configured again using the loadContent command. If the content being released is the active content of a media display device and the content is currently being shown, then the media display device may be closed prior to releasing the content.

The setActiveContent command may be used to specify which content is to be active in the media display device. In one embodiment, content may be required to be activated on a device before the content is shown with the showMediaDisplay command. The contentStatus command may be generated in response to the setActiveContent command. If the gaming device receives this command with a contentId and transactionId that does not match the contentId and transactionId of any of the content that is currently contained in the log and isn't finalized, it may respond with the error indicating an invalid contentId/transactionId. If a host attempts to activate content that does not have a contentState of 'loaded' or 'executing' and error condition indicating that the content is not Loaded error may be generated.

The contentStatus command may be generated in response to the getContentStatus command. The getContentStatus command may be used to get the current status of content identified by the contentId and transactionId pair. If the EGM receives this command with a contentId and transactionId that does not match the contentId and transactionId of any of the content that is currently in the log and isn't finalized, it responds with the error "Invalid contentId/transactionId."

The showMediaDisplay command may be used by the host to make a media display device visible. The mediaDisplayAck command may be generated in response to the showMediaDisplay command. The MediaDisplayPriority variable in the device profile denotes how the media display device is to interact with other media display devices already showing on the screen. As described above, if a host attempts to show content that does not have a contentState of 'executing,' an error condition indicating the host to activate content before showing in the media display device error may be generated and the media display device may remains hidden. If the deviceVisibleState is set to shown when the command is received, the mediaDisplayAck may be generated, but the deviceVisibleState may not be affected.

The hideMediaDisplay command may be used by the host to hide an active media display device. The mediaDisplayAck command may be generated in response to the hideMediaDisplay command. If the deviceVisibleState is set to 'hidden,' i.e., it is already hidden, the mediaDisplayAck may be generated, but the deviceVisibleState may not be affected. The mediaDisplayAck command returns the transactionID/ContentID pair and the state of the media display device, i.e., shown or hidden.

The getContentLogStatus command may be used by the host to request the current status of the log associated with at least one media display device from the gaming device. The response may include the sequence number of the last transaction and the total number of transactions in the log. A contentLogStatus may be generated in response to a getContentLogStatus command. The getContentLog command may be used by the host to request the contents of a transaction log from a gaming device. The contentLogList command may be generated in response to the getContentLog command. This command is used by the gaming device to send the contents of the content log to a host. The contentLogList command may be generated in response to the getContentLog command. Each contentLog may span the life of the content from when it is loaded by the loadContent command to when it is released by the releaseContent command or an error occurs. A list of attributes of the content log for one embodiment, are described in the following table.

TABLE 1.5 contentLog Attributes

| Attribute | Restrictions | Description |
|---|---|---|
| logSequence | type: logSequence<br>use: required | May be unique log sequence number assigned by the gaming device to the log entry. |
| deviceId | type: deviceId<br>use: required | deviceId for the media display device |
| transactionId | type:<br>use: required<br>minIncl: 1 | Transaction identifier that the gaming device has assigned to the content. |
| contentId | type: identifier string<br>use: required<br>minIncl: 1 | Content identifier assigned by the host. |
| mediaURI | type: anyURI<br>use: required<br>minLen: 0<br>maxLen: 256 | Location of the content assigned by the host. If there is a '?' in the mediaURI, the gaming device may only report the string before the '?'. |
| contentState | type:<br>use: required | Describes the current state of the content. |
| contentLoadedDateTime | type: dateTime<br>use: optional<br>default: <null> | Date and time that the content was successfully loaded by the mediaDisplay device. |
| contentReleasedDateTime | type: dateTime<br>use: optional<br>default: <null> | Date and time that the content was successfully released by the mediaDisplay device. |
| contentException | type:<br>use: optional<br>default: 0 | Exception code associated with the contentState. may be provided when the contentState indicates an error condition. |

As described above, various fault conditions may disable a media display device. The egmEnabled and egmState attributes may both be determined from multiple factors. If all of the faults for a media display device have been cleared then the egmEnabled attribute for the device may be set to 'true.' If any one fault still exists then the egmEnabled attribute may be set to 'false.' Thus, after a fault is cleared, the gaming device may evaluate all of the attributes that contribute to the state of the egmEnabled attribute. If anyone of them shows a fault then the egmEnabled attribute may remain false.

Likewise, the egmState attribute of the cabinetStatus (status of the gaming device as opposed to the media display device) may reflect the aggregate state of all devices in the gaming device. If the requiredForPlay attribute in the profile of a device is set to true then if either the egmEnabled or hostEnabled attribute of the device is set to false, the egmState may reflect that the gaming device is disabled. Similarly, if the egmLocked or hostLocked attribute of a device is set to 'true' then the egmState may reflect that the gaming device is locked out. If any one device is in such a state then the egmState may reflect that the gaming device is disabled or locked out, as appropriate. Thus, after a device has been enabled or a lockout has been cleared, the gaming device may evaluate the state of all active devices within the gaming device to determine the proper value of the egmState attribute. At the same time, the deviceClass and deviceId attributes of the cabinetStatus may be updated to reflect the appropriate device.

Resource Allocation

FIG. 5 is a block diagram showing hardware and software components and their interactions on a gaming machine for embodiments of the present invention. In embodiments of the present invention, the operating system may maintain "resource partitions." A resource partition may be logical abstraction implemented in the operating system logic that enables the operating system to monitor and limit the resources used by all of the process or process threads executing in each resource partition. At any given time, a resource partition may include one or more member processes or member process threads. For example, in one embodiment of the present invention, a QNX operating system (Ottawa, Canada) may be employed. With QNX, each thread of execution may be individually assigned to a different resource partition. Thus, one process may have several threads each running in different partitions. In general, the operating system may be a POSIX compliant operating system, such as Unix and Linux variants, Windows™ NT, 2000, XP, Vista, etc.

Resource partitioning is one example or aspect of virtualization. Virtualization is the process of presenting a logical grouping or subset of computing resources so that they can be accessed in ways that give benefits over the original configuration. In particular, virtualization may provide techniques for hiding the physical characteristics of computing resources from the way in which other systems, applications, or end users interact with those resources. These techniques may include making a single physical resource (such as a server, an operating system, an application, or storage device) appear to function as multiple logical resources; or it can include making multiple physical resources (such as storage devices or servers) appear as a single logical resource. Virtualization may refer to the abstraction of resources in many different aspects of computing and may include virtual machines and systems management software. Thus, the examples of resource partitioning and other virtualization examples are provided for illustrative purposes only and are not intended to limit the invention to virtualizations providing only resource partitioning or the other examples of virtualization mentioned herein.

As noted above, threads may be assigned to different partitions in some embodiments of the present invention. A thread may be short for a thread of execution. Threads are a way for a program to split itself into two or more simultaneously (or pseudo-simultaneously) running tasks. Threads and processes differ from one operating system to another, but in general, the way that a thread is created and shares its resources may be different from the way a process does.

Multiple threads may be executed in parallel on many computer systems. This multithreading may be provided by time slicing, where a single processor switches between different threads, in which case the processing is not literally simultaneous, for the single processor is only really doing one thing at a time. This switching can happen so fast as to give the illusion of simultaneity to an end user. For instance, a typical computing device may contain only one processor, but multiple programs can be run at once, such as an ECI for player tracking alongside an a game program; though the user experiences these things as simultaneous, in truth, the processor may be quickly switching back and forth between these separate threads. On a multiprocessor system, threading can be achieved via multiprocessing, wherein different threads can run literally simultaneously on different processors.

In embodiments of the present invention, multiprocessor systems with multiple CPUs may be used in conjunction with multiprocessing. For example, an ECI process or ECI thread may be executed on one or more CPUs while a game is executed on one or more different CPUs. In a particular embodiment, in a multiprocessor system, CPU accessibility may be limited according to the application. For instance, ECI's may be only executed on certain processors and games on other processors. The ECI's may be prevented from utilizing processors dedicated to executing games or other applications.

Threads are distinguished from traditional multi-tasking operating system processes in that processes are typically independent, carry considerable state information, have separate address spaces, and interact only through system-provided inter-process communication mechanisms. Multiple threads, on the other hand, typically share the state information of a single process, and share memory and other resources directly. Although, as noted above, threads of the same process may be assigned to different resource partitions. Context switching between threads in the same process may be typically faster than context switching between processes.

In general, the term, "process" refers to a manipulation of data on a device, such as a computer. The data may be "processed" in a number of manners, such as by using logical instructions instantiated in hardware, by executing programming logic using a processor, or combinations thereof. Thus, a "process" for the purposes of this specification may describe one or more logical components instantiated as hardware, software or combinations thereof that may be utilized to allow data to be manipulated in some manner. Therefore, the terms "process" and "process thread" as described are provided for the purposes of clarity only and are not meant to be limiting.

Four resource partitions, 360, 366, 368 and 370 are illustrated in FIG. 5. An operating system resource partition 360 that includes processes (or process threads) executed by the operating system. A game resource partition 366 from which game processes (or process threads) are executed. An ECI resource partition 382 from which a first ECI process 382 (or ECI process thread) may be executed and an ECI resource partition 368 from which a second ECI process 380 (or ECI process thread) may be executed. As noted above, resource partitioning may be performed at the process level, the process thread level or combinations thereof.

In one embodiment, resource partition definitions 308, such as resources allocated to each resource partition and processes that are enabled to execute in each partition (e.g. partition assignments 310) may be stored in the secure memory 326. Data stored in the secure memory may have been authenticated using the authentication components 304 stored on the Boot ROM 302. When a process is launched by the operating system, it may check to see which resource partition to assign the process using the partition assignments 310, which may include a list of processes that may be executed in each partition. In one embodiment, some processes may be assigned to more than one resource partition. Thus, when the resources associated with a first resource partition are being fully utilized, the process may be executed from a second resource partition with available resources.

In another embodiment, the partition assignment information may be stored with each executable image, such as images, 316, 318 and 320. When a process or process thread is launched, the operating system may determine which partition to assign the process or the process thread (In general, each process will have at least one process thread). With this method, new executable images may be downloaded to the gaming machine from a remote device that are not listed in the partition assignments 310 and still be assigned to a resource partition.

In a particular embodiment, the operating system may only allow one ECI process or ECI process thread to execute in a partition at one time. In other embodiments, a plurality of ECI processes may be executed from a single partition at one time. When only a single ECI process is allowed to execute from a partition at one time, the amount of resources available to the ECI process occupying the partition may be more predictable. This type of architecture may be valuable when ECI's are provided from two or more different hosts simultaneously where each remote host doesn't necessarily know the resource requirements utilized by an ECI from another remote host. When two or more ECIs are allowed to occupy a single partition and execute simultaneously, the resources provide to each ECI, respectively, may be more vary more if each respective ECI is competing for a limited amount of resources.

The resource competition may be become more acute when the resources needed by two or more ECIs are near or greater than one or more resources (e.g., CPU cycles or memory) provided in a partition. In some embodiments, the gaming machine may prioritize resource utilization by each ECI process. For instance, an execution priority may be assigned to each ECI process executing in a resource partition such that based on the priority one ECI process is favored over another ECI process when they are both competing for resources.

The priority assigned to each ECI process may be based on another factors. A priority to resources may be assigned to an ECI process based upon its function. For instance, an ECI for providing a bonus interface may be given a higher priority to resources than an ECI for providing advertising. In another embodiment, a priority may be assigned to an ECI process in accordance with a price paid to allow the ECI process and its content to be presented on the gaming device. In general, prioritization for utilizing resources is another way of providing virtualization on a gaming device.

Resources that may be monitored and limited for each partition include but are not limited CPU usage, memory usage, such as RAM usage, NV-RAM usage, disk memory usage, etc., GPU (graphics processing usage), network bandwidth, sound card usage and access to gaming devices, such as displays, audio devices, card readers, bill validators. Resources that may be monitored on the gaming machine 300 include the executable space 338, the processing devices 348, the gaming devices 358 and the secure memory 326. The local resource metering process 238 may monitor resource usage for each partition. In FIG. 5, the local resource metering process 238 is shown monitoring, device A, device B, network bandwidth usage, processor usage of processors, 340 and 342, power usage, and memory usage.

The local resource metering process 238 may report information to the resource partition manager 256. In particular embodiments, based upon limits placed on each resource partition, the resource partition manager 256 may prevent new processes from executing in a particular resource partition or may even terminate certain processes to free up resources processes executing in other partitions. For example, if the output of the game on the gaming machine 300 is less than optimal because of the resources utilized by the ECI 380 or ECI 382, the gaming machine may suspend execution or terminate execution of one or both of the ECI 380 or ECI 382.

In particular embodiments of the present invention, prior to enabling a remote host to control an ECI on the gaming machine 300 and based on its resource partitioning system, the gaming machine 300 may notify the remote host of information regarding the resources it may have available to use while the ECI it wishes to control is executing on the gaming machine 300. In one embodiment, the remote resource manager 230 may report this information to the remote host. In another embodiment, the gaming machine may broadcast its available resources to a plurality of remote hosts that may control an ECI on the gaming machine 300. These messages may be broadcast at regular intervals and change depending on a current resource utilization on the gaming machine.

The resource information may include information regarding an upper limit of resources that may be available (e.g., a maximum of 10% CPU usage, 100 MB of RAM), a lower limit of resources that may be available (e.g., a minimum of 5% CPU usage, 50 MB of RAM, no audio capabilities), a prediction of a range of resources that may be available over time (e.g., at least 400×300 pixel window with periodic access to a 1600×1200 pixel window and at least 4 channels of 32 channel sound card with periodic access to all channels), a prediction of platform performance based on the available resources (e.g., an output frame rate of 25 frames per second at 60 Hz screen refresh rate using 16 bits of color). An upper and lower limit of resources may be provided because the resources available on the gaming machine may change with time while an ECI is executing.

Additional partitioning information may include a display mode, such as a translucent overlay of the game screen or a display location (e.g., left third of the display screen). Further, information sent to the remote host may include game theme, graphics and sound information currently executing on the gaming machine 300. The remote host may utilize this information to customize content for an ECI executing on the gaming machine 300 that is thematically consistent with a game executing on the gaming machine 300.

In addition, the gaming machine may send file information to the remote host information regarding files, such as application files executed by an ECI, stored in the resource partitions. The files may have been previously downloaded from the remote host or a different remote host at an earlier. One or more files or information/data/commands within the one or more files may be of use to the remote host and thus, the remote host may structure a download based on the file information. For instance, the remote host may download files/data/content that is only needed in addition to the files/data/content already stored on the gaming machine.

In response to the resource information it receives from the gaming machine, the remote host may determine whether the resources are adequate to output the content it wishes to present on the gaming machine via the ECI. In some embodiments, the remote host may adjust the content to output via the ECI to account for the available resources. For instance, when resources are limited, pre-rendered images, 2-D graphics or vector-based graphics may be used instead of dynamically rendered 3-D graphics. As another example, if network traffic is high, such that the network bandwidth is limited, the remote host may reduce the amount of data sent to gaming machine. Details of graphical related apparatus and methods that may be utilized in embodiments of the present invention are described with respect to U.S. Pat. No. 6,887,157, filed Aug. 9, 2001, by LeMay, et al., and entitled, "Virtual Cameras and 3-D gaming environments in a gaming machine," which is incorporated herein and for all purposes.

In a particular embodiment, the remote host may request additional resources than the gaming machine 300 has said are available. In response, the gaming machine 300 may temporarily create a resource partition, such as 370 or 368, or another type of virtualization (e.g., a virtual machine) that enables the remote host to access the additional requested resources while the ECI is executed. In other embodiments, the resources available on the gaming machine may not be suitable for the content that the remote host has available and the remote host may decide not to control an ECI, such as 382 or 380.

One advantage of using a virtualization, such as resource partitions, may be that a remote host in control of an ECI on a gaming machine may be enabled to control of resources while guaranteeing adequate game performance. A gaming machine operator always wants a game player to be presented with a quality game experience including presentations with desirable graphics and sounds. If providing access to gaming machine resources via an ECI results in an excessive degradation of the game experience (e.g., the graphics become jagged or jumpy), then sharing of gaming resources using an ECI would not be desirable. New gaming machine are becoming increasingly powerful in their capabilities. The use of ECIs in combination with resource partitioning enables under utilized gaming machine resources to be used in an effective manner while insuring that a quality game experience is always is provided to a game player.

Another advantage of using a virtualization, such as resource partitions, may be that testing requirements related to the development of game software and ECI software may be simplified. One method of ensuring a quality game experience is maintained on a gaming device while a game process for generating a game is executing on the gaming device while one or more ECI processes are executing is to extensively test the one or more ECI processes and game process under a variety of conditions. Testing every possible ECI process in combination with one or more possible ECI process in conjunction with every different game variation quickly becomes very unattractive in terms of both cost and time.

Using virtualization, where the maximum resources allowed to be utilized by one or more ECI processes are prevented from exceeding a set limit, the gaming software for generating a game on the gaming machine may be tested where a maximum resource utilization allowed for the one or more ECI processes is simulated while the game is being executed. The game may be tested under a variety of operational conditions, such as when it is using a maximum number of CPU cycles or graphic processor cycles, to ensure that the generated game is adequate at the maximum resource utilization condition allowed for the one or more ECI processes. After the testing, it may be concluded that the game performance will be adequate for any combination of one or more ECI processes using up to the maximum allowable resources for the ECIs. Thus, new ECI processes may be developed after the game is released without having to test the performance of the game in combination with each new ECI.

In addition, each ECI process may be tested to determine whether they perform adequately under various resource conditions up to the maximum resources allowed for a single ECI on a gaming device. This process may allow ECI developers to develop and test ECIs and associated content that are appropriate for different resource ranges up to the maximum allowed resources without needing to test them in combination with each possible game. Further, the developer may develop multiple ECIs and associated content to perform a particular function using different amount of resources with the knowledge that each ECI will perform adequately after testing. For example, a first ECI may use vector graphics to provide an animation, which requires less memory and allows for a faster download time, as compared to a second ECI that uses pre-rendered bitmaps to provide the animation where the function of the first and second ECI are the same.

As described above, in regards to virtualization, the present invention is not limited to resource partitioning. Other examples of virtualization that may be employed in embodiments of the present invention are described as follows. Via Intel's Virtualization Technology (or the corresponding AMD technology), these microprocessor vendors have introduced features in their micro-architectures that may improve the processor's ability to run multiple operating systems and applications as independent virtual machines. Using this virtualization technology, one computer system can appear to be multiple "virtual" systems. Thus, in various embodiments, a gaming environment utilizing virtual gaming machines where the operating systems may vary from virtual gaming machine to virtual gaming machine may be employed. In a particular embodiment, a virtual gaming machine may use a core of a multi-core processor.

A virtual gaming machine may use a virtual machine monitor (VMM) A virtual machine monitor may be a host program that allows a single computer to support multiple, identical execution environments. All the users may see their systems as self-contained computers isolated from other users, even though every user is served by the same machine. In this context, a virtual machine may be an operating system (OS) that may be managed by an underlying control program.

Low interrupt latency, direct access to specialized I/O, and the assurance that a VMM won't "time slice away" the determinism and priority of real-time tasks may be important for a real-time virtual gaming machine used in a gaming environment. In one embodiment of the present invention, the combination of multi-core CPUs and Intel VT or a related technology may be used to build a real-time hypervisor based on dynamic virtualization.

A real-time hypervisor may be a VMM that uses hardware virtualization technology to isolate and simultaneously host general-purpose operating systems and real-time operating systems. Unlike a static virtualization, the dynamic virtualization implemented by a real-time hypervisor may use an "early start" technique, to take control of the hardware platform. Thus, operating systems may only be allowed to "boot" only after the real-time hypervisor has constructed a virtual machine for them. The guest operating system may be associated with a particular game provided by a software provider. Thus, in the present invention, a gaming platform may support games provided by multiple software vendors where different games may be compatible with different operating systems.

In the processors that include Intel VT an overarching operating-mode has been added, called VMX root, where a hypervisor executes with final control of the CPU hardware. A hypervisor that uses Intel VT may intercept key supervisor-mode operations executed by any software operating outside of VMX root without requiring a prior knowledge of the guest OS binaries or internals. Using this Intel VT hardware assist for virtualization, one may build a hypervisor VMM that hosts protected-mode operating systems executing in ring 0 without giving up control of key CPU resources. Also, Intel VT provides a way for the VMM to implement virtual interrupts.

In the present invention, static and dynamic virtualization may be used. Nevertheless, two advantages to building a multi-OS real-time system by using dynamic virtualization rather than static virtualization may be: first, a wide range of operating systems, both general-purpose and real-time, may be supported and, second, the boot sequence for each guest OS may be under the control of the hypervisor. The second advantage means it may possible, in embodiments of the present invention, to restart one guest OS while other guest operating systems continue to run without interruption.

TenAsys provides an example of a hypervisor that may be used in embodiments of the present invention. The hypervisor may be capable of supporting the demands of a Real-time operating system (RTOS) while simultaneously hosting a general-purpose operating system (GPOS), like Windows or Linux. The hypervisor may enhance real-time application responsiveness and reliability in a "multi-OS, single-platform" environment, by providing control over interrupt latency and partitioning of I/O resources between multiple guest operating systems.

In various embodiments, the hypervisor may be used to distinguish between resources that may be multiplexed by the VMM and those that are exclusive to a virtual machine. For example, When user interface I/O is not associated with time-critical events, input devices like the keyboard, mouse, console, disk, and an enterprise Ethernet interface may be multiplexed and shared between all virtual machines. However, hardware that is specific to a real-time control application, such as a video capture card, fieldbus interface, or an Ethernet NIC designated for communication with real-time I/O devices, may not be multiplexed between virtual machines. Using the hypervisor, specialized real-time I/O may be dedicated to its real-time virtual machine, so the RTOS and application using that I/O can maintain real-time determinism and control.

In one embodiment of a VMM some or all of the memory in each virtual machine may be swapped to disk, in order to more efficiently allocate limited physical RAM among multiple virtual machines. In another embodiment, a real-time hypervisor may be used to guarantee that each real-time virtual machine is locked into physical RAM, and is never swapped to disk. This approach may be used to insure that every real-time event is serviced consistently, with deterministic timing. In yet another embodiment, the hypervisor may used to dedicate a core in a multi-core processor to a virtual machine, such as a virtual gaming machine.

Gaming Machine

Figure 6:
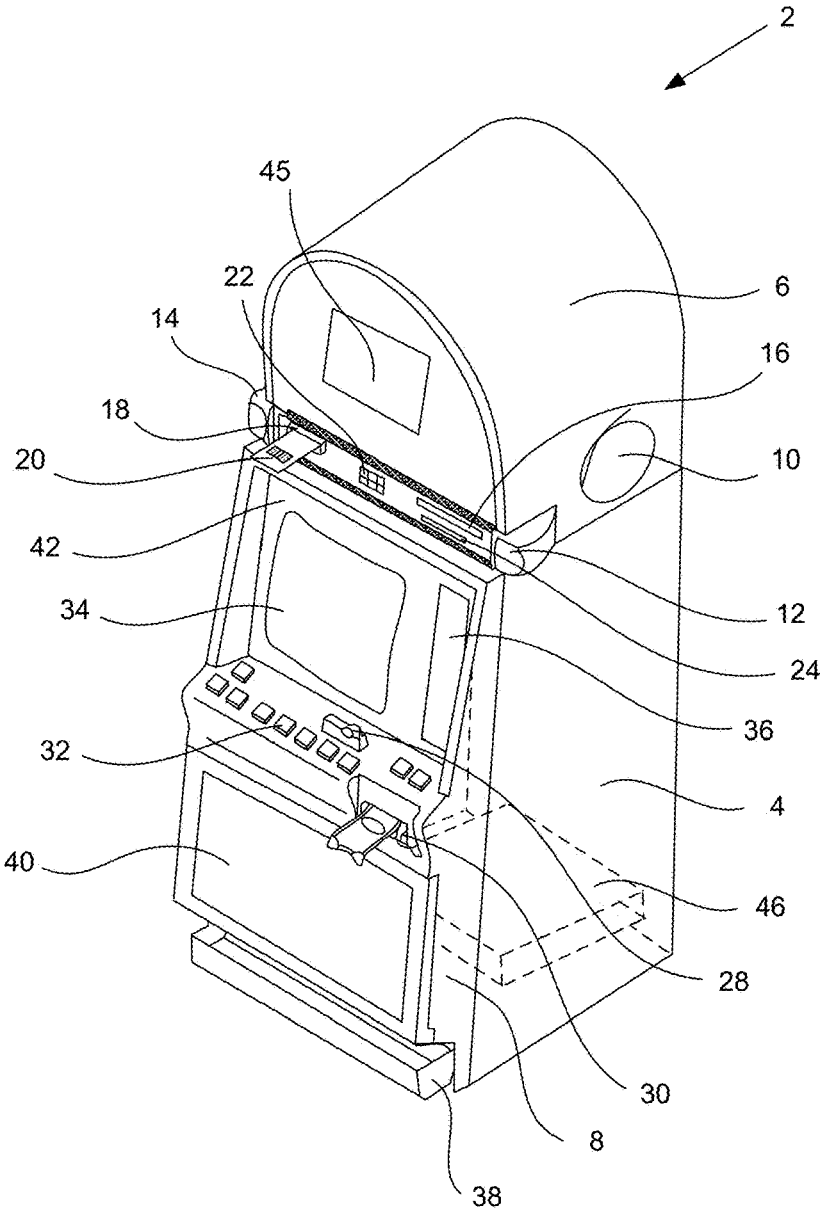
FIG. 6 illustrates a perspective view of one embodiment of a gaming machine.

FIG. 6 shows a perspective view of a gaming machine 2 in accordance with a specific embodiment of the present invention. The gaming devices and gaming functions described with respect to at least FIG. 6 may be incorporated as components of the ECI's and media display devices described above with respect to at least FIGS. 1 thru 5. Further, the gaming devices may be operated in accordance with instructions received from a remote host in communication with the gaming machine. In some instance, a host-controlled process executed on the gaming machine may share a gaming device with a process controlled by the master gaming controller 46 on the gaming machine.

As illustrated in the example of FIG. 6, machine 2 includes a main cabinet 4, which generally surrounds the machine interior and is viewable by users. The main cabinet includes a main door 8 on the front of the machine, which opens to provide access to the interior of the machine.

In one embodiment, attached to the main door is at least one payment acceptor 28 and a bill validator 30, and a coin tray 38. In one embodiment, the payment acceptor may include a coin slot and a payment, note or bill acceptor, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming machine. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming machine. In one embodiment, money may be transferred to a gaming machine through electronic funds transfer. When a player funds the gaming machine, the master gaming controller 46 or another logic device coupled to the gaming machine determines the amount of funds entered and displays the corresponding amount on the credit or other suitable display as described above.

In one embodiment attached to the main door are a plurality of player-input switches or buttons 32. The input switches can include any suitable devices which enables the player to produce an input signal which is received by the processor. In one embodiment, after appropriate funding of the gaming machine, the input switch is a game activation device, such as a pull arm or a play button which is used by the player to start any primary game or sequence of events in the gaming machine. The play button can be any suitable play activator such as a bet one button, a max bet button or a repeat the bet button. In one embodiment, upon appropriate funding, the gaming machine may begin the game play automatically. In another embodiment, upon the player engaging one of the play buttons, the gaming machine may automatically activate game play.

In one embodiment, one input switch is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input switch is a bet max button (not shown), which enables the player to bet the maximum wager permitted for a game of the gaming machine.

In one embodiment, one input switch is a cash-out button. The player may push the cash-out button and cash out to receive a cash payment or other suitable form of payment corresponding to the number of remaining credits. In one embodiment, when the player cashes out, the player may receive the coins or tokens in a coin payout tray. In one embodiment, when the player cashes out, the player may receive other payout mechanisms such as tickets or credit slips redeemable by a cashier (or other suitable redemption system) or funding to the player's electronically recordable identification card. Details of ticketing or voucher system that may be utilized with the present invention are described in co-pending U.S. patent application Ser. No. 10/406,911, filed Apr. 2, 2003, by Rowe, et al., and entitled, "Cashless Transaction Clearinghouse," which is incorporated herein by reference and for all purposes.

In one embodiment, one input switch is a touch-screen coupled with a touch-screen controller, or some other touch-sensitive display overlay to enable for player interaction with the images on the display. The touch-screen and the touch-screen controller may be connected to a video controller. A player may make decisions and input signals into the gaming machine by touching the touch-screen at the appropriate places. One such input switch is a touch-screen button panel.

In one embodiment, the gaming machine may further include a plurality of communication ports for enabling communication of the gaming machine processor with external peripherals, such as external video sources, expansion buses, game or other displays, an SCSI port or a key pad.

As seen in FIG. 6, viewable through the main door is a video display monitor 34 and an information panel 36. The display monitor 34 will typically be a cathode ray tube, high resolution flat-panel LCD, SED based-display, plasma display, a television display, a display based on light emitting diodes (LED), a display based on a plurality of organic light-emitting diodes (OLEDs), a display based on polymer light-emitting diodes (PLEDs), a display including a projected and/or reflected image or any other suitable electronic device or display. The information panel 36 or belly-glass 40 may be a static back-lit, silk screened glass panel with lettering to indicate general game information including, for example, a game denomination (e.g. $0.25 or $1) or a dynamic display, such as an LCD, an OLED or E-INK display. In another embodiment, at least one display device may be a mobile display device, such as a PDA or tablet PC, that enables play of at least a portion of the primary or secondary game at a location remote from the gaming machine. The display devices may be of any suitable size and configuration, such as a square, a rectangle or an elongated rectangle.

The display devices of the gaming machine are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like. In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia. In another embodiment, the display device may include an electromechanical device adjacent to a video display, such as a video display positioned in front of a mechanical reel. In another embodiment, the display device may include dual layered video displays which co-act to generate one or more images.

The bill validator 30, player-input switches 32, video display monitor 34, and information panel are gaming devices that may be used to play a game on the game machine 2. Also, these devices may be utilized as part of an ECI provided on the gaming machine. According to a specific embodiment, the devices may be controlled by code executed by a master gaming controller 46 housed inside the main cabinet 4 of the machine 2. The master gaming controller may include one or more processors including general purpose and specialized processors, such as graphics cards, and one or more memory devices including volatile and non-volatile memory. The master gaming controller 46 may periodically configure and/or authenticate the code executed on the gaming machine.

In one embodiment, the gaming machine may include a sound generating device coupled to one or more sounds cards. In one embodiment, the sound generating device includes at least one and preferably a plurality of speakers or other sound generating hardware and/or software for generating sounds, such as playing music for the primary and/or secondary game or for other modes of the gaming machine, such as an attract mode. In one embodiment, the gaming machine provides dynamic sounds coupled with attractive multimedia images displayed on one or more of the display devices to provide an audio-visual representation or to otherwise display full-motion video with sound to attract players to the gaming machine. During idle periods, the gaming machine may display a sequence of audio and/or visual attraction messages to attract potential players to the gaming machine. The videos may also be customized for or to provide any appropriate information.

In one embodiment, the gaming machine may include a sensor, such as a camera that is selectively positioned to acquire an image of a player actively using the gaming machine and/or the surrounding area of the gaming machine. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

In another embodiment, the gaming devices on the gaming machine may be controlled by code executed by the master gaming controller 46 (or another logic device coupled to or in communication with the gaming machine, such as a player tracking controller) in conjunction with code executed by a remote logic device in communication with the master gaming controller 46. As described above with respect to at least FIG. 1-5, the master gaming controller 46 may execute ECI processes that enable content generated and managed on a remote host to be output on the gaming machine. The gaming machine may receive and send events to a remote host that may affect the content output on an instantiation of a particular ECI. The master gaming controller 46 may be configured to limit the resources that can be utilized by the ECI processes executing on the gaming machine at any given time and may constantly monitor resources utilized by the ECI processes to ensure that gaming experience on the gaming machine is optimal.

Gaming System Components

Figure 7:
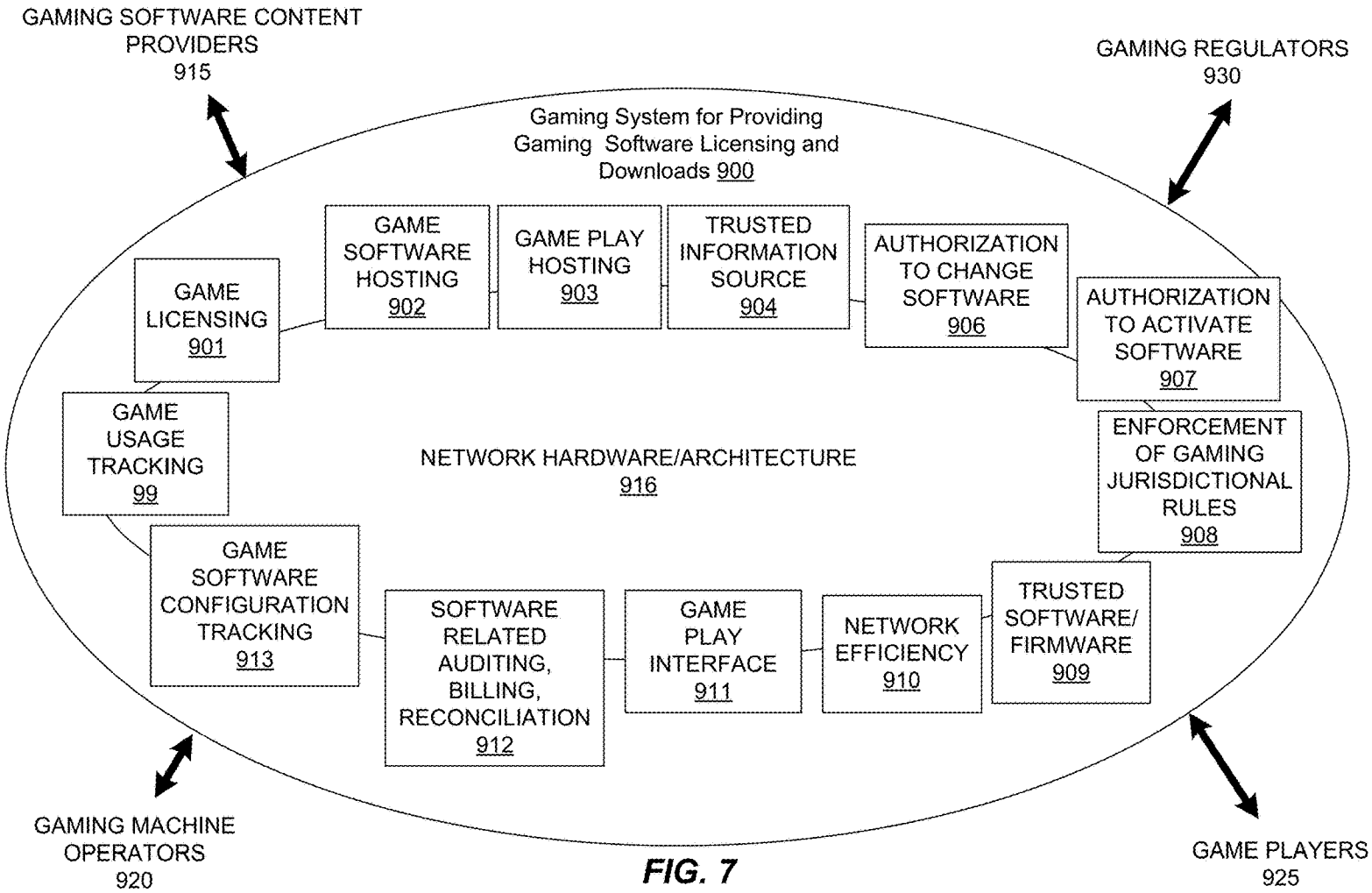
FIG. 7 illustrates a block diagram of a gaming system for embodiments of the present invention.

FIG. 7 shows a block diagram illustrating components of a gaming system 900 which may be used for implementing various aspects of the present invention. In FIG. 7, the components of a gaming system 900 for providing game software licensing and downloads are described functionally. The described functions may be instantiated in hardware, firmware and/or software and executed on a suitable device. In the system 900, there may be many instances of the same function, such as multiple game play interfaces 911. Nevertheless, in FIG. 7, only one instance of each function is shown. The functions of the components may be combined. For example, a single device may comprise the game play interface 911 and include trusted memory devices or sources 909. The described components and their functions may be incorporated various embodiments of the servers and clients described with respect to at least FIGS. 1A and 6.

The gaming system 900 may receive inputs from different groups/entities and output various services and or information to these groups/entities. For example, game players 925 primarily input cash or indicia of credit into the system, make game selections that trigger software downloads, and receive entertainment in exchange for their inputs. Game software content providers provide game software for the system and may receive compensation for the content they provide based on licensing agreements with the gaming machine operators. Gaming machine operators select game software for distribution, distribute the game software on the gaming devices in the system 900, receive revenue for the use of their software and compensate the gaming machine operators. The gaming regulators 930 may provide rules and regulations that must be applied to the gaming system and may receive reports and other information confirming that rules are being obeyed.

In the following paragraphs, details of each component and some of the interactions between the components are described with respect to FIG. 7. The game software license host 901 may be a server connected to a number of remote gaming devices that provides licensing services to the remote gaming devices. For example, in other embodiments, the license host 901 may 1) receive token requests for tokens used to activate software executed on the remote gaming devices, 2) send tokens to the remote gaming devices, 3) track token usage and 4) grant and/or renew software licenses for software executed on the remote gaming devices. The token usage may be used in utility based licensing schemes, such as a pay-per-use scheme.

In another embodiment, a game usage-tracking host 915 may track the usage of game software on a plurality of devices in communication with the host. The game usage-tracking host 915 may be in communication with a plurality of game play hosts and gaming machines. From the game play hosts and gaming machines, the game usage tracking host 915 may receive updates of an amount that each game available for play on the devices has been played and on amount that has been wagered per game. This information may be stored in a database and used for billing according to methods described in a utility based licensing agreement.

The game software host 902 may provide game software downloads, such as downloads of game software or game firmware, to various devious in the game system 900. For example, when the software to generate the game is not available on the game play interface 911, the game software host 902 may download software to generate a selected game of chance played on the game play interface. Further, the game software host 902 may download new game content to a plurality of gaming machines via a request from a gaming machine operator.

In one embodiment, the game software host 902 may also be a game software configuration-tracking host 913. The function of the game software configuration-tracking host is to keep records of software configurations and/or hardware configurations for a plurality of devices in communication with the host (e.g., denominations, number of paylines, paytables, max/min bets). Details of a game software host and a game software configuration host that may be used with the present invention are described in U.S. Pat. No. 6,645,077, by Rowe, entitled, "Gaming Terminal Data Repository and Information System," filed Dec. 21, 2000, which is incorporated herein in its entirety and for all purposes.

A game play host device 903 may be a host server connected to a plurality of remote clients that generates games of chance that are displayed on a plurality of remote game play interfaces 911. For example, the game play host device 903 may be a server that provides central determination for a bingo game play played on a plurality of connected game play interfaces 911. As another example, the game play host device 903 may generate games of chance, such as slot games or video card games, for display on a remote client. A game player using the remote client may be able to select from a number of games that are provided on the client by the host device 903. The game play host device 903 may receive game software management services, such as receiving downloads of new game software, from the game software host 902 and may receive game software licensing services, such as the granting or renewing of software licenses for software executed on the device 903, from the game license host 901.

In particular embodiments, the game play interfaces or other gaming devices in the gaming system 900 may be portable devices, such as electronic tokens, cell phones, smart cards, tablet PC's and PDA's. The portable devices may support wireless communications and thus, may be referred to as wireless mobile devices. The network hardware architecture 916 may be enabled to support communications between wireless mobile devices and other gaming devices in gaming system. In one embodiment, the wireless mobile devices may be used to play games of chance.

The gaming system 900 may use a number of trusted information sources. Trusted information sources 904 may be devices, such as servers, that provide information used to authenticate/activate other pieces of information. CRC values used to authenticate software, license tokens used to enable the use of software or product activation codes used to activate to software are examples of trusted information that might be provided from a trusted information source 904. Trusted information sources may be a memory device, such as an EPROM, that includes trusted information used to authenticate other information. For example, a game play interface 911 may store a private encryption key in a trusted memory device that is used in a private key-public key encryption scheme to authenticate information from another gaming device.

When a trusted information source 904 is in communication with a remote device via a network, the remote device will employ a verification scheme to verify the identity of the trusted information source. For example, the trusted information source and the remote device may exchange information using public and private encryption keys to verify each other's identities.

Gaming devices storing trusted information might utilize apparatus or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected.

The gaming system 900 of the present invention may include devices 906 that provide authorization to download software from a first device to a second device and devices 907 that provide activation codes or information that enable downloaded software to be activated. The devices, 906 and 907, may be remote servers and may also be trusted information sources. One example of a method of providing product activation codes that may be used with the present invention is describes in previously incorporated U.S. Pat. No. 6,264,561.

A device 906 that monitors a plurality of gaming devices to determine adherence of the devices to gaming jurisdictional rules 908 may be included in the system 900. In one embodiment, a gaming jurisdictional rule server may scan software and the configurations of the software on a number of gaming devices in communication with the gaming rule server to determine whether the software on the gaming devices is valid for use in the gaming jurisdiction where the gaming device is located. For example, the gaming rule server may request a digital signature, such as CRC's, of particular software components and compare them with an approved digital signature value stored on the gaming jurisdictional rule server.

Further, the gaming jurisdictional rule server may scan the remote gaming device to determine whether the software is configured in a manner that is acceptable to the gaming jurisdiction where the gaming device is located. For example, a maximum bet limit may vary from jurisdiction to jurisdiction and the rule enforcement server may scan a gaming device to determine its current software configuration and its location and then compare the configuration on the gaming device with approved parameters for its location.

A gaming jurisdiction may include rules that describe how game software may be downloaded and licensed. The gaming jurisdictional rule server may scan download transaction records and licensing records on a gaming device to determine whether the download and licensing was carried out in a manner that is acceptable to the gaming jurisdiction in which the gaming device is located. In general, the game jurisdictional rule server may be utilized to confirm compliance to any gaming rules passed by a gaming jurisdiction when the information needed to determine rule compliance is remotely accessible to the server.

Game software, firmware or hardware residing a particular gaming device may also be used to check for compliance with local gaming jurisdictional rules. In one embodiment, when a gaming device is installed in a particular gaming jurisdiction, a software program including jurisdiction rule information may be downloaded to a secure memory location on a gaming machine or the jurisdiction rule information may be downloaded as data and utilized by a program on the gaming machine. The software program and/or jurisdiction rule information may used to check the gaming device software and software configurations for compliance with local gaming jurisdictional rules. In another embodiment, the software program for ensuring compliance and jurisdictional information may be installed in the gaming machine prior to its shipping, such as at the factory where the gaming machine is manufactured.

The gaming devices in game system 900 may utilize trusted software and/or trusted firmware. Trusted firmware/software is trusted in the sense that is used with the assumption that it has not been tampered with. For instance, trusted software/firmware may be used to authenticate other game software or processes executing on a gaming device. As an example, trusted encryption programs and authentication programs may be stored on an EPROM on the gaming machine or encoded into a specialized encryption chip. As another example, trusted game software, i.e., game software approved for use on gaming devices by a local gaming jurisdiction may be required on gaming devices on the gaming machine.

In the present invention, the devices may be connected by a network 916 with different types of hardware using different hardware architectures. Game software can be quite large and frequent downloads can place a significant burden on a network, which may slow information transfer speeds on the network. For game-on-demand services that require frequent downloads of game software in a network, efficient downloading is essential for the service to remain viable. Thus, in the present inventions, network efficient devices 910 may be used to actively monitor and maintain network efficiency. For instance, software locators may be used to locate nearby locations of game software for peer-to-peer transfers of game software. In another example, network traffic may be monitored and downloads may be actively rerouted to maintain network efficiency.

One or more devices in the present invention may provide game software and game licensing related auditing, billing and reconciliation reports to server 912. For example, a software licensing billing server may generate a bill for a gaming device operator based upon a usage of games over a time period on the gaming devices owned by the operator. In another example, a software auditing server may provide reports on game software downloads to various gaming devices in the gaming system 900 and current configurations of the game software on these gaming devices.

At particular time intervals, the software auditing server 912 may also request software configurations from a number of gaming devices in the gaming system. The server may then reconcile the software configuration on each gaming device. In one embodiment, the software auditing server 912 may store a record of software configurations on each gaming device at particular times and a record of software download transactions that have occurred on the device. By applying each of the recorded game software download transactions since a selected time to the software configuration recorded at the selected time, a software configuration is obtained. The software auditing server may compare the software configuration derived from applying these transactions on a gaming device with a current software configuration obtained from the gaming device. After the comparison, the software-auditing server may generate a reconciliation report that confirms that the download transaction records are consistent with the current software configuration on the device. The report may also identify any inconsistencies. In another embodiment, both the gaming device and the software auditing server may store a record of the download transactions that have occurred on the gaming device and the software auditing server may reconcile these records.

There are many possible interactions between the components described with respect to FIG. 7. Many of the interactions are coupled. For example, methods used for game licensing may affect methods used for game downloading and vice versa. For the purposes of explanation, details of a few possible interactions between the components of the system 900 relating to software licensing and software downloads have been described. The descriptions are selected to illustrate particular interactions in the game system 900. These descriptions are provided for the purposes of explanation only and are not intended to limit the scope of the present invention.

Although the foregoing present invention has been described in detail by way of illustration and example for purposes of clarity and understanding, it will be recognized that the above described present invention may be embodied in numerous other specific variations and embodiments without departing from the spirit or essential characteristics of the present invention. Certain changes and modifications may be practiced, and it is understood that the present invention is not to be limited by the foregoing details, but rather is to be defined by the scope of the appended claims.

The invention claimed is:

1. A method of operating a gaming system, the method comprising:

establishing, by a server communication interface, communication with a gaming machine configured to operate a wagering game;

after establishing communication with the gaming machine and responsive to a determination occurring, based on a usage of the gamine machine, to allocate control of a first resource of a display device of the gaming machine to at least one server processor which is distinct from the gaming machine, receiving, by the server communication interface and from the gaming machine, game data associated with one or more plays of the wagering game;

causing, by the at least one server processor, the display device of the gaming machine to display content associated with a secondary game, wherein the displayed content of the secondary game is based at least in part on the received game data, the displayed content of the secondary game is in addition to any displayed content for the one or more plays of the wagering game, and the secondary game is not controlled by the gaming machine; and providing an award associated with the secondary game when an award condition is satisfied.

2. The method of claim 1, which includes, after establishing communication with the gaming machine, receiving, by the server communication interface and from the gaming machine, a player record locator for a player of the gaming machine.

3. The method of claim 2, which includes, responsive to receiving the player record locator, using, by the at least one server processor, the player record locator to determine a secondary game state for the player.

4. The method of claim 3, wherein the displayed content associated with the secondary game is based at least in part on the secondary game state for the player.

5. The method of claim 1, wherein the secondary game is a persistence game including a plurality of different achievements, and wherein the award condition is satisfied when the player has achieved a designated quantity of the achievements.

6. The method of claim 5, wherein the designated quantity of the achievements includes all of the achievements.

7. The method of claim 5, which includes controlling the secondary game based at least in part on the received game data by determining, by the at least one server processor, whether the player has achieved any of the achievements based on the received game data and, if so, updating, by the at least one server processor, a secondary game state for the player.

8. The method of claim 5, which includes receiving, by the server communication interface and from the gaming machine, a request to enroll a player of the gaming machine in the persistence game.

9. The method of claim 8, which includes, responsive to receiving the request to enroll, enrolling, by the at least one server processor, the player in the persistence game and determining, by the at least one server processor, the plurality of achievements.

10. The method of claim 1, which includes terminating, by the at least one server processor, the secondary game responsive to a termination condition being satisfied.

11. The method of claim 1, which includes, after establishing communication with the gaming machine, responsive to not receiving any message from the gaming machine within a designated time period, logging, by the at least one server processor, an error in at least one memory device.

12. A gaming system comprising:

a communication interface configured to establish communication with a gaming machine configured to operate a wagering game;

at least one processor distinct from the gaming machine; and at least one memory device that stores a plurality of instructions that, when executed by the at least one processor, cause the at least one processor to operate with the communication interface to:

establish communication with the gaming machine;

after establishing communication with the gaming machine and responsive to a determination occurring, based on a usage of the gaming machine, to allocate control of a first resource of a display device of the gaming machine to the at least one processor, receive, from the gaming machine, game data associated with one or more plays of the wagering game;

causing the display device of the gaming machine to display content associated with a secondary game, wherein the displayed content of the secondary game is based at least in part on the received game data, the displayed content of the secondary game is in addition to any displayed content for the one or more plays of the wagering game, and the secondary game is not controlled by the gaming machine; and provide an award associated with the secondary game when an award condition is satisfied.

13. The gaming system of claim 12, wherein the plurality of instructions, when executed by the at least one processor, cause the at least one processor to operate with the communication interface to, after establishing communication with the gaming machine, receive, from the gaming machine, a player record locator for a player of the gaming machine.

14. The gaming system of claim 13, wherein the plurality of instructions, when executed by the at least one processor, cause the at least one processor to, responsive to receiving the player record locator, use the player record locator to determine a secondary game state for the player.

15. The gaming system of claim 14, wherein the displayed content associated with the secondary game is based at least in part on the secondary game state for the player.

16. The gaming system of claim 12, wherein the secondary game is a persistence game including a plurality of different achievements, and wherein the award condition is satisfied when the player has achieved a designated quantity of the achievements.

17. The gaming system of claim 16, wherein the designated quantity of the achievements includes all of the achievements.

18. The gaming system of claim 16, wherein the plurality of instructions, when executed by the at least one processor, cause the at least one processor to control the secondary game based at least in part on the received game data by determining whether the player has achieved any of the achievements based on the received game data and, if so, updating a secondary game state for the player.

19. The gaming system of claim 16, wherein the plurality of instructions, when executed by the at least one processor, cause the at least one processor to operate with the communication interface to receive, from the gaming machine, a request to enroll a player of the gaming machine in the persistence game.

20. The gaming system of claim 19, wherein the plurality of instructions, when executed by the at least one processor, cause the at least one processor to, responsive to receiving the request to enroll, enroll the player in the persistence game and determine the plurality of achievements.

21. The gaming system of claim 12, wherein the plurality of instructions, when executed by the at least one processor, cause the at least one processor to terminate the secondary game responsive to a termination condition being satisfied.

22. The gaming system of claim 12, wherein the plurality of instructions, when executed by the at least one processor, cause the at least one processor to, after establishing communication with the gaming machine, responsive to not receiving any message from the gaming machine within a designated time period, log an error in the at least one memory device.

* * * * *